US006918489B2

(12) United States Patent
Harding et al.

(10) Patent No.: US 6,918,489 B2
(45) Date of Patent: Jul. 19, 2005

(54) DUNNAGE CONVERTER SYSTEM

(75) Inventors: Joseph J. Harding, Mentor, OH (US); Judith L. Skiba, Kingsville, OH (US); James A. Simmons, Jr., Painesville Township, OH (US); James Tekavec, Willoughby, OH (US); Edward W. Lintala, Concord, OH (US); Erwin Methorst, Holtum (NL); Koen H. M. Kuypers, Amsterdam (NL); Dan Coppus, Doenrade (NL); Robert Cheich, Independence, OH (US); Raymond P. M. Demers, Landgraaf (NL); Pierre Kobben, Kerkrade (NL)

(73) Assignee: Ranpak Corp., Cleveland, OH (US)

( * ) Notice: Subject to any disclaimer, the term of this patent is extended or adjusted under 35 U.S.C. 154(b) by 0 days.

(21) Appl. No.: 10/420,519

(22) Filed: Apr. 22, 2003

(65) Prior Publication Data

US 2003/0216236 A1 Nov. 20, 2003

Related U.S. Application Data

(60) Provisional application No. 60/433,548, filed on Dec. 13, 2002, provisional application No. 60/421,996, filed on Oct. 29, 2002, provisional application No. 60/412,127, filed on Sep. 18, 2002, and provisional application No. 60/375,149, filed on Apr. 22, 2002.

(51) Int. Cl.[7] ..... B65D 81/107

(52) U.S. Cl. ..... 206/451; 206/83.5; 206/494; 206/521; 428/181

(58) Field of Search ..... 206/83.5, 449, 206/451, 453, 454, 494, 499, 521, 586, 591–594; 428/181, 182

(56) References Cited

U.S. PATENT DOCUMENTS

| | | | | |
|---|---|---|---|---|
| 901,357 | A | * | 10/1908 | Lewis ..... 229/72 |
| 4,458,814 | A | * | 7/1984 | Meschi ..... 206/494 |
| 4,834,242 | A | * | 5/1989 | Selack et al. ..... 206/555 |
| 5,123,889 | A | | 6/1992 | Armington et al. |
| 5,387,173 | A | | 2/1995 | Simmons, Jr. |
| 5,779,049 | A | * | 7/1998 | Werby et al. ..... 206/451 |
| 5,836,538 | A | | 11/1998 | Lencoski et al. |
| 5,864,484 | A | | 1/1999 | Harding |
| 5,882,767 | A | | 3/1999 | Simmons, Jr. |
| 5,891,009 | A | | 4/1999 | Ratzel et al. |
| 5,897,478 | A | | 4/1999 | Harding et al. |
| 5,947,886 | A | | 9/1999 | Simmons |
| 6,015,374 | A | | 1/2000 | Murphy et al. |
| 6,120,428 | A | | 9/2000 | Ratzel |
| 6,168,847 | B1 | | 1/2001 | Murphy et al. |
| 2002/0091053 | A1 | | 7/2002 | Kung et al. |

* cited by examiner

*Primary Examiner*—Jim Foster
(74) *Attorney, Agent, or Firm*—Renner, Otto, Boisselle & Sklar, LLP

(57) ABSTRACT

An easy load packaging system, and a stand and a dunnage conversion machine therefor are disclosed. The stand includes a base and a pair of upright guide members mounted to the base and supporting at the upper ends thereof a dunnage conversion machine. The guide members define there between a channel for guiding sheet stock material to the dunnage conversion machine. The dunnage conversion machine is pivotable relative to the stand between an operating position and a servicing/loading position whereat access to internal components of the machine is simplified. A stack of sheet stock material is jacketed and/or baled for simplified loading into a packaging system or stand. An adhesive layer on the bottom or top of the stack enables the stack to be easily spliced to another stack.

13 Claims, 28 Drawing Sheets

DUNNAGE CONVERTER SYSTEM

RELATED APPLICATION DATA

This application claims the benefit under 35 USC 119(e) of earlier filed U.S. Provisional Application Nos. 60/433,548, filed on Dec. 13, 2002; 60/421,996, filed on Oct. 29, 2002; 60/412,127, filed on Sep. 18, 2002; and 60/375,149, filed on Apr. 22, 2002, all of which are hereby incorporated herein by reference in their entireties.

FIELD OF THE INVENTION

The present invention relates to a dunnage converter and, more particularly, to a dunnage converter and fan folded stock material therefor that enable improved loading ability of the stock material.

BACKGROUND OF THE INVENTION

Cushioning conversion machines convert sheet stock material into a relatively more dense strip of dunnage product which is useful in providing cushioning in packages. Typically, a conversion machine is mounted to a stand so that the conversion machine is at a height at which dunnage product produced by the machine may be easily accessed, for example, at eye level of the operator. Some conversion machine stands are equipped with the capability of tilting the conversion machine relative to horizontal and other stands enable the conversion machine to be swivelled in a horizontal plane.

In these prior conversion machines, sheet stock material is drawn from a supply, such as a roll of sheet stock material or a stack of fan folded sheet stock material, and into an upstream end of the machine. Although the sheet stock material usually follows a consistent path as it travels from the supply to the upstream end of the machine, when the conversion machine is operating at relatively high speeds, for example, as when a void fill product is being produced, or during starting and stopping of the machine, the sheet stock material may experience ripples or undulations. Sometimes, these undulations may initiate a tear in a lateral edge portion of the sheet stock material, possibly causing a machine jam or deleterious effects in the quality of the dunnage product.

Other machines are constructed in such a manner that access to components inside the machine, for example for assembly or servicing of the components, is hindered by the particular orientation of the machine or the complexity of the mounting arrangement of the components therein.

Various packaging systems also have been developed in which access to, for example, a dunnage conversion machine of the system is impeded by the particular arrangement of the system.

Thus, it would be desirable to provide a dunnage conversion machine and stand, as well as an improved packaging system, which embodies stock material guiding features in the stand, ease of access and serviceability to components within the machine and/or system, as well as improved overall ergonomics in such machines and/or systems.

SUMMARY OF THE INVENTION

The present invention provides a packaging system which provides easy access to components thereof. According to one general aspect of the invention, a stand guides sheet stock material to a dunnage conversion machine. According to another aspect of the invention, an infeed paper guide assembly of a dunnage conversion machine guides sheet stock material from a stock supply and through the dunnage conversion machine. According to a further general aspect of the invention, a pulling assembly motor and severing assembly motor are disposed in an L-shape configuration to support a dunnage conversion machine having a compact configuration.

More particularly and according to an aspect of the invention, there is provided a stand for a dunnage conversion machine, including a base, and a pair of upright guide members. The upright guide members are mounted to the base and support at the upper ends thereof a dunnage conversion machine. The guide members define there between a channel for guiding sheet stock material to the dunnage conversion machine.

According to another aspect of the invention, there is provided a dunnage conversion machine, including converting sub-assemblies, and an infeed paper guide assembly. The converting sub-assemblies convert sheet stock material into a dunnage product. The infeed paper guide assembly is upstream of the converting sub-assemblies. The infeed paper guide assembly is moveable between an open position whereat access is provided to a portion of a travel path of the sheet stock material and a closed position whereat the infeed paper guide assembly guides the sheet stock material along the travel path.

According to another aspect of the invention, there is provided a dunnage conversion machine, including a pulling assembly, a severing assembly, and a frame having an L-shaped configuration. The pulling assembly pulls sheet stock material through the dunnage conversion machine thereby to convert the sheet stock material into a strip of dunnage. The pulling assembly is powered by a pulling assembly motor having a pulling assembly motor axis. The severing assembly severs the strip of dunnage into a dunnage product. The severing assembly is powered by a severing assembly motor having a severing assembly motor axis. The pulling assembly motor is mounted to the frame so that its axis is parallel to one leg of the L-shape configuration, and the severing assembly motor is mounted to the frame so that its axis is parallel to the other leg of the L-shape configuration.

According to still another aspect of the invention, there is provided a packaging system, including a dunnage conversion machine and a packing surface. The dunnage conversion machine is disposed above the packing surface.

According to another aspect of the invention, there is provided a packaging system, including a dunnage conversion machine, a stock supply assembly and a gangway. The stock supply assembly supplies sheet stock material to the dunnage conversion machine. The gangway provides access to the stock supply assembly.

According to another aspect of the invention, there is provided a packaging system, including an elevated support member, a dunnage conversion machine, and a stock supply assembly. The dunnage conversion machine is mounted to the elevated support member so that the dunnage conversion machine is suspended from the elevated support member. The stock supply assembly supplies sheet stock material to the dunnage conversion machine.

According to another aspect of the invention, there is provided a dunnage conversion system, including a dunnage conversion machine and a stand. The stand supports the dunnage conversion machine and supports a stack of sheet stock material below the dunnage conversion machine from which the dunnage conversion machine draws sheet stock material and converts it into a strip of dunnage product. The stand includes a pair of transversely spaced upright channel members having longitudinally extending transversely spaced apart left and right inner-facing walls and transversely extending longitudinally spaced front and rear guide walls extending inwardly from the inner-facing guide walls. The width between right and left sides of the stack of sheet stock material is greater than the distance between the inner edges of the guide walls and less than the distance between the inner-facing walls of the stand, and the distance between the front and rear sides of the stack of sheet stock material is less than the distance between the front and rear guide walls of the stand. The stack of sheet stock material is supported between the upright channel members and the upright channel members guide the sheet stock material to the dunnage conversion machine as the dunnage conversion machine draws sheet stock material therefrom.

According to another aspect of the invention, there is provided a method of loading a rectangular stack of sheet stock material into a stand for a dunnage conversion machine, wherein the stand has a pair of transversely spaced upright channel members having longitudinally extending transversely spaced apart left and right inner-facing walls and transversely extending longitudinally spaced front and rear guide walls extending inwardly from the inner-facing guide walls, and wherein the width between right and left sides of the stack is greater than the distance between the inner edges of the guide walls and less than the distance between the inner-facing walls of the stand, and the distance between the front and rear sides of the stack is less than the distance between the front and rear guide walls of the stand, the method including the steps of inserting the right or left side of the stack between the guide members, tilting the stack such that first and second diagonally opposite corners thereof are between the inner-facing walls of the stand, moving the right or left side of the stack towards the respective right or left inner-facing wall of the stand, tilting the stack such that the right and left sides of the stack are disposed inwardly of the respective right and left walls of the stand, shifting the stack laterally towards the left or right inner-facing walls to substantially center the stack between the inner-facing walls.

According to another aspect of the invention, there is provided a dunnage conversion system, including a dunnage conversion machine and a stand. The dunnage conversion machine converts sheet stock material into a dunnage product, and includes a pulling assembly for pulling sheet stock material into the dunnage conversion machine and an outlet through which the dunnage product is discharged. The dunnage conversion machine is pivotably mounted to the stand for movement between an operating position whereat the outlet of the dunnage conversion machine faces the front of the system, and one or more servicing/loading positions whereat a feeding end of the pulling assembly faces the front of the system for operator access thereto.

According to another aspect of the invention, there is provided a dunnage conversion system, including a dunnage conversion machine and a stand. The dunnage conversion machine converts sheet stock material into a dunnage product and includes a severing assembly for severing the strip of dunnage to a desired length and a cover for covering the severing assembly. The stand includes a pair of upright guide members. The width of the upright guide members is greater than the width of the cover. The dunnage conversion machine is pivotably mounted to the stand for movement between an operating position whereat the dunnage conversion machine discharges the strip of dunnage in front of the system, and one or more servicing/loading positions whereat the cover of the severing assembly is disposed between the upright guide members.

According to another aspect of the invention, there is provided a dunnage conversion system, including a dunnage conversion machine and a stand. The dunnage conversion machine converts sheet stock material into a dunnage product. The dunnage conversion machine is pivotably mounted to the stand for movement between an operating position whereat the dunnage conversion machine is in an upright position and one or more servicing/loading positions whereat the dunnage conversion machine is at least partially inverted.

According to another aspect of the invention, there is provided a baled stack of sheet stock material for use with a dunnage conversion machine. The baled stack includes a stack of fan-folded sheet stock material and a jacket for at least partially surrounding the stack. At least one bale tie secures the jacket to the stack of sheet stock material.

According to another aspect of the invention, there is provided a jacketed stack of sheet stock material for use with a dunnage conversion machine. The jacketed stack includes a stack of fan-folded sheet stock material, and a jacket having bottom tabs that underlie the stack and that are moveable away from one another to enable the tabs to be removed from beneath the stack.

According to another aspect of the invention, there is provided a stack of sheet stock material for use with a dunnage conversion machine. The stack includes a stack of fan-folded sheet stock material having a top and a bottom, an adhesive layer at least on the top or on the bottom of the stack, and a release liner covering the adhesive layer.

According to another aspect of the invention, there is provided a method of loading a stack of sheet stock material onto a second stack of sheet stock material, including the steps of providing first and second stacks of sheet stock material with an adhesive layer applied to the top of the first stack or the bottom of the second stack, and setting the second stack on top of the first stack, whereby the adhesive bonds the top page of the first stack to the bottom page of the second stack.

According to another aspect of the invention, there is provided a method of loading a stack of sheet stock material onto a second stack of sheet stock material, including the steps of providing first and second stacks of sheet stock material with an adhesive layer applied to the top of the first stack or the bottom of the second stack and a release liner covering the adhesive layer, setting the second stack on top of the first stack, and pulling the release liner from between the stacked stacks of sheet stock material to expose the adhesive layer, whereby the adhesive bonds the top page of the first stack to the bottom page of the second stack.

According another aspect of the invention, there is provided a baled stack of sheet stock material for use with a dunnage conversion machine. The stack includes a stack of fan-folded sheet stock material; a jacket having at least two flaps forming an L-shape cross section, a corner of the stack being disposed adjacent the corner of the L-shaped jacket; and at least one bale tie for securing the jacket to the stack of sheet stock material.

According another aspect of the invention, there is provided a dunnage conversion machine for converting sheet stock material into a dunnage product. The machine includes a forming assembly for shaping the sheet stock material into a continuous strip of dunnage; a pulling assembly positioned downstream from the forming assembly for advancing the sheet material through the forming assembly; wherein the forming assembly includes a funnel portion through which the sheet stock material passes for shaping the sheet stock material into the strip of dunnage and directing the formed strip to the pulling assembly.

According another aspect of the invention, there is provided a dunnage conversion machine for converting sheet stock material into a dunnage product. The machine includes a forming assembly for shaping the sheet stock material into a continuous strip of dunnage; a pulling assembly positioned downstream from the forming assembly for advancing the sheet material through the forming assembly; wherein the forming assembly includes an annular array of rollers through which the sheet stock material passes for shaping the sheet stock material into the strip of dunnage and directing the formed strip to the pulling assembly.

According another aspect of the invention, there is provided a dunnage conversion machine for converting sheet stock material into a dunnage product. The machine includes first and second pulling assemblies, each pulling assembly including at least two grippers movable together through a dunnage transfer region in opposition to one another and cooperative to grip therebetween the sheet stock material for advancing the same through the transfer region, and at least one of the grippers including an aperture operative to gather and laterally capture therein the sheet stock material as the grippers move through the transfer region; wherein the first pulling assembly is downstream from the forming assembly and the second pulling assembly is downstream from the first pulling assembly; and wherein the first pulling assembly operates at a different speed than the second pulling assembly to longitudinally crumple the strip of dunnage passing through the dunnage transfer region.

According another aspect of the invention, there is provided a dunnage conversion machine for converting sheet material into a dunnage product. The machine includes a pulling assembly for advancing the sheet material through the machine; the pulling assembly including at least two opposed grippers, at least one of which is moveable through a dunnage transfer region in opposition to the other gripper and cooperative to grip therebetween the sheet stock material for advancing the sheet stock material through the transfer region, and the moving gripper including an aperture operative to gather and laterally capture therein the sheet stock material as the gripper moves through the transfer region; wherein the moving gripper with the aperture includes a plurality of projections protruding from its inner edge to aid in gripping the sheet stock material.

According another aspect of the invention, there is provided a dunnage conversion machine for converting sheet material into a dunnage product. The machine includes a pulling assembly for advancing the sheet material through the machine; the pulling assembly including a pair of rotatable transfer members each having a concave outer surface and a plurality of protruding elements extending from the concave outer surface, the transfer members being in opposition to one another to define a dunnage transfer region therebetween, and being cooperative when rotating to gather and laterally capture sheet material therebetween and to advance the sheet material through the transfer region.

According another aspect of the invention, there is provided a dunnage conversion machine for converting sheet material into a dunnage product. The machine includes a pulling assembly for advancing the sheet material through the machine; the pulling assembly including a pair of rotatable transfer members each having a cylindrical outer surface and a plurality of protruding elements extending from the cylindrical surface, the transfer members being in opposition to one another to define a dunnage transfer region therebetween, and being cooperative when rotating to gather and laterally capture sheet material therebetween and to advance the sheet material through the transfer region.

According another aspect of the invention, there is provided a dunnage conversion machine for converting sheet material having at least two layers thereof folded flat along their length and joined together along an edge fold into a dunnage product. The machine includes a pulling assembly for advancing the flat folded sheet material through the machine; an expanding device operative, as the flat folded sheet material passes therethrough, to separate adjacent layers of the flat folded sheet material from one another to form an expanded strip of sheet material; the pulling assembly including at least two grippers movable together through a transfer region in opposition to one another and cooperative to grip therebetween the expanded strip of sheet material for advancing the same through the transfer region, and at least one of the grippers including an aperture operative to gather and laterally capture therein the expanded strip of sheet material as the grippers move through the transfer region.

According another aspect of the invention, there is provided a method of converting sheet material having at least two layers thereof folded flat along their length and joined together along an edge fold into a dunnage product. The method includes the steps of including the steps of using a pulling assembly for advancing the sheet material through the machine; wherein the step of advancing the flat folded sheet material includes moving grippers together through a transfer region in opposition to one another to cooperatively grip therebetween the flat folded sheet material and advance the flat folded sheet material through the transfer region, while an aperture in at least one of the grippers gathers and laterally captures therein the flat folded sheet material as the grippers are moved through the transfer region.

According another aspect of the invention, there is provided a dunnage conversion machine for converting sheet material into a dunnage product. The machine includes a pulling assembly for advancing the sheet material through the machine; the pulling assembly including at least two grippers movable together through a transfer region in opposition to one another and cooperative to grip therebetween the dunnage strip for advancing the dunnage strip through the transfer region, and at least one of the grippers including an aperture operative to gather and laterally capture therein the dunnage strip as the grippers move through the transfer region; and a software controller for controlling the speed of the pulling assembly.

According another aspect of the invention, there is provided a method of converting sheet material into a dunnage product. The method includes the steps of using a pulling assembly for advancing the sheet material through the machine; wherein the step of advancing the sheet material includes moving grippers together through a transfer region in opposition to one another to cooperatively grip therebetween the sheet material and advance the sheet material through the transfer region, while an aperture in at least one of the grippers gathers and laterally captures therein the sheet material as the grippers are moved through the transfer region; further including ramping the speed of the pulling assembly up before starting a conversion process.

According another aspect of the invention, there is provided a method of converting sheet material into a dunnage product. The method includes the steps of using a pulling assembly for advancing the sheet material through the machine; wherein the step of advancing the sheet material includes moving grippers together through a transfer region in opposition to one another to cooperatively grip therebetween the sheet material and advance the sheet material through the transfer region, while an aperture in at least one of the grippers gathers and laterally captures therein the sheet material as the grippers are moved through the transfer region; further including ramping the speed of the pulling assembly down after a conversion process is completed.

According another aspect of the invention, there is provided a method of converting sheet material into a dunnage product. The method includes the steps of using a pulling assembly for advancing the sheet material through the machine; wherein the step of advancing the sheet material includes moving grippers together through a transfer region in opposition to one another to cooperatively grip therebetween the sheet material and advance the sheet material through the transfer region, while an aperture in at least one of the grippers gathers and laterally captures therein the sheet material as the grippers are moved through the transfer region; further including adjusting the speed of the pulling assembly to one of a plurality of pre-programmed speeds before using the pulling assembly to advance the sheet material through the machine.

According another aspect of the invention, there is provided a method of converting sheet material into a dunnage product. The method includes the steps of using a pulling assembly for advancing the sheet material through the machine; wherein the step of advancing the sheet material includes moving grippers together through a transfer region in opposition to one another to cooperatively grip therebetween the sheet material and advance the sheet material through the transfer region, while an aperture in at least one of the grippers gathers and laterally captures therein the sheet material as the grippers are moved through the transfer region; further including operating the pulling assembly at a first speed; and operating the pulling assembly at a second speed.

DETAILED DESCRIPTION

Figure 1:
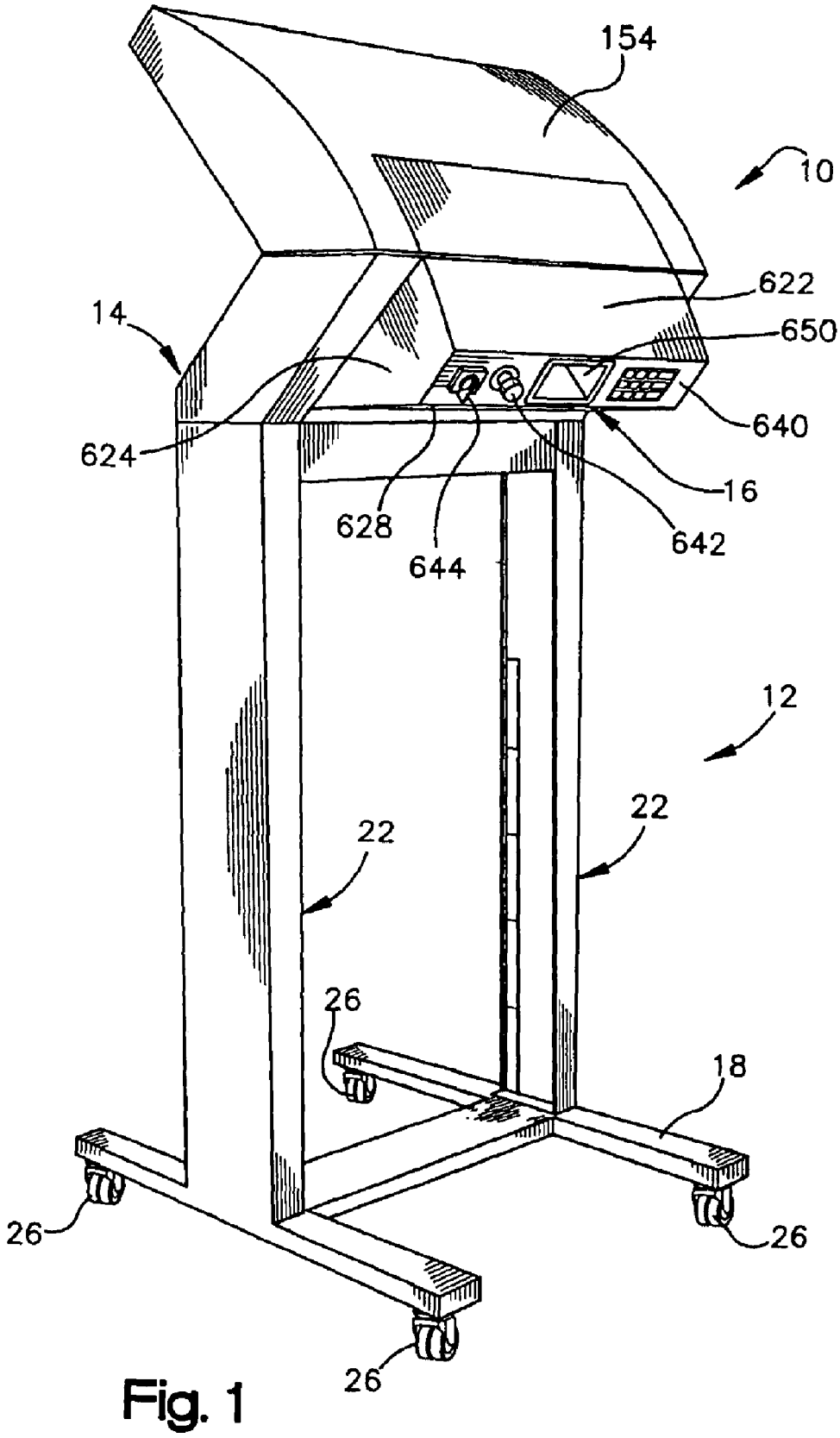
FIG. 1 is a front perspective view of a dunnage conversion machine and a stand in accordance with the present invention.

Referring now to the drawings in detail and initially to FIGS. 1 to 4, there is shown a dunnage conversion machine 10 and a stand 12 in accordance with the present invention. The dunnage conversion machine 10 converts a sheet-like stock material, such as one or more layers of recyclable and reusable Kraft paper, into a strip of dunnage including, for example, a relatively narrow three dimensional strip or rope of a generally cylindrical shape. The machine 10 has an upstream end 14 at which sheet stock material is supplied to the machine 10, and a downstream end 16 from which the machine 10 discharges dunnage product. As used herein, the terms upstream and downstream refer to a travel path of sheet stock material, illustrated at 15 (FIG. 8), as it passes from the stand 12 to the outlet of the dunnage conversion machine 10 as a strip of dunnage product. The dunnage product is used as an environmentally responsible protective packaging material typically used as void fill or cushioning during shipping. The stand 12 is oriented in a generally vertical manner and includes a base 18 and a pair of upright guide members 22 to which the machine's frame is mounted. The bottom corners of the base 18 include wheels 26 so that the stand 12 and machine 10 may be moved easily.

Figure 5:
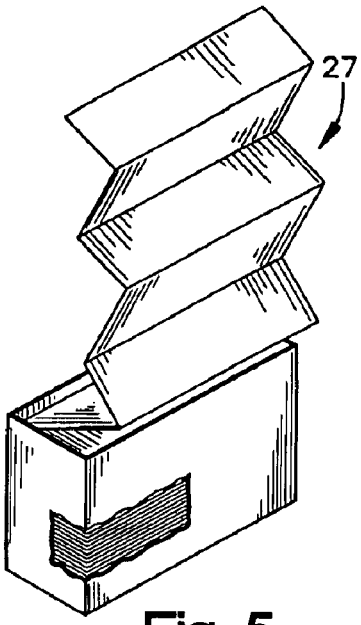
FIG. 5 is a perspective view of a stock supply in the form of a stack of fan-folded sheet stock material for use in the dunnage conversion machine and stand of FIG. 1.

A stock supply 27 supplies sheet stock material to the upstream end 14 of the machine 10. In the illustrated embodiment, the stock supply 27 is separate from the machine 10 and includes a stack of fan-folded sheet stock material such as that shown if FIG. 5, which rests on the base 18 of the stand 12 between the upright guide members 22.

It will be appreciated that the stock supply 27 may be any desired type for supplying sheet material to the conversion machine 10. For example, as an alternative, the stock supply 27 may be in the form of a roll of sheet stock material mounted on an axle and suitably supported at its ends by the stand 12. Alternatively, the axle of the stock roll may be supported on a separate cart and be disposed adjacent or next to the stand 12. The advantage to fan-folded sheet stock material, in contrast to a stock roll of sheet material, is that there is minimal or no inertia to overcome. Also, increased operating speeds are possible, and edge-tension problems are minimized, when the fan-folded stock material is used instead of rolled stock material. Also, although in the illustrated embodiment the fan-folded stock material comprises a single ply of the sheet material, multi-ply arrangements, such as two-ply or three-ply arrangements, may alternatively be used in the present invention. The number of plies of the sheet material may vary depending upon the characteristics of the dunnage conversion machine being used and/or the desired qualities of the dunnage product being created.

Each upright guide member 22 includes an inner side wall 30, an outer side wall 32 spaced from the inner side wall 30 by a gap G, a front wall 34, and a rear wall 36. The rear walls 36 span the gap between the inner and outer side walls 30 and 32 and connect the rear edges thereof. Similarly, the front walls 34 span the gap G between the inner and outer side walls 30 and 32 and connect the front edges thereof. The front walls 34 extend inwardly beyond the respective inner side walls 30 to form a pair of respective front guide surfaces 44. A transverse support member 48 is connected to and extends between the guide members 22 at the upper most end of the guide members 22.

Figure 3:
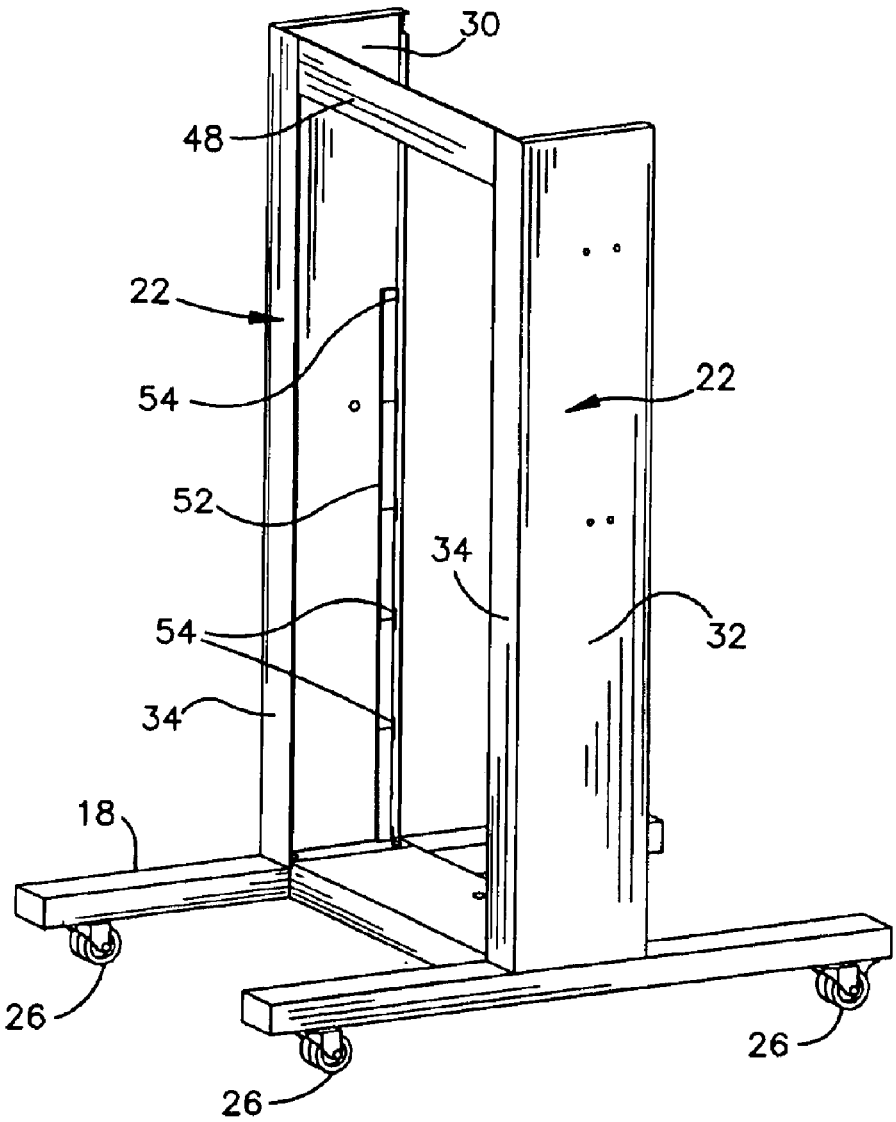
FIG. 3 is a front perspective view of the stand of FIG. 1.
Figure 4:
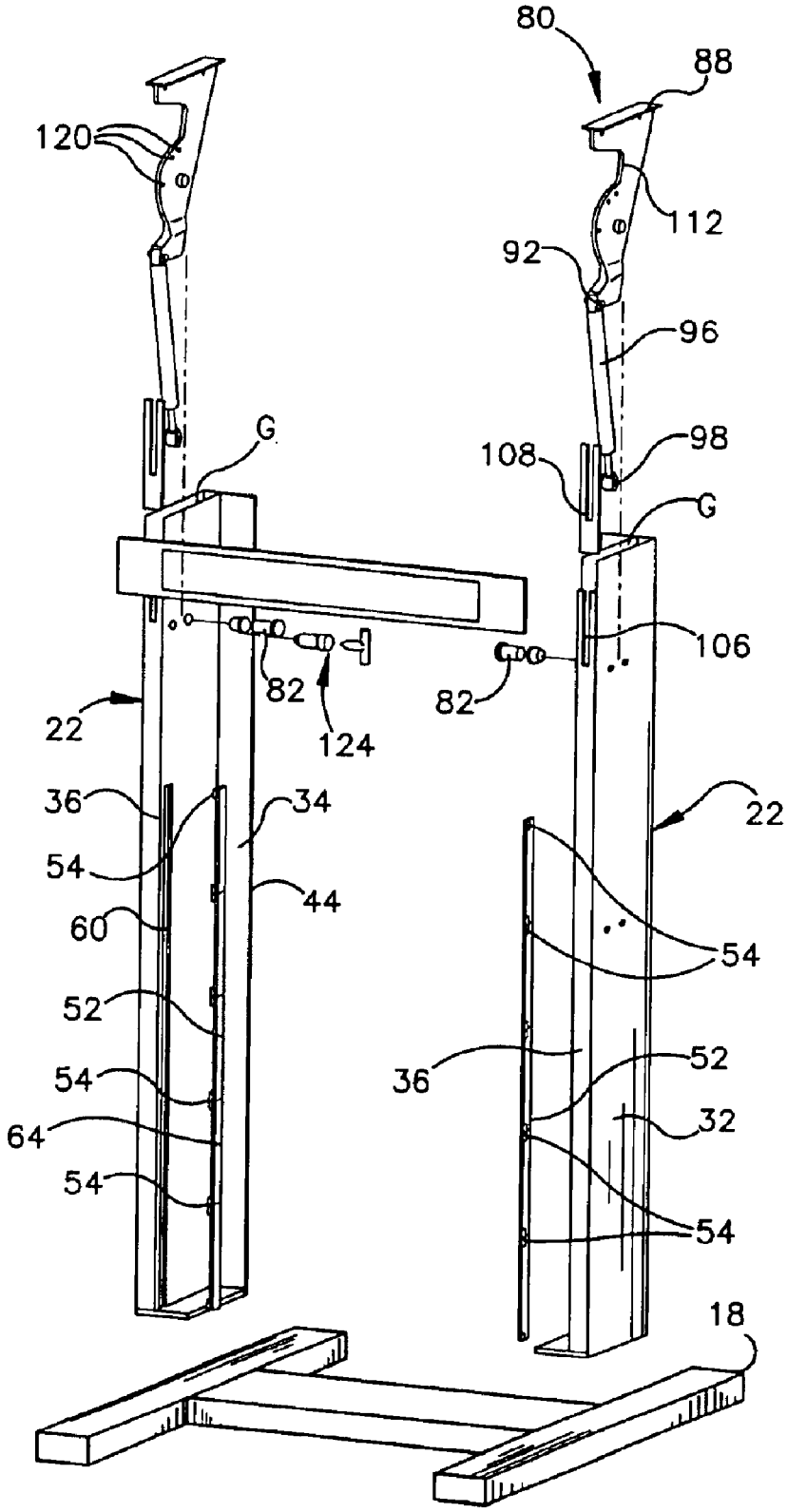
FIG. 4 is an exploded front perspective view of the stand of FIG. 1, showing in greater detail the components which make up the stand.

Referring to FIGS. 3 and 4, a pair of vertically extending catches 52 are hingedly connected via hinges 54 at or near the corner formed by the respective inner side walls 30 and rear walls 36 of the upright guide members 22. The inner side walls 30 each include a vertical slot or opening 60 sized for receipt there through of the respective catches 52. The catches 52 are pivotable between an open position in which the catches 52 retracted into the respective slots 60, and a closed position in which the catches 52 extend inwardly towards one another such rear guide surfaces 64 are oppositely disposed from the front guide surfaces 44 of the front walls 34. The catches 52 are spring biased towards their closed positions.

In accordance with the present invention, when a stack of fan folded sheet stock material (FIG. 5) having a width slightly less than the distance between the upright guide channels 22 (and slightly greater than the distance between the innermost edges of the catches 52) and a depth slightly less than the distance between the front and rear guide surfaces 44 and 64 is inserted from the rear of the stand 12 between the guide members 22, the catches 52 deflect outwardly relative to one another and retract into their respective vertical slots 60. This enables the fan folded sheet stock material to be pushed toward the front guide surfaces 44 of the guide members 22. Once the stack of fan folded sheet stock material abuts the front guide surfaces 44, the catches 52 spring back to their original biased positions, thereby capturing the stack of fan folded sheet stock material between the front guide surfaces 44 and the rear guide surfaces 64. The front and rear guide surfaces 44 and 64 prevent or at least reduce the likelihood of the stack of fan folded sheet stock material from tipping either rearwardly or forwardly out from the stand 12, while the inner side walls 30 of the respective guide members 22 prevent or at least reduce the likelihood of the stack of fan folded sheet stock material from moving laterally within the stand 12. It has been found that this is particularly useful when the stand is moved from one location to another on the wheels 26.

Figure 6:
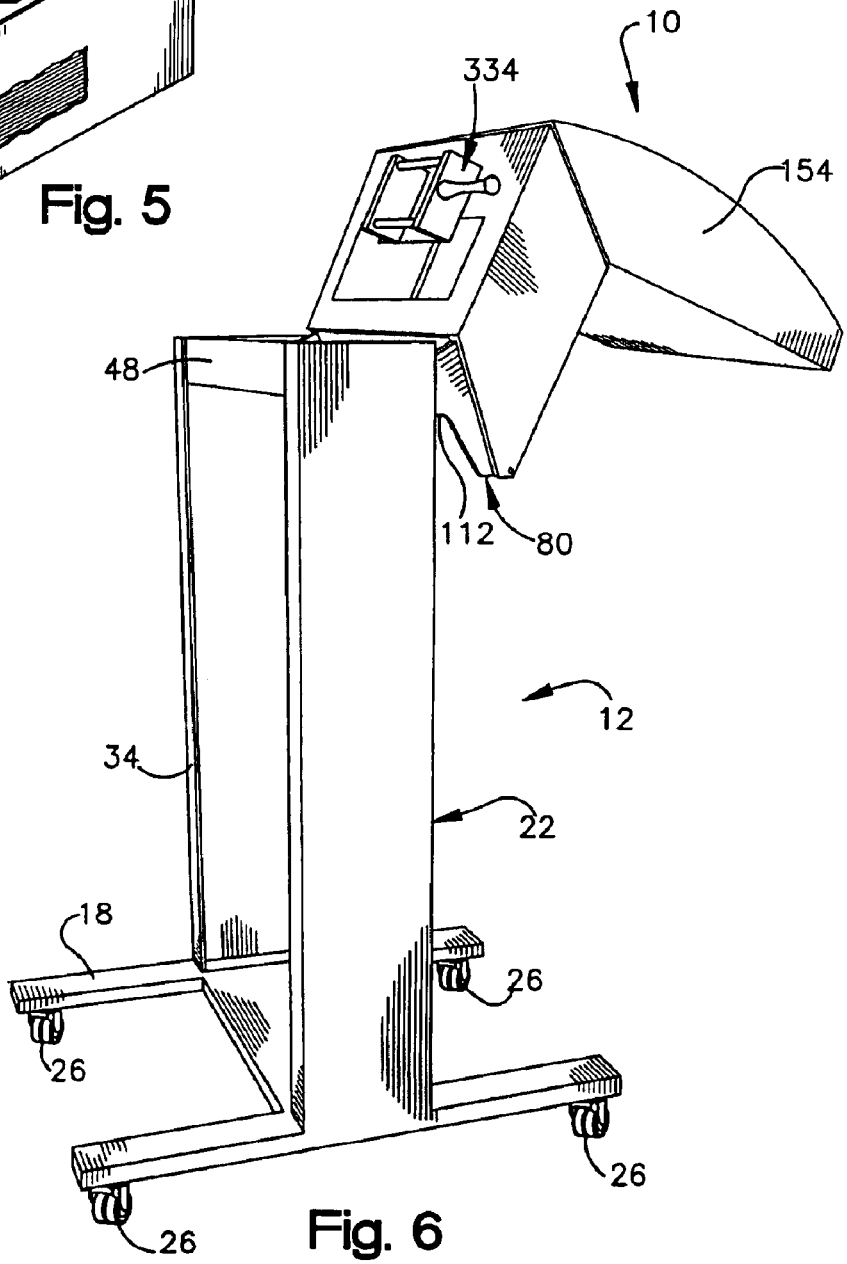
FIG. 6 is a front perspective view of the dunnage conversion machine and stand of FIG. 1, with the dunnage conversion machine shown pivoted to a servicing/loading position, and with a cover of the dunnage conversion machine removed for viewing components of the machine.

Referring now to FIGS. 3, 4 and 6, the dunnage conversion machine 10 is mounted to the stand 12 via a pair of hinge plates 80. Each hinge plate 80 includes a transversely extending hinge pin 82 which is rotatably supported in a suitable manner at its opposite ends in the inner and outer side walls 30 and 32 of the respective upright guide members 22. The hinge plates 80 include at one end thereof a T-shaped flange 88 to which the dunnage conversion machine 10 is suitably mounted, and at the opposite end thereof a transversely extending pivot pin 92, which couples the hinge plate 80 to one end of a gas compression spring 96 to enable relative pivotal movement between the hinge plate 80 and the gas compression spring 96. At the opposite end of the gas compression spring 96, there is provided a transversely extending pivot pin 98 which is supported in a suitable manner at its opposite ends by the inner and outer side walls 30 and 32 of the respective guide members 22.

The hinge plates 80, and consequently the dunnage conversion machine 10 mounted thereto, may be pivoted between a dunnage conversion machine operating position (FIGS. 1 and 2) and a dunnage conversion machine service/loading position (FIG. 6). The gas compression spring 96 dampens sudden movement of the dunnage conversion machine 10 between its operating position and service/loading position.

Figure 2:
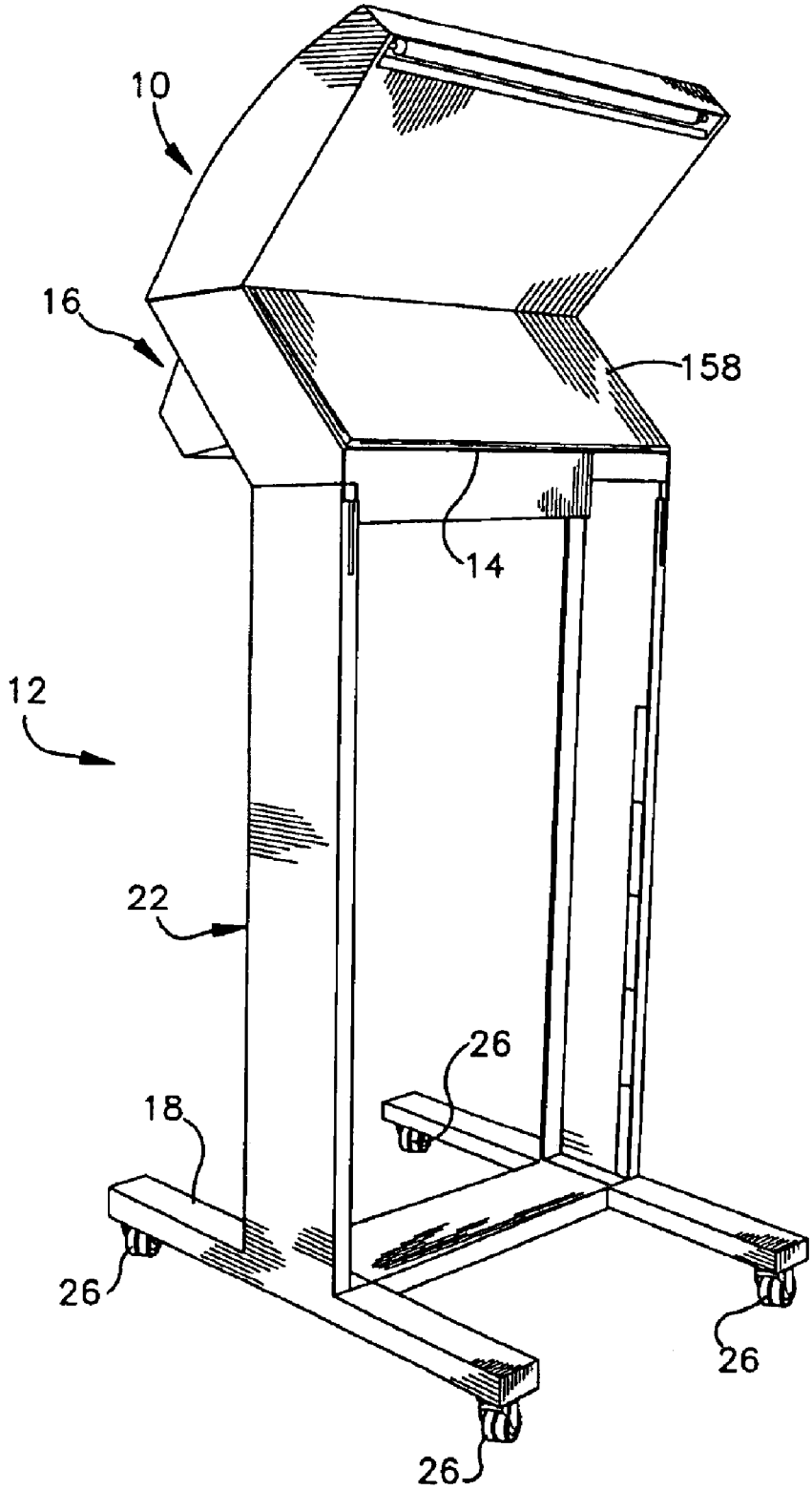
FIG. 2 is a rear perspective view of the dunnage conversion machine and stand of FIG. 1.

As is shown in FIGS. 1 and 2, the hinge plates 80 fully retract between the inner and outer side walls 30 and 32 of the respective upright guide members 22 when the dunnage conversion machine 10 is in its operating position. When the dunnage conversion machine 10 is moved from the operating position to the service/loading position, and accordingly the hinge plate 80 is pivoted about the hinge pin 82, the hinge plate 80 exerts a pulling force on the gas compression spring 96 through the pivot pin 92. Once the pulling force exceeds the resistance provided by the gas compression spring 96, the hinge plate 80 can be pivoted and the dunnage conversion machine 10 may be pivoted to the service/loading position.

As is shown in FIG. 4, the rear walls 36 of the guide members 22 have slots 106 which accommodate the hinge plates 80 when the dunnage conversion machine 10 is in the service/loading position. The perimeters of the slots 106 are reinforced via respective reinforcing brackets 108 which fit between the inner and outer side walls 30 and 32 and are suitably connected to the inner surface of the rear walls 36. Each hinge plate 80 has a relief portion or cut-out 112, enabling the hinge plate 80 to be pivoted such that the top surface of its T-shaped flange 88 is approximately perpendicular relative to the horizontal as is illustrated in FIG. 6.

Each hinge plate 80 includes a plurality of transversely extending adjustment holes 120 disposed on a circumference spaced a radial distance from the transverse hinge pin 82. Each adjustment hole 120 in the respective hinge plates 80 corresponds to a position to which the dunnage conversion machine 10 may be rotated. In the illustrated exemplary embodiment, each hinge plate 80 has three adjustment holes 120, wherein one adjustment hole 120 corresponds to the dunnage conversion machine operating position, another adjustment hole 120 corresponds to the dunnage conversion machine servicing/loading position, and an intermediate adjustment hole 120 corresponds to a position intermediate the dunnage conversion machine operating position and the dunnage conversion machine servicing/loading position.

A spring actuated actuator pin 124 is provided in each upright guide member 22 (only one is shown in the Figures) and is spring biased in the corresponding adjustment hole 120 when the adjustment hole 120 and actuator pin 124 are brought into alignment. The actuator pin 124 thereby secures the dunnage conversion machine 10 in the desired position. To move the dunnage conversion machine 10 to a different position, the actuator pin 124 is pulled out from its corresponding adjustment hole 120 and the dunnage conversion machine 10 is pivoted until a different adjustment hole 120 aligns with the actuator pin 124, whereupon the actuator pin 124 automatically snaps back into a different adjustment hole 120 to secure the dunnage conversion machine 10 in its different (new) position.

As is shown in FIG. 6, when the dunnage conversion machine 10 is pivoted to its servicing/loading position, internal components of the dunnage conversion machine 10 which may otherwise be difficult to gain access to, are more easily accessible by an operator or user. In any event, the multiple positions to which the dunnage conversion machine 10 may be positioned provide multiple points of access to service the machine 10. Also, as is further described below, initial feeding of sheet stock into the dunnage conversion machine 10 is simplified when the dunnage conversion machine is in its servicing/loading position.

Figure 7:
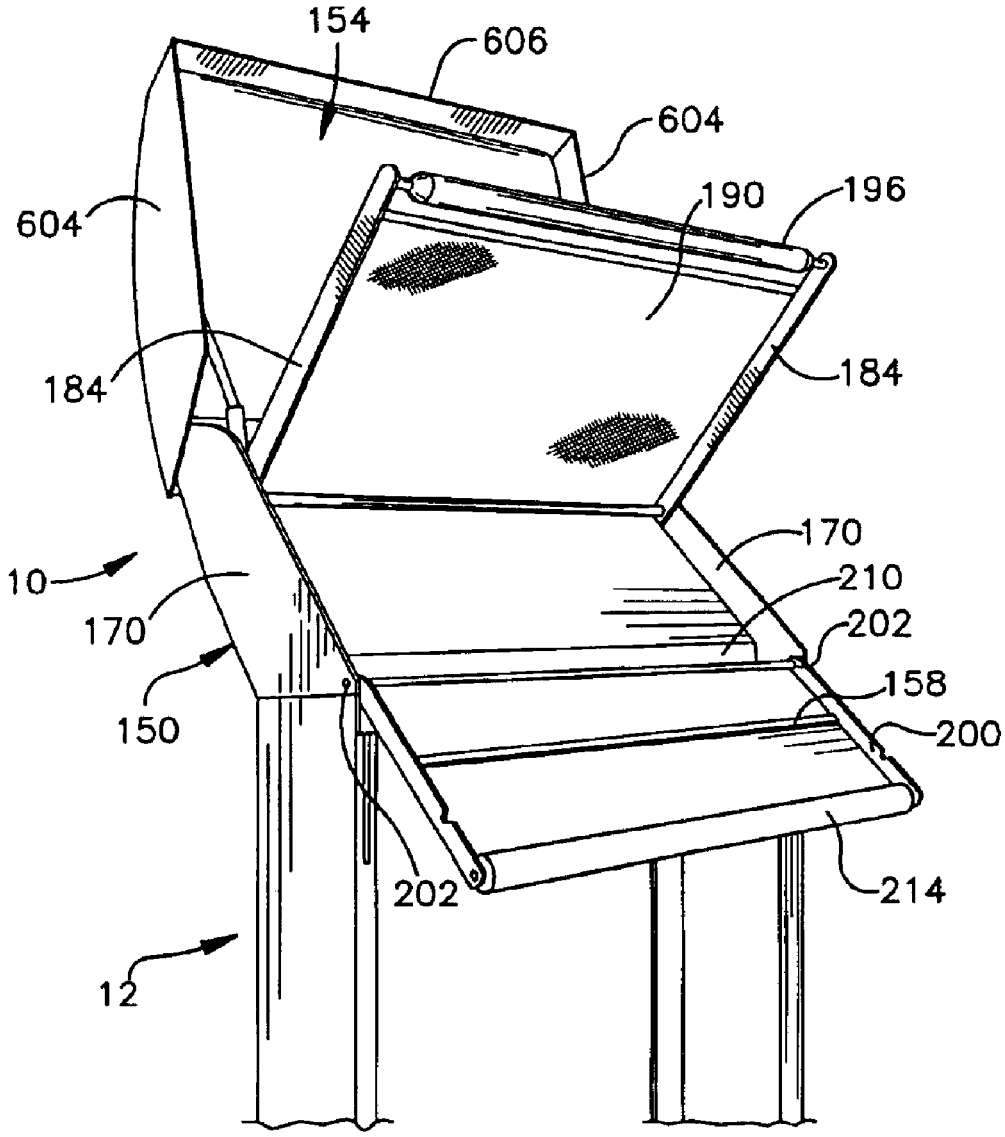
FIG. 7 is a rear perspective view of the dunnage conversion machine and upper portion of the stand of FIG. 1, with a hood and a swing open guide panel of the conversion machine shown in an open position.
Figure 8:
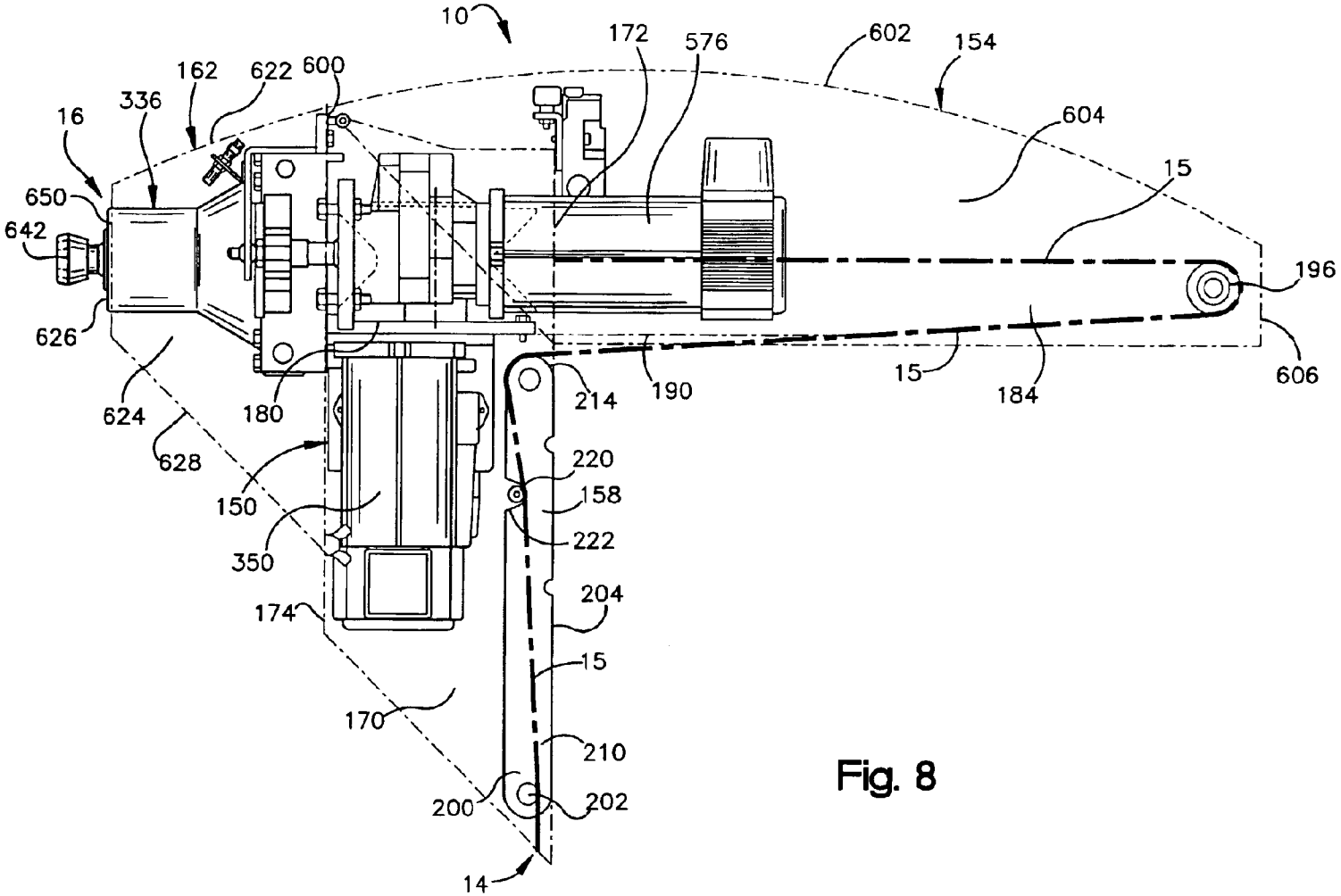
FIG. 8 is a side elevational view of the dunnage conversion machine of FIG. 1, showing the internal components of the machine, and showing in phantom lines a frame, cover and hood of the conversion machine.

Referring now to FIGS. 1, 7 and 8, the dunnage conversion machine 10 includes a frame 150 which is mounted to the stand 12, several conversion sub-assemblies mounted to the frame 150 which convert the sheet stock material into a dunnage product, a hood 154 which covers various of the conversion sub-assemblies, and an infeed paper guide assembly 158 which simplifies loading and/or splicing sheet stock material. The dunnage conversion machine 10 also includes a cover 162 at the downstream end thereof which covers various of the conversion sub-assemblies and has secured thereto various control features of the dunnage conversion machine 10.

The frame 150 includes a pair of side walls 170, upstream and transversely extending upstream and downstream walls 172 and 174 connected at their lateral edges to the side walls 170. As is shown in FIG. 8, the upstream wall 172 is shorter in height than the downstream wall 174. The side walls 170 are parallel to each other and perpendicular to the upstream and downstream walls 172 and 174. The frame 150 also includes a transversely extending internal support wall 180 which extends in an upstream-downstream manner from the bottom of the upstream wall 172 to the downstream wall 174 so as to form a T-shaped configuration with the downstream wall 174. A pair of laterally spaced side arms 184 project perpendicularly from the respective side walls 170 and a guide panel 190 is connected at its lateral edges to the respective side arms 184. The illustrated guide panel 190 is perforated to reduce weight of same. A constant entry roller 196 is rotatably mounted at its lateral ends to the distal ends of the respective side arms 184. The constant entry roller 196 provides a constant entry path to the converting sub-assemblies of the dunnage conversion machine 10.

The infeed paper guide assembly 158 includes a pair of side arms 200 and a guide panel 204 which is connected at its lateral edges to the side arms 200. The illustrated guide panel 204 is perforated to reduce the weight of same. One end of the respective side arms 200 is mounted at 202 for pivotable movement to the respective side walls 170. The pivot connection 202 enables the infeed paper guide assembly 158 to be pivoted from an open position as shown in FIG. 7 and a closed position as shown in FIG. 8. In the closed position, the infeed paper guide assembly 158 resides between the side walls 170 of the frame 150. In the open position, the infeed paper guide assembly 158 is about 180° from its closed position.

A transversely extending guide bar 210 is mounted at its ends to the respective side walls 170 and has an axis coincident with that of the pivot connection 202. A gap is provided between the guide bar 210 and the guide panel 204 of the infeed paper guide assembly 158 through which the sheet stock material passes, as is illustrated in FIG. 8.

At the opposite or distal end of the side arms 200, a guide roller 214 is rotatably supported at its opposite ends to the respective side arms 200. An intermediate transversely extending guide bar 220, which is disposed between the guide bar 210 and guide roller 214, is mounted at its lateral ends to the respective side walls 170 of the frame 150. The side arms 200 of the infeed paper guide assembly 158 include respective recessed portions 222 which are sized to receive therein the ends of the guide bar 220 when the infeed paper guide assembly 158 is in its closed position (FIG. 8). FIG. 8 shows the travel path 15 of the stock material as it passes through the dunnage conversion machine 10. From the stock supply 27, the sheet stock material passes between the guide roller 202 and the panel 204. The sheet stock material then passes between the guide bar 220 and the guide panel 204 and is then trained around the guide roller 214. From the guide roller 214 the sheet stock material passes alongside or underneath the guide panel 190 and to the constant entry roller 196. The constant entry roller 196, in turn, guides sheet stock material downstream to the converting components of the dunnage conversion machine 10.

In accordance with the invention, the sheet stock material is substantially contained by the upright guide members 22 of the stand 12 and the dunnage conversion machine 10 so that loops or undulations exhibited by the sheet stock material during operation of the machine 10 are prevented or at least minimized. Advantageously, the travel path 15 of the sheet stock material is maintained substantially inside the machine 10 or in close proximity to the machine 10 so that little or no paper loops form external to the machine 10.

Referring now to FIG. 7, the infeed paper guide assembly 158 may be pivoted into an open position thereby to provide access to the gap between the guide roller 202 and the guide panel 204. To load sheet stock material into the machine 10, sheet stock material is initially fed from the stock supply 27 therebelow and through the gap. A sufficient length of sheet stock material is pulled through the gap to reach the constant entry roller 196. The infeed paper guide assembly 158 may then be swung back or pivoted about its pivot connection 202 to its closed position, whereby the sheet stock material is urged by the guide roller 214 into the corner formed by the side arms 184 and the side arms 200 and is trained around the guide roller 214. Also, in its open position, the infeed paper guide assembly 158 provides a surface upon which a new sheet stock material may be spliced to an almost expired sheet stock material. After splicing is performed, the infeed paper guide assembly 158 need merely be pivoted about its pivot connection 202 so that the guide roller 214 pushes the sheet stock material into its travel path 15.

From the constant entry roller 196, the sheet stock material passes to the converting sub-assemblies of the dunnage conversion machine 10. The dunnage conversion machine 10 includes a forming section 326 and a pulling assembly 328 powered (energized) by a motor 330, for example a rotary electric motor. Downstream of the pulling assembly 328, there is provided a severing assembly 334 for severing a continuous strip of dunnage formed by the forming section 326 into a desired length pad, and a valve 336 for preventing objects from entering the downstream end of the machine 10. The forming section components, the pulling assembly 328, the severing assembly 334, and the valve 336 are mounted to the frame 150 of the dunnage conversion machine 10. The operation of the dunnage conversion machine 10 may be controlled by a known controller (not shown).

In operation of the dunnage conversion machine 10, the stock supply assembly 327 supplies sheet material to the forming section 326. The illustrated forming section 326 includes a first (upstream) pair of side guide bars 344, a second (downstream) pair of side guide bars 345, an upper guide plate 346, and a constriction member 348. The side guide bars 344 and 345 are mounted to the guide panel 190 of the frame 150 and the upper guide plate 346, in turn, is mounted to the top ends of the side guide bars 344 and 345. The constriction member 348 is mounted to the upstream wall 172 of the frame 150.

Figure 12:
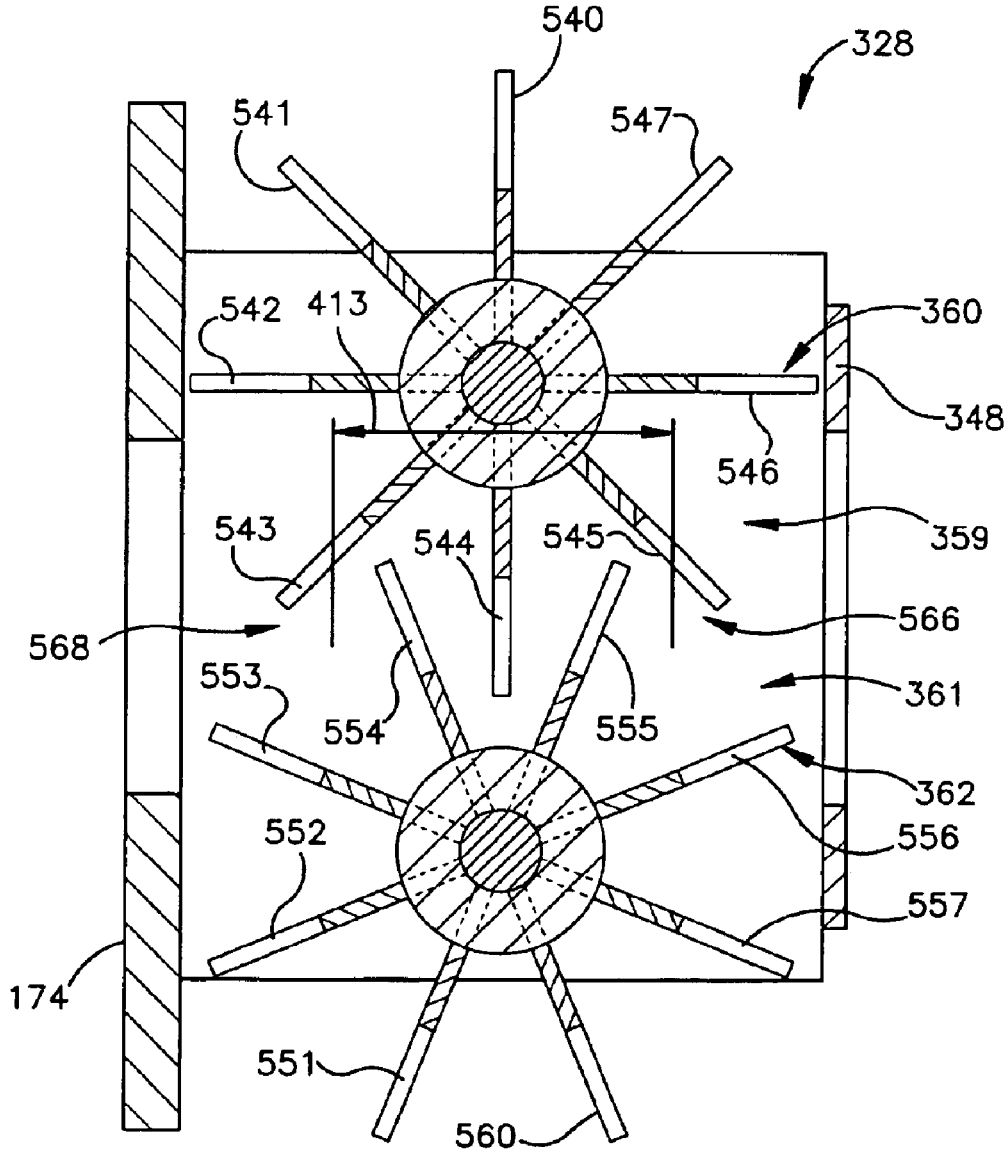
FIG. 12 is a top plan view of the pulling assembly of the dunnage conversion machine of FIG. 1.
Figure 13:
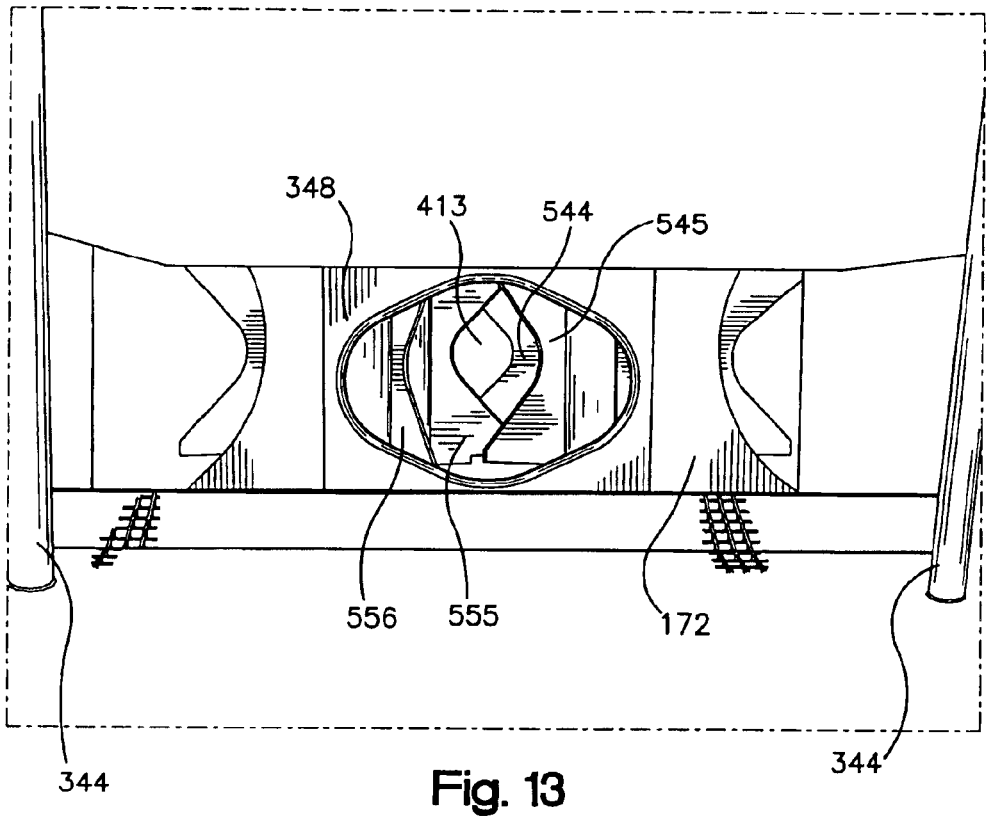
FIG. 13 is an end elevational view of the pulling mechanism of FIG. 11 and a constriction member as seen from the upstream end of the dunnage conversion machine.

The upstream side guide bars 344 are spaced apart relatively wider than the downstream side guide bars 345 such that as sheet stock material is passed through the two pairs of side guide bars 344 and 345, the side edges of the sheet stock material are folded or rolled inwardly towards one another so that the inwardly folded edges form multiple substantially longitudinally extending resilient crumpled portions of sheet material, thus preforming and streamlining the sheet material. The side guide bars 344 and 345 coact with the upper guide plate 346 and the guide panel 190 to guide the sheet material to the constriction member 348 (FIGS. 12 and 13). The constriction member 348, which may also be called a gathering member, further forms or shapes the sheet material and performs the additional function of directing the formed strip of dunnage into the pulling assembly 328. The constriction member 348 may alternatively be used as the forming section 326 without the side guide bars 344 and 345. Other types of forming components may be employed, such as those disclosed in commonly owned U.S. patent application Ser. No. 09/878,130, and U.S. Pat. Nos. 5,947,886 and 5,891,009, which are hereby incorporated herein by reference.

The pulling assembly 328 is located downstream of the forming section 326 and includes a first transfer assembly 359 including a first set of translating grippers 360, and a second transfer assembly 361 including a second set of cooperating and opposing translating grippers 362. The translating grippers 360 and 362 are translated along respective circular paths.

The pulling assembly 328 performs at least one and preferably two functions in the operation of the dunnage conversion machine 10. One function is a feeding function whereby the opposing sets of translating grippers 360 and 362 progressively transversely engage the strip of dunnage on opposite transverse sides thereof to pull the dunnage strip through the forming section 326 and in turn the sheet material from the stock supply assembly 327. The second function preferably performed by the pulling assembly 328 is a connecting function whereby the opposing sets of translating grippers 360 and 362 deform the strip of dunnage on opposite sides thereof to form a connected strip of dunnage. Of course, other mechanisms may be employed to "connect" the dunnage strip, i.e., to operate on the dunnage strip in such a manner that it will retain its void fill and/or cushioning properties as opposed to reverting to the original flat form of the sheet material. For example, known connecting mechanisms include mechanisms that crease the sheet material to enable the sheet material to hold its three-dimensional shape. The opposing sets of translating grippers 360 and 362 enable gradual transverse engagement and progressive advancement of the strip of dunnage across the full width of the strip so as to prevent, or at least reduce the likelihood of, tearing of the sheet stock material.

Figure 11:
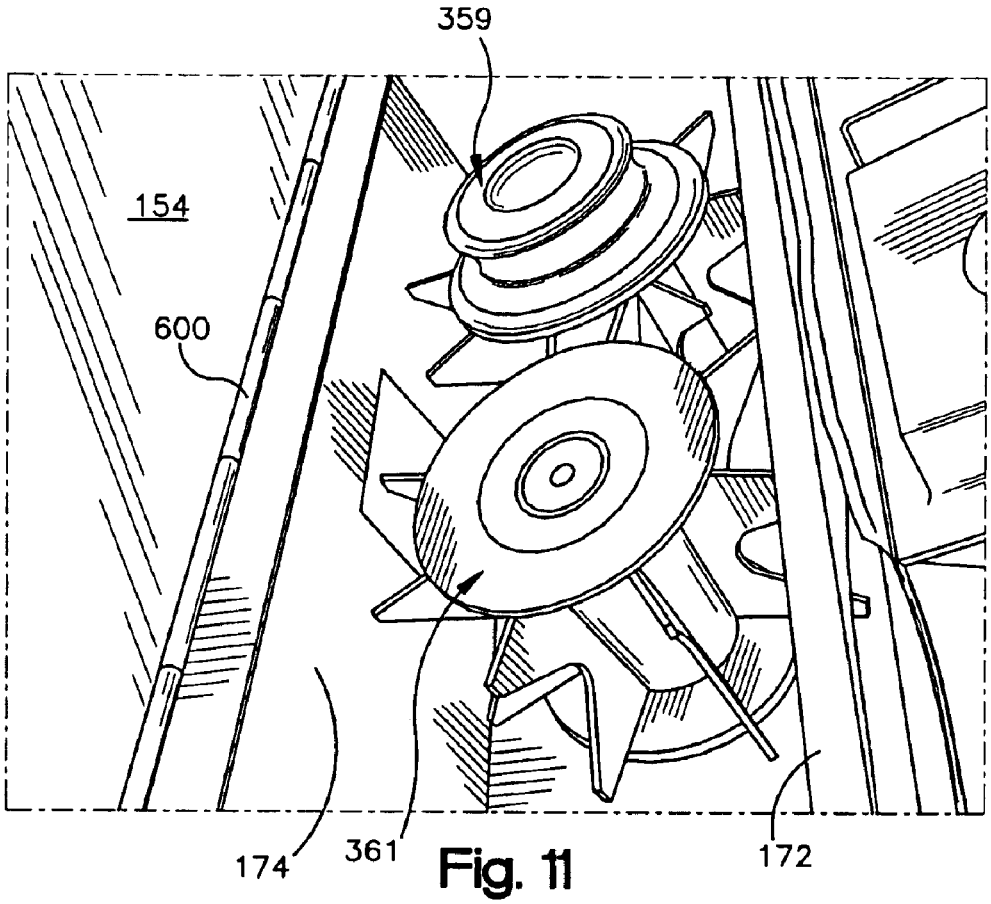
FIG. 11 is a perspective view of a pulling mechanism of the dunnage conversion machine of FIG. 1, the pulling mechanism being shown mounted to a frame of the dunnage conversion machine.

The pulling assembly 328 is shown in greater detail in FIGS. 11 to 13. The pair of transfer assemblies 359 and 361 define there between a dunnage transfer region 413 (FIGS. 12 and 13) through which the strip of dunnage from the forming section 326 passes. The transfer assemblies 359 and 361 are driven by a pulling assembly drive motor 330. The transfer assembly 361 includes a driven gear 420 mounted to an axle, the axles being parallel and laterally spaced relative to one another. The drive gear 422 of the transfer assembly 361 coacts with the driven gear 420 of the transfer assembly 359 to drive the transfer assembly 359 in a direction opposite that of the transfer assembly 361. The coacting gears 420 and 422 are the same size and, consequently, the speed at which the transfer assemblies 359 and 361 rotate is the same.

In the illustrated exemplary embodiment, the opposing sets of grippers 360 and 362 respectively include a first set of uniformly circumferentially spaced apart grippers 540–547 and a second opposing set of uniformly circumferentially spaced apart grippers 550–557 (FIG. 12). The illustrated grippers 540–547 and 550–557 are secured to respective hubs which, in turn, are mounted to the respective axles 480 and 482 for rotation therewith. The opposing sets of grippers 360 and 362 together form the above mentioned dunnage transfer region 413 (FIGS. 12 and 13) through which the strip of dunnage is gradually transversely engaged, advanced, and released. The dunnage transfer region 413 extends from about a region 566 upstream from the laterally spaced axles to about a region 568 downstream from the laterally spaced axles.

The grippers 540–547 and 550–557 of the pulling assembly 328 each have a somewhat V-shaped, or outwardly opening, aperture. On opposite sides of the outwardly opening aperture are contact portions (i.e., the arms that form the V-shape opening), which include arm portions (i.e., side contact portions) which are bridged by a base portion (i.e., a central contact portion). The apertures of opposing grippers 540–547 and 550–557 together form a gap there between which gradually becomes narrower as the grippers 540–547 and 550–557 progressively move towards each other. The narrowing of the gap between the grippers 540–547 and 550–557 eventually reaches a minimal gap size by which the strip of dunnage is fully transversely engaged or captured by the opposing grippers 540–547 and 550–557. In other words, the arm portions of the opposing grippers 540–547 and 550–557 move laterally towards (i.e., "close in" on) each other and the base portions of the opposing grippers 540–547 and 550–557 move transversely towards (i.e., close in" on) each other altogether to grip or capture the strip of dunnage there between.

Once the opposing grippers 540–547 and 550–557 have transversely engaged the strip of dunnage, the opposing grippers 540–547 and 550–557 maintain a grip on the strip of dunnage for the duration of their travel through the dunnage transfer region 413. During passage through the transfer region 413 the strip of dunnage is crimped and/or deformed on opposite sides thereof. At the downstream end of the pulling assembly 328, and more particularly the downstream end of the dunnage transfer region 413, the opposing sets of grippers 360 and 362 gradually diverge away from each other to release the strip of dunnage.

The quantity and/or type of grippers 540–547 and 550–557 employed may be other than that shown in the several Figures depending on, for example, the desired circumferential spacing between the grippers, the desired point at which the strip of dunnage is engaged by the grippers (e.g., relatively longer grippers may engage the strip of dunnage sooner and/or further upstream than relatively shorter grippers), the geometric configuration of the grippers (e.g., the outwardly opening apertures may be semicircular or semi-oval in shape to achieve the lateral and transverse capturing), or the type of engagement desired by the grippers (e.g., whether it is desired to have the strip of dunnage connected by the grippers). Also, the grippers 540–547 of one transfer assembly 359 may be longitudinally offset by a gap in relation to the grippers 550–557 of the other opposing transfer assembly 361. Also, the pulling assembly 328 may function as a feeding assembly and/or a connecting assembly. The illustrated exemplary pulling assembly 328 both pulls the sheet material (i.e., feeds the sheet material) through the forming section 326 and progressively crimps and/or kinks (i.e., connects) the strip of dunnage at regular intervals as it passes through the pulling assembly 328. Other means of connecting may also be employed, as alluded to above.

In the illustrated pulling assembly 328, the opposing grippers are shown as each having an aperture. Alternatively, there may be provided opposed grippers wherein only one of the grippers includes an aperture. The gripper including the aperture operates to gather and laterally capture therein the dunnage strip as the opposing gripper without the aperture moves along with the aperture gripper through the transfer region. The opposing grippers may have different shapes (for example, semicircle or semi-oval) and/or size apertures.

Figure 14:
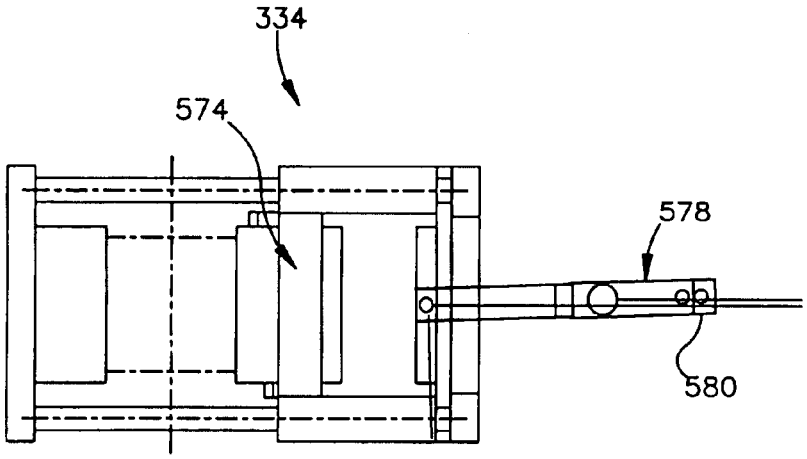
FIG. 14 is an end elevational view of a severing assembly of the dunnage conversion machine of FIG. 1.
Figure 15:
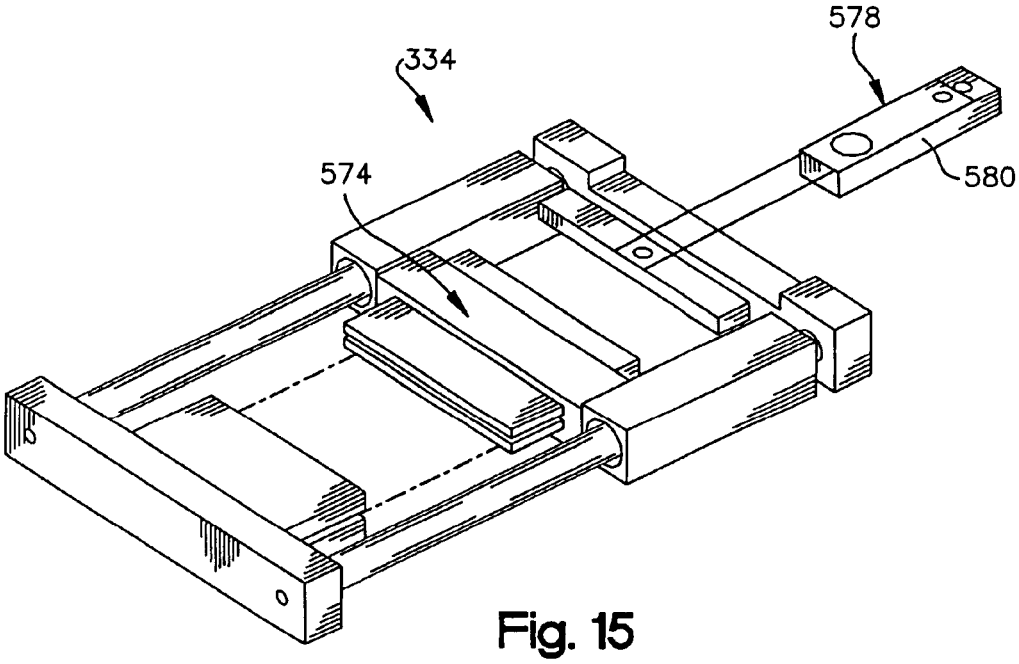
FIG. 15 is a perspective view of the severing assembly of FIG. 14.
Figure 16:
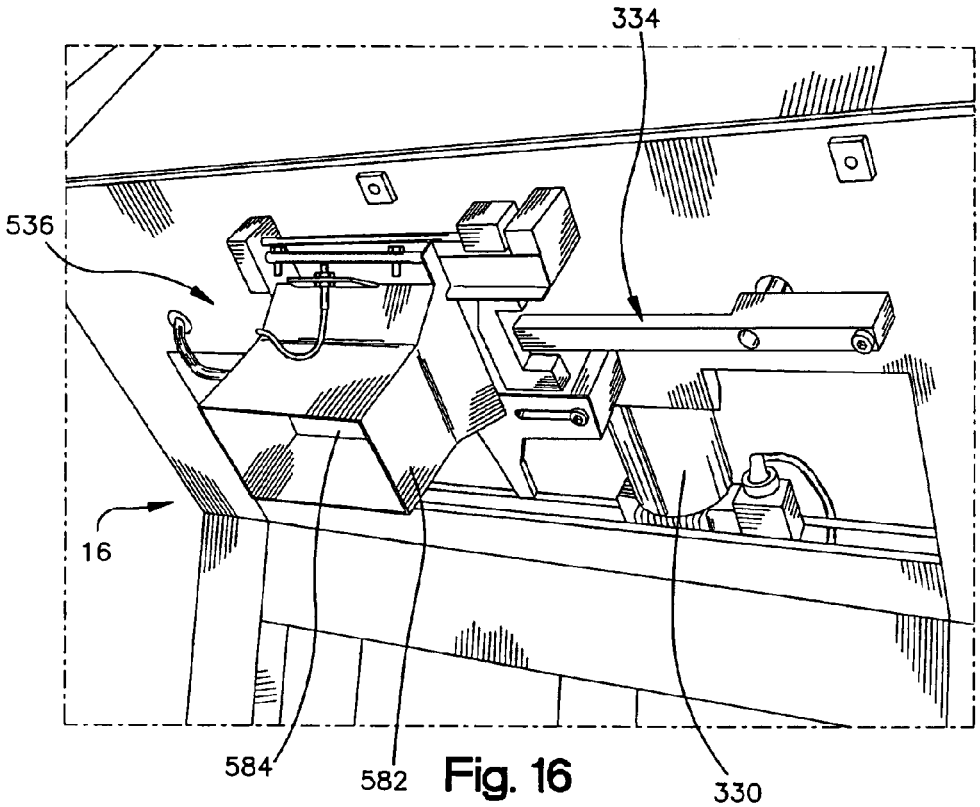
FIG. 16 is a perspective view of an output chute and a portion of the severing assembly of the conversion machine as seen from a downstream end of the dunnage conversion machine.

From the pulling assembly 328 the continuous strip of dunnage travels downstream to the severing assembly 334. The severing assembly 334 is shown in FIGS. 14 to 16. The severing assembly 334 severs, as by cutting or tearing, the strip of dunnage into a section of a desired length. The severing assembly 334 may be any desired type for severing the strip of dunnage. The illustrated severing assembly 334 includes a guillotine blade assembly 574 powered by a rotary motor 576 (FIG. 8) via a motion-transmitting assembly 578. In the illustrated embodiment, the blade of the blade assembly 574 is serrated. A complete rotation of a crank 580 of the motion-transmitting assembly 578 causes the guillotine blade assembly 574 to move from a ready-to-sever, or open, position (FIGS. 14 and 15) to a severed, or closed, position whereby the dunnage strip is severed, and then back to a ready-to-sever position. The on the fly severing provided by the severing assembly 334 enables rapid continuous severing of the strip of dunnage as it emerges from the pulling assembly 328.

The valve 336 is located downstream from the severing assembly 334. The valve 336 is shown in FIG. 16. The valve 336 includes a rectangular shaped outlet chute 582, a door 584 pivotably mounted to and/or in the chute 582, and a position sensor (not shown). The door 584 is spring biased or gravity biased to an inclined position wherein the door 584 extends from an upstream end of the chute 582 (near the severing assembly 334) to a downstream end of the chute 582. When the door 584 is in its spring biased position, the chute 582 and the inclined door 584 form a relatively narrow opening at the downstream end of the chute 582 to prevent objects from entering same. The door 584 may be swung open by a strip of dunnage passing through the chute 582. The severing assembly 334 is activated to sever the strip of dunnage upon the position sensor sensing that a strip of dunnage exists in the chute 582. It will be appreciated that other valves for example an inclined conveyor suitably coupled to the pulling assembly motor 330, may be used to prevent foreign objects from entering the exit chute of the machine 10.

As above indicated, the conversion machine 10 may be operated by a controller. The controller, for example, may cause the pulling assembly drive motor 330 to be energized when a foot pedal is depressed by the operator. The machine 10 may produce a pad for as long as the pedal is depressed. When the pedal is released the controller may cease operation of the pulling assembly drive motor 330 and effect operation of the severing assembly motor 576 to sever the strip of dunnage. Other control means may be provided such as that described in U.S. Pat. Nos. 5,897,478 and 5,864,484.

Referring again to FIG. 8, the frame 150 provides a compact L-shape configuration for the conversion subassemblies. In particular, the pulling assembly motor 330 is mounted to the frame 150 so that its axis is parallel to one leg of the L-shape configuration, and the severing assembly motor 576 is mounted to the frame 150 so that its axis is parallel to the other leg of the L-shape configuration.

Figure 9:
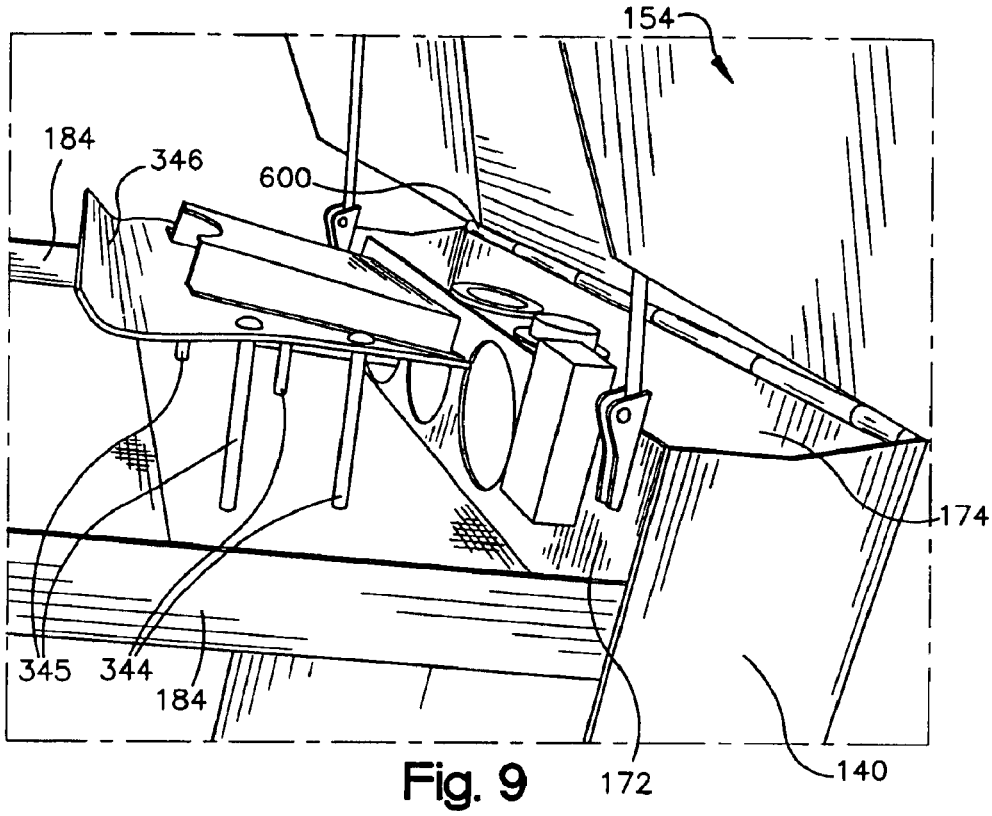
FIG. 9 is a right side perspective view of the dunnage conversion machine of FIG. 1, with the hood thereof in an open position to permit viewing of the internal components of the machine.
Figure 10:
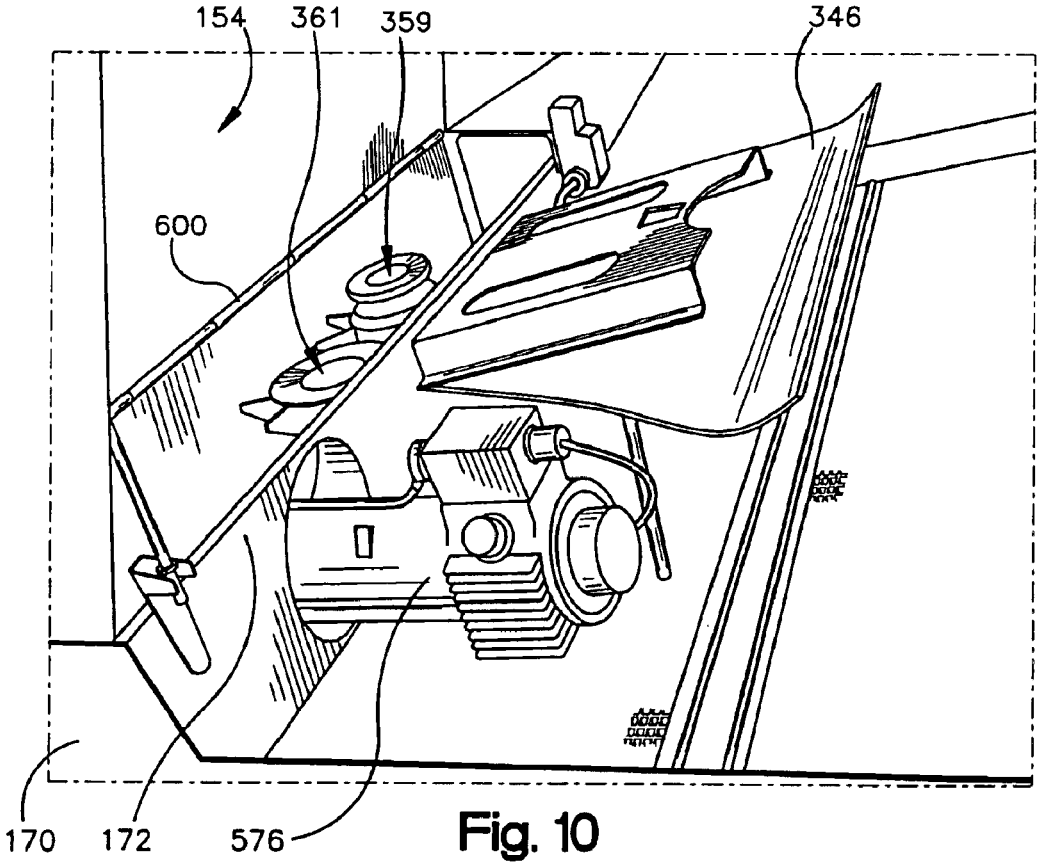
FIG. 10 is a left side perspective view of the dunnage conversion machine of FIG. 1, with the hood thereof in an open position to permit viewing of the internal components of the machine.

Referring again to FIGS. 7–10, the conversion subassemblies are covered by the hood 154 and the cover 162. The hood 154 is connected to the downstream wall 174 of the frame 150 by a transversely extending hinge 600. The hinge 600 enables the hood 154 to be pivoted between a closed position shown in FIG. 8 and an open position shown in FIGS. 7, 9 and 10. The hood 154 includes an arcuate shaped top wall 602, a pair of side walls 604 depending from the lateral edges of the top wall 602, and an upstream wall 606 depending from the upstream edge of the top wall 602. As is shown in FIG. 8, the side walls 604 of the hood 154 have respective angled edge portions which extend from the hinge 600 to the corner defined by the side arms 200 and the side arms 184. The side walls 604 of the hood 154 are laterally spaced slightly wider than the side arms 184 and the side walls 170 of the frame 150 so that when the hood 154 is pivoted to its closed position, the side arms 184 and the upper portions of the side walls 170 are contained within the side walls 604 of the hood 154. In its closed position (FIG. 8), the hood 154 protects such components as the forming section 326 and the pulling assembly 328 of the dunnage conversion machine 10 from debris and foreign objects. In the open position (FIGS. 7, 9 and 10), such components are easily accessible and therefore may be easily assembled to the frame 150 and/or easily serviced.

The cover 162 is mounted to the downstream wall 174 of the frame 150. As is shown in FIG. 8, the cover 162 includes a top wall 622 which has an arcuate shape contour having the same radius as the arcuate shape of the top wall 602 of the hood 154. Depending from the top wall 622 are a pair of side walls 624 and a downstream end wall 626. A bottom wall 628 is connected at its lateral edges to the respective side walls 624 and at its top edge to the downstream end wall 626. As is shown in FIGS. 1 and 8, the bottom wall 628 is substantially parallel to the bottom edge of the side walls 170 of the frame 150. The cover 162 protects such components as the severing assembly 334 and the valve 336 of the dunnage conversion machine 10 from debris and foreign objects. Also, the cover 162 is lightweight owing to its relatively small size and therefore may be easily removed for assembling and/or servicing the components contained by the cover 162.

The cover 162 also is ergonomically advantageous as is illustrated in FIG. 1, the cover 162 contains a control panel 640 for controlling the dunnage conversion machine 10, an emergency stop button 642 for ceasing operation of the dunnage conversion machine 10, and an on-off switch 644 for turning the dunnage conversion machine on and off. An outlet opening 650 is provided in the cover 162 through which the strip of dunnage passes from the valve 336 of the dunnage conversion machine 10. Advantageously, the downstream end wall 626 of the cover 162 faces downwardly at an angle of about 45 degrees relative to horizontal. At such an angle, the cover 162 enables the control panel 640, the emergency stop button 642 and the on-off switch 644 to be easily accessed while discharging the strip of dunnage through the outlet 650 in close proximity, and therefore reach, to such components.

Figure 17:
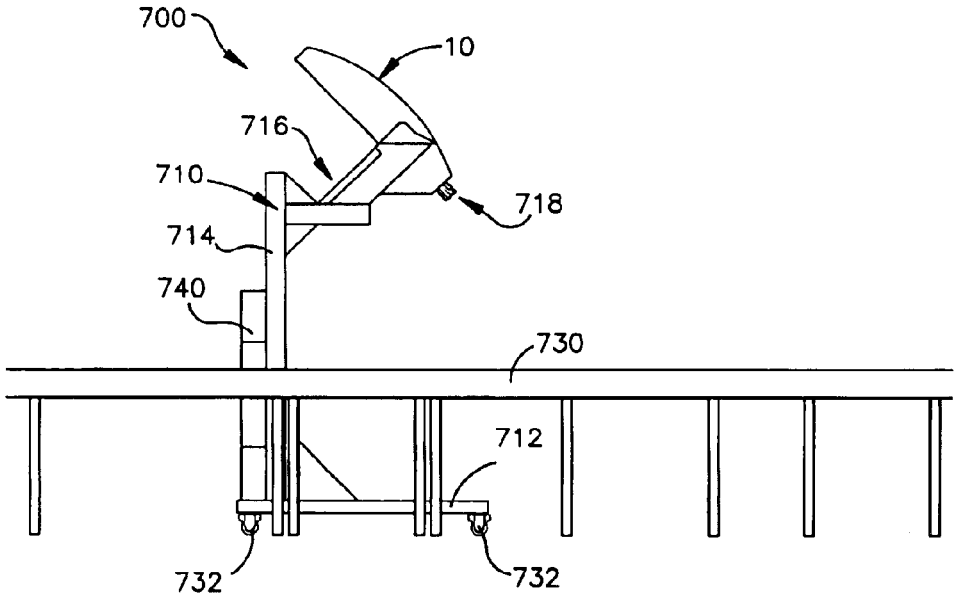
FIG. 17 is a side elevational view of a packaging system incorporating a dunnage conversion machine in accordance with the present invention.
Figure 18:
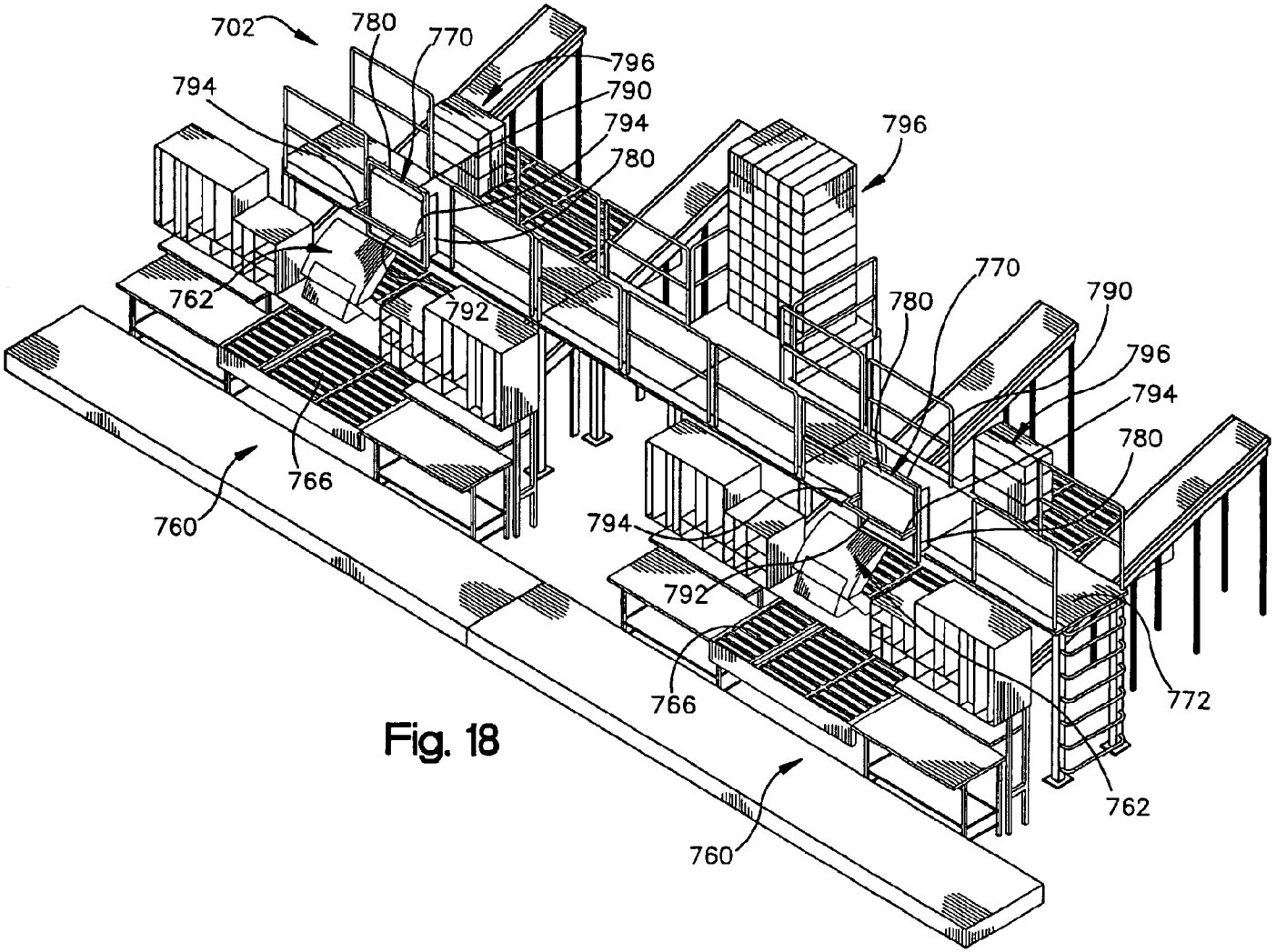
FIG. 18 is a perspective view of a packaging system incorporating the dunnage conversion machine in accordance with the present invention.
Figure 19:
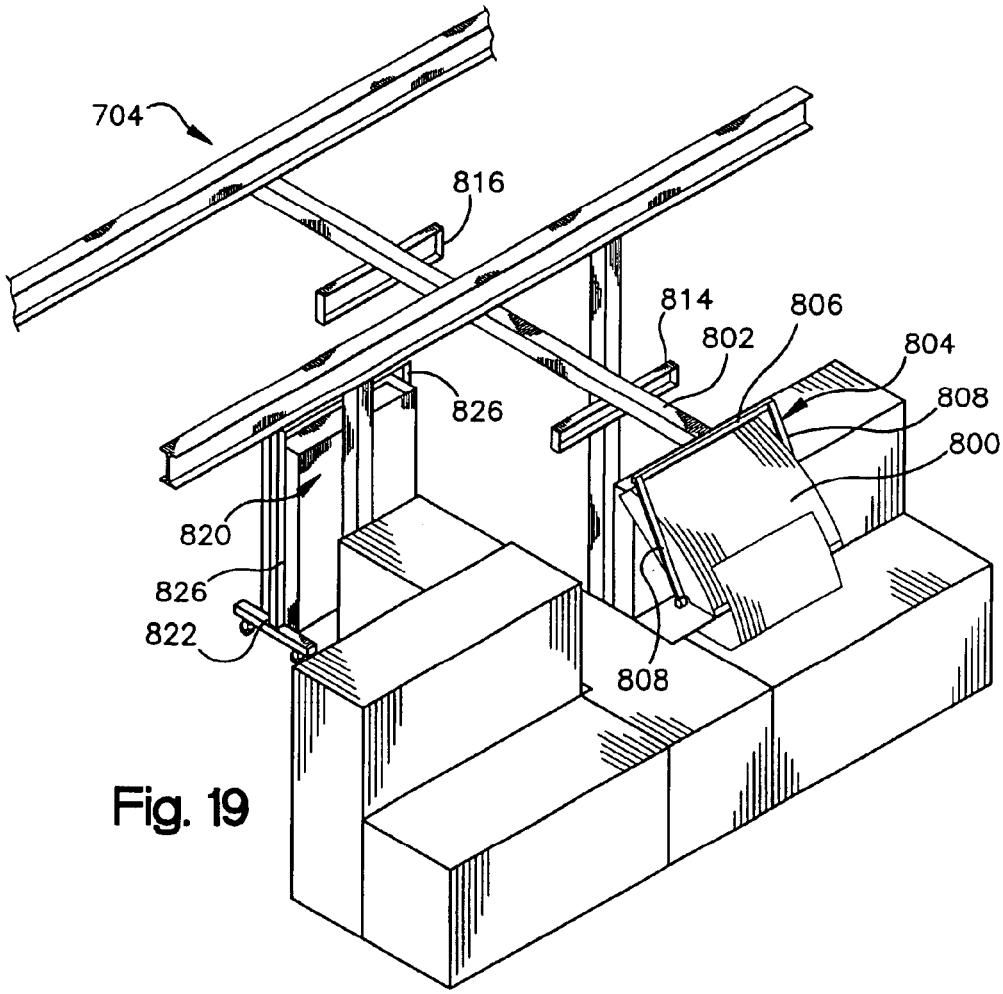
FIG. 19 is a perspective view of yet another packaging system incorporating a dunnage conversion machine in accordance with the present invention.

Referring now to FIGS. 17–19, there are shown three different packaging systems 700, 702, and 704 embodying the dunnage conversion machine 10. As is shown in FIG. 17, the dunnage conversion machine 10 is mounted to a stand 710 which is oriented in a generally vertical manner. The stand 710 includes a base 712 and an upright frame 714 to which the machine 10 is mounted. The machine 10 has an upstream end 716 at which sheet stock material is supplied to the machine 10 and a downstream end 718 from which the machine 10 discharges dunnage pads. The stand 710 has an L-shaped configuration such that when the base 712 is positioned below a working surface 730, for example, a conveyor or, as shown in FIG. 17, a table, the downstream end 718 of the machine 10 extends over the working surface 730. The bottom corners of the base 712 include wheels 732 so that the stand 710 and the machine 10 may be moved easily. The upright frame 714 of the stand 710 includes a pair of upright guide members between which a stack of fan folded sheet stock material 740 is guided to the upstream end 716 of the dunnage conversion machine 10. As was noted above, the sheet stock material alternatively may be provided in the form of a stock roll supported either by the stand 710 or by a cart disposed next to or adjacent the stand 710.

The packaging system 702 shown in FIG. 18 includes a pair of packaging stations 760, each of which includes a dunnage conversion machine 762. The dunnage conversion machine 762 is similar to the dunnage conversion machine 10 illustrated and described above except that the dunnage conversion machine 762 does not include the infeed paper guide assembly 158. The downstream ends of the respective dunnage conversion machines 762 are disposed above respective packaging surfaces 766. The upstream ends of the respective dunnage conversion machines 762, in turn, extend upwardly towards respective elevated loading stations 768 including respective stock supply assemblies 770. Each stock supply assembly 770 is accessible from an elevated gangway 772.

The stock supply assembly 770 supplies sheet stock material to the upstream end of the dunnage conversion machine 762 by means of, for example, a stock supply roll or the as-shown stack of fan folded stock material. The stack of fan folded sheet stock material is guided at the lateral edges thereof by respective laterally spaced guideposts 780 of the stock supply assembly 770. The sheet stock material is trained over an upper transversely extending guide bar 790 supported at its ends by the respective upright guideposts 780. From the guide bar 790 the sheet stock material is trained over an intermediate guide bar 792. The intermediate guide bar 792 is mounted at its ends to respective side support members 794 which are mounted to and project perpendicularly from the upright guideposts 780. The sheet stock material passes from the intermediate guide bars 792 to the constant entry roller of the dunnage conversion machine 762 and passes to the downstream conversion sub-assemblies of the dunnage conversion machine 762 in a manner similar to that described above in reference to the dunnage conversion machine 10. Located at the opposite side of the gangway 772 from the stock supply assemblies 770 are several storage locations 796 for the fan folded sheet stock material.

Advantageously, the packaging system 702 of the present invention separates the packaging stations 760 from the loading stations 768 so that the packaging and loading tasks may be performed independently. Moreover, the fan-folded sheet stock material is stored out of the way from the packaging stations 760.

The packaging system 704 of FIG. 19 includes a dunnage conversion machine 800 similar to the dunnage machine 10 except that it does not include the infeed paper guide assembly 158. The dunnage conversion machine 800 is suspended from and connected to a structural member 802 of, for example, a warehouse roof. More particularly, the dunnage conversion machine 800 is supported by an inverted U-shaped bracket 804. The base 806 of the U-shaped bracket 804 is mounted to the distal end of the structural member 802 and the laterally spaced apart legs 808 of the U-shaped bracket 804 depend from the base portion 806 and are mounted to the respective sides of the dunnage conversion machine 800. Upstream from the dunnage conversion machine 800 and mounted to the structural member 802 are a pair of sheet stock material guideways 814 and 816. Each guideway 814 and 816 provides an opening through which the sheet stock material travels before entering the dunnage conversion machine 800. Below the structural member 802 there is provided a supply of sheet stock material 820 which in the illustrated embodiment is in the form of a stack of fan-folded sheet stock material. The stack of fan-folded sheet stock material 820 rests on a stand 822 which includes a pair of guideposts 826 between which the sheet stock material is guided to the downstream guideway 816. Advantageously, the dunnage conversion machine 800 is suspended so as to be out of the way of any packaging stations there below and the stock supply 820 upstream therefrom.

Figure 20:
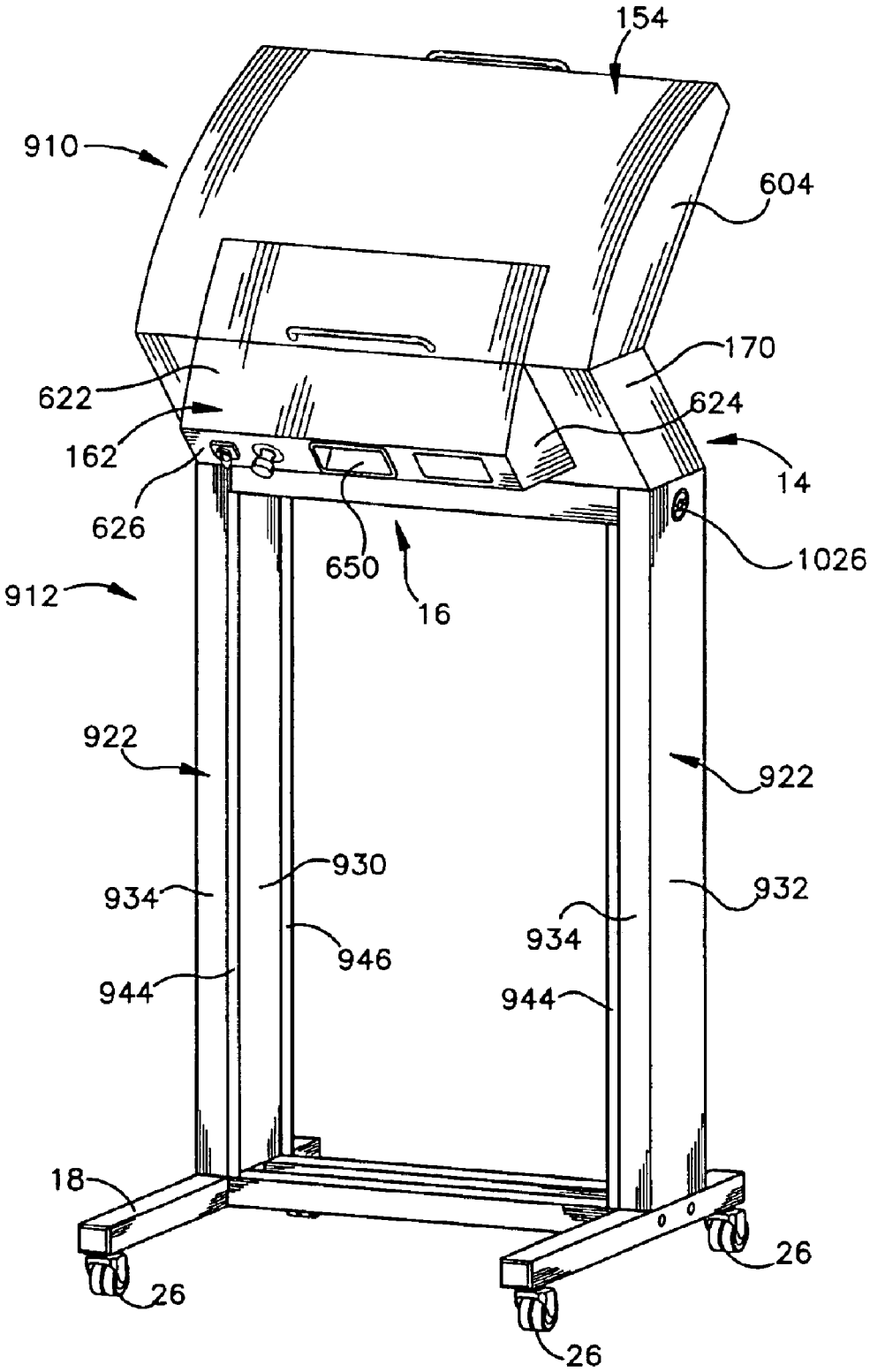
FIG. 20 is a front perspective view of a dunnage conversion machine and a stand in accordance with another embodiment of the present invention.
Figure 21:
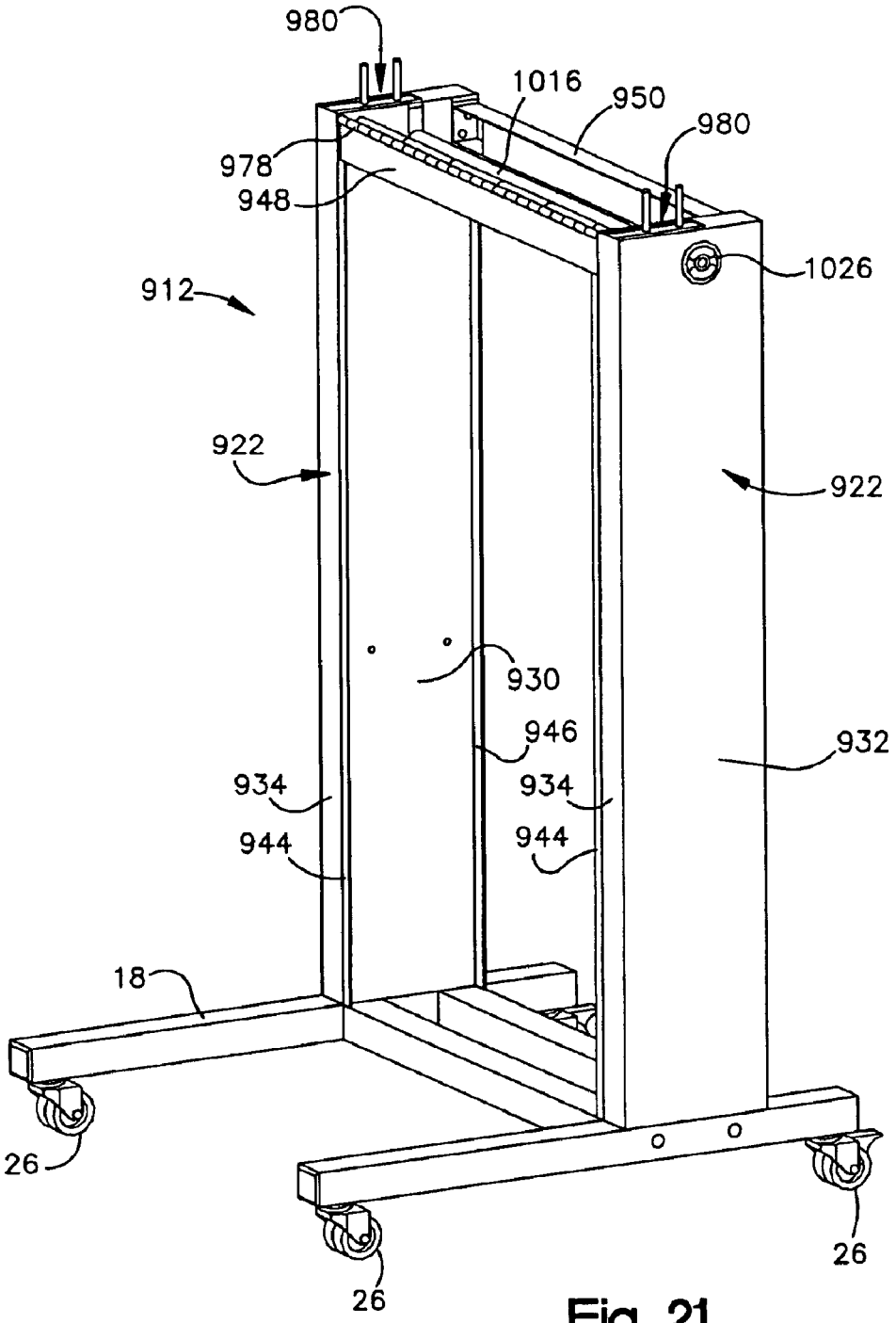
FIG. 21 is a front perspective view of the stand of FIG. 20.

Referring now to FIGS. 20 and 21, there is shown a dunnage conversion system 900 including a dunnage conversion machine or dunnage conversion machine head 910 and a stand 912 in accordance with another embodiment of the present invention. Except as described herein, the dunnage conversion machine 910 and the stand 912 are substantially the same as the afore described dunnage conversion machine 10 and the stand 12. In the several Figures, like reference numerals represent like components or features.

The stand 912 of the dunnage conversion system 900 includes a pair of upright guide members 922 to which the dunnage conversion machine 910 is mounted. Each upright guide member 922 includes an inner side wall 930, an outer side wall 932 spaced from the inner side wall 930 by a gap G, a front wall 934, and a rear wall 936. The front and rear walls 934 and 936 span the gap G between the inner and outer side walls 930 and 932 and extend inwardly beyond the respective inner side walls 930 to form respective front and rear guide surfaces 944 and 946. Front and rear transverse support members 948 and 950 are connected to and extend between the guide members 922 at the upper most end of the guide members 922. Unlike the stand 12, the stand 912 does not include vertically extending catches 52.

Figure 22:
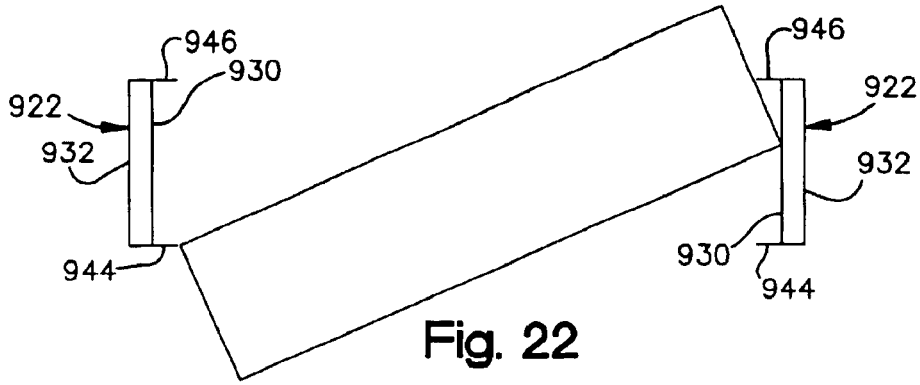
FIGS. 22–26 illustrate sequentially several views of an exemplary technique for inserting a stack of fan folded sheet stock material into the stand of FIGS. 20 and 21.
Figure 23:
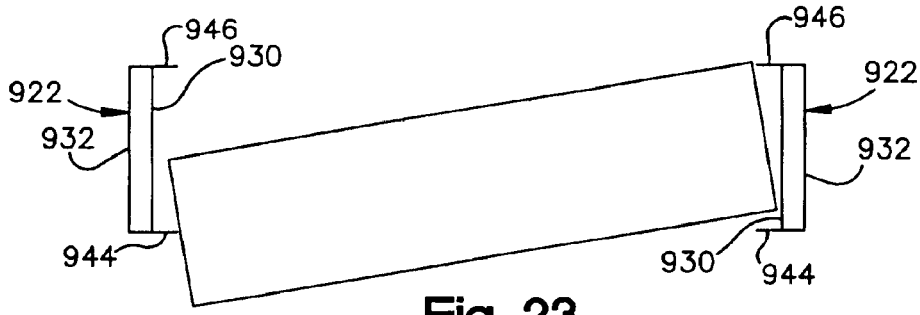
Figure 24:
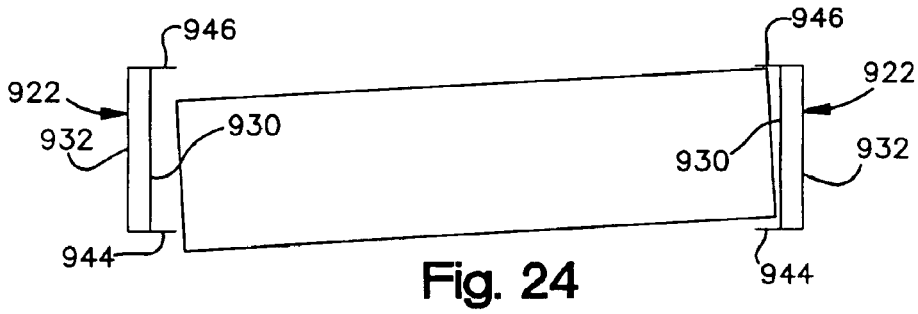
Figure 25:
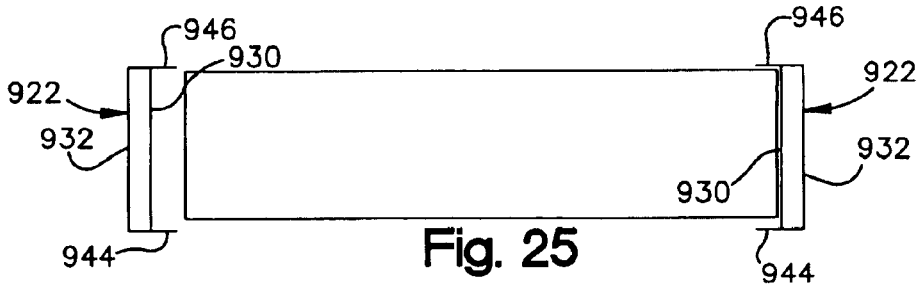
Figure 26:
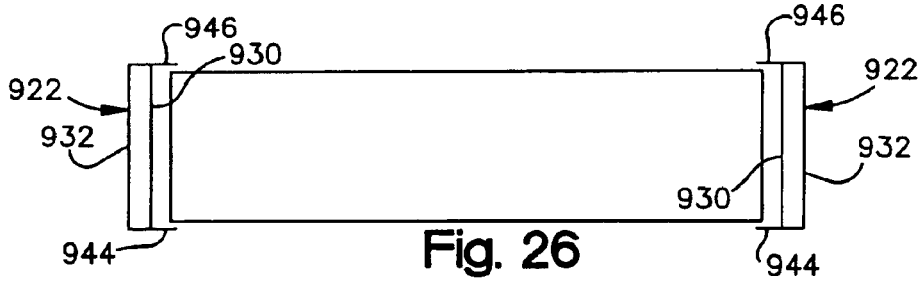

FIGS. 22–26 illustrate sequentially an exemplary method of loading a stack of fan folded sheet stock material (FIG. 5) between the guide members 922, as viewed from the top of the stack. The width of the stack is slightly less than the distance between the inner side walls 930 and slightly greater than the distance between the innermost edges of the front and rear guide walls 944 and 946. Initially, the stack is inserted sideways between the guide members 922 (FIG. 22). In the illustrated embodiment, the right side of the stack is inserted between the guide members 922, for example. The stack is then tilted clockwise until diagonally opposite corners, for example the right front corner and the rear left corner in the illustrated embodiment, are in between the guide members 922, as shown in FIG. 23. The right side of the stack is then moved towards the right inner side wall 930 so that the right rear corner of the stack clears the right rear guide wall 946 (FIG. 24). The stack is then moved further towards the right inner side wall 930 sufficient enough to enable the left front corner of the stack to clear the left front guide wall 944. The stack is then tilted clockwise until the sides of the stack are within the inner side walls 930, and the front and rear of the stack are within the front and rear guide walls 944 and 946 of the guide members 922 (FIG. 25). The stack is then shifted laterally to the left to approximately center the stack between the inner side walls 930 (FIG. 26). As a result, the fan folded sheet stock material is captured between the inner side walls 930 and the front and rear guide walls 944 and 946. The front and rear guide walls 944 and 946 prevent or at least reduce the likelihood of the stack from tipping either rearwardly or forwardly out from the stand 912, while the inner side walls 930 of the respective guide members 922 prevent or at least reduce the likelihood of the stack from moving laterally within the stand 912. It has been found that this is particularly useful when the stand is moved from one location to another on the wheels 26.

Although in the illustrated embodiment the stack is inserted between the guide members 922 by first inserting the right side of the stack, it will be appreciated that alternative methods may be employed to insert the stack. For example, the left side of the stack may be inserted first, followed by tilting the stack counterclockwise. Also, it will be appreciated that any stack of fan folded sheet stock material may be inserted between the guide members 922 according to the invention. For example, as is further described below in reference to FIGS. 32–39, the stack of sheet stock material may be in the form of a bale that, once inserted into the stand, may be debated to release same for feeding into and converting by the conversion machine 910.

Figure 27:
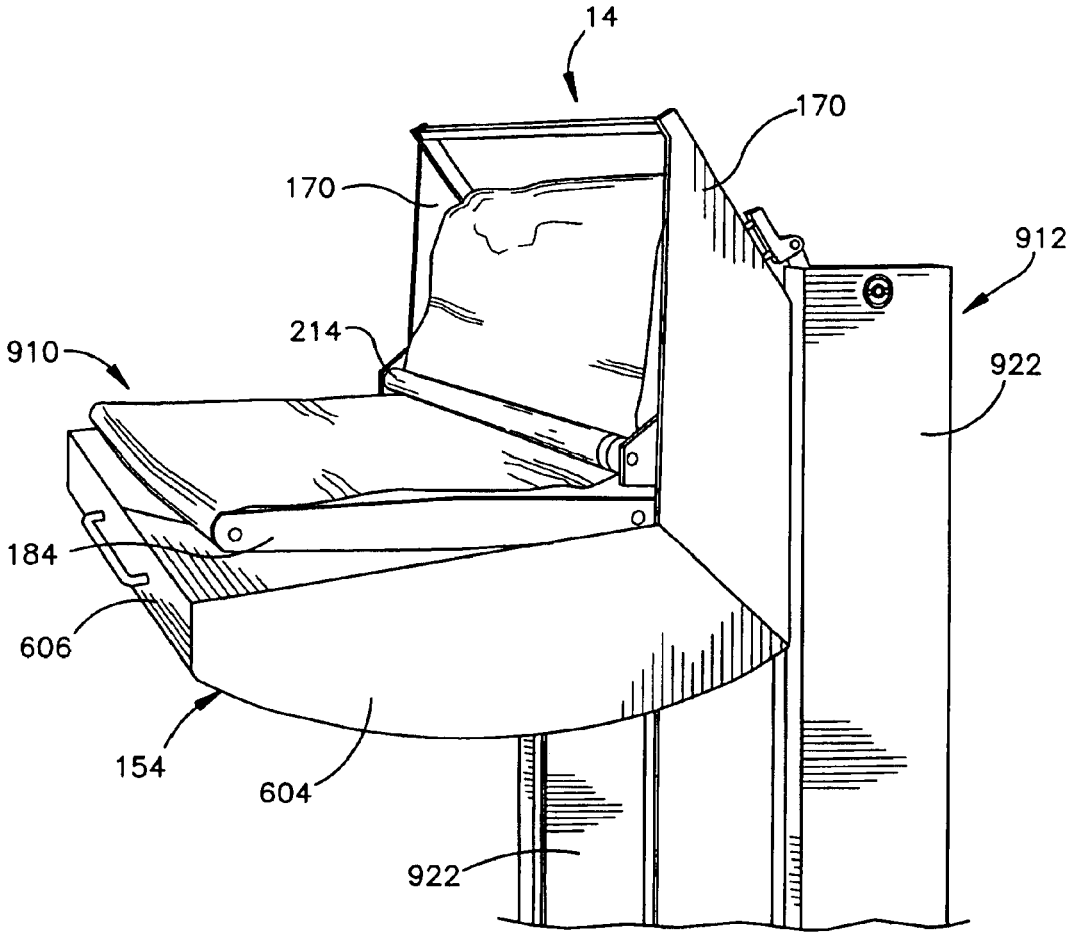
FIG. 27 is a front perspective view of the dunnage conversion machine and upper portion of the stand of FIGS. 20 and 21, with the dunnage conversion machine shown pivoted to a servicing/loading position, with a cover of the dunnage conversion machine residing between a pair of upright guide members of the stand and therefore hidden from view.
Figure 28:
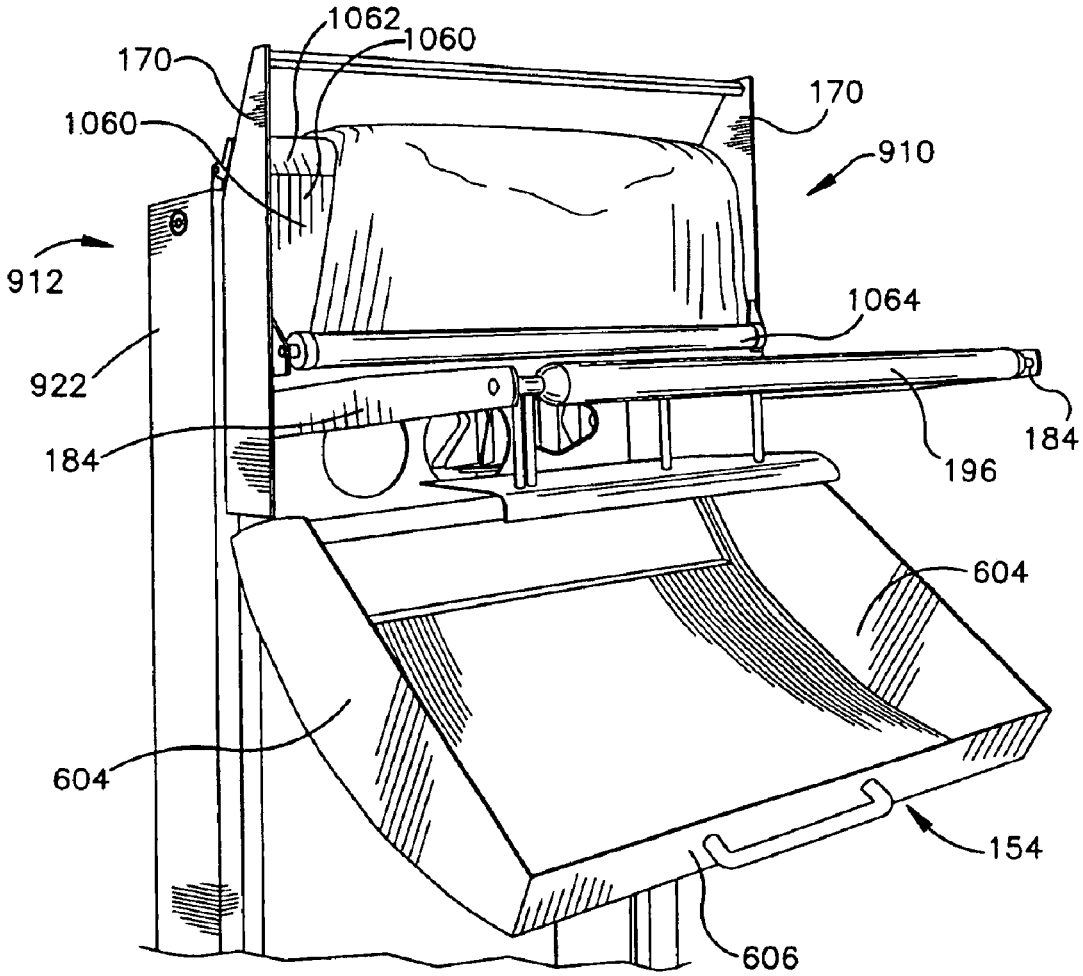
FIG. 28 is a front perspective view of the dunnage conversion machine and upper portion of the stand of FIGS. 20 and 21, with the dunnage conversion machine shown pivoted to a servicing/loading position, with a cover of the dunnage conversion machine residing between a pair of upright guide members of the stand and therefore hidden from view, and with a hood of the conversion machine shown in an open position.

Referring now to FIGS. 20, 21 and 27–31, the dunnage conversion machine or dunnage conversion machine head 910 is mounted to the stand 912 via a hinge 978 and a pair of mounting mechanisms 980 (hidden from view in FIGS. 20, 27 and 28). The hinge 978 and mounting mechanisms 980 enable the dunnage conversion machine 910 to be selectively pivoted from an operating position shown in FIG. 20 to a servicing/loading position shown in FIGS. 27 and 28. The dunnage conversion machine 910 is pivotable towards the front of the system 900 so as to suspend at least partially in front of the stand 912. In contrast, the earlier described dunnage conversion machine 10 is pivotable towards the rear of the stand 12.

As is shown in FIG. 21, the hinge 978 extends transversely between the guide members 922 of the stand 912 at the uppermost and frontmost corner thereof. More particularly, the hinge 978 has one end mounted to or formed by the front transverse support member 948 of the stand 912 and the other end mounted to a flange (not shown) projecting rearwardly from the bottom of the transverse wall 174 of the frame 150 of the dunnage conversion machine 910.

Each mounting mechanism 980 includes a mounting bracket 984, a gas compression spring 988, and a guide bracket 992. Each mounting bracket 984 has projecting therefrom a pair of upright mounting posts 996. The dunnage conversion machine 910 is mounted to the mounting posts 996 via a pair of flanges (not shown) projecting inwardly from the bottoms of the side walls 170 of the conversion machine frame 150. A pivot pin 1000 couples the forward end of the mounting bracket 984 to the upper end of the gas compression spring 988 to enable relative pivotal movement between the mounting bracket 984 and the gas compression spring 988. The gas compression springs 988 extend downward from the mounting bracket 984 and are moveable between the inner and outer side walls 930 and 932 of the respective upright guide members 922. The bottom end of the gas compression spring 988 is mounted to a transversely extending pivot pin 1004 that is rotatably supported in a suitable manner at its opposite ends by the inner and outer side walls 930 and 932.

Projecting from the side of the mounting bracket 984 is a pivot pin 1008 that couples the rear end of the mounting bracket 984 to the upper end of the guide bracket 992 to enable relative pivotal movement between the mounting bracket 984 and the guide bracket 992. The guide brackets 992, like the gas compression springs 988, extend downward from the mounting bracket 984 between the inner and outer side walls 930 and 932 of the respective upright guide members 922. Each guide bracket 992 is arcuate in shape and includes an arcuate shape slot 1012 therein. When the dunnage conversion machine 910 is pivoted relative to the stand 912 about the hinge 978, the guide brackets 992 slide along the opposite ends of the guide rod 1016 to guide such pivotal movement. The opposite ends of the guide rod 1016 are rotatably supported by respective reinforcing brackets 1020 that are sandwiched between and suitably connected to the inner and outer side walls 930 and 932 of the respective upright guide members 922.

The dunnage conversion machine 910 is pivotable to a wide range of angular displacements relative to the stand 912, the range being limited by the distance the guide brackets 992 can travel on the guide rod 1016, which is when the terminal ends of the arcuate slots 1012 in the guide brackets 992 reach the guide rod 1016. A turning knob 1026 or similar mechanism may be suitably connected to the dunnage conversion machine 910 and/or one or both of the mounting mechanisms 980 to lock the dunnage conversion machine 910 at a desired angular displacement relative to the stand 912, or to unlock the dunnage conversion machine 910 to enable pivotal movement of the dunnage conversion machine 910 relative to the stand 912.

In the illustrated exemplary dunnage conversion system 900, the dunnage conversion machine 910 is selectively lockable in an operating position (FIG. 20), and two different servicing/loading positions, one of which is shown in FIGS. 27 and 28, by means of the guide rod 1016 and the guide brackets 992. Specifically, the guide rod 1016 is rotatably adjustable between a pivot enabling position and a pivot disabling or locking position. The knob 1026 (FIGS. 20 and 21), which in the illustrated embodiment is accessible from the side of the stand 912, is suitably connected to the guide rod 1016 to provide for such rotatable movement.

Figure 29:
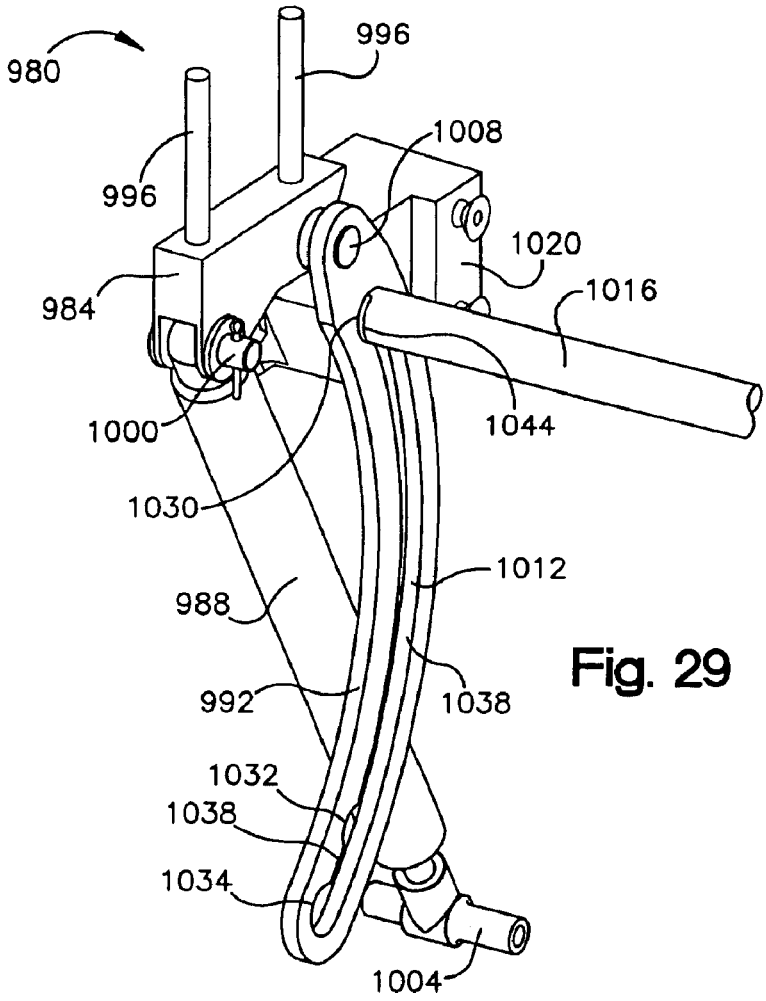
FIG. 29 is a perspective view of a mounting mechanism enabling the dunnage conversion machine to be selectively pivoted relative to the stand from an operating position to a servicing/loading position.

Referring to FIG. 29, the slot 1012 of each guide bracket 992 has three arcuate indentations 1030, 1032 and 1034, each having a radius slightly larger than the radius of the guide rod 1016, and a relatively narrower track portion 1038 extending between the indentations 1030, 1032 and 1034. The arcuate indentations 1030, 1032 and 1034 correspond respectively to the three different positions in which the dunnage conversion machine 910 may be selectively locked and unlocked. As will be appreciated, the guide rod 1016 is rotatable when the center axis of the guide rod 1016 is substantially collinear with the center axis of one of the arcuate indentations 1030, 1032 and 1034 of the slot 1012. The opposite ends of the guide rod 1016 include respective arcuate segment notches 1044 therein. The axial width of each notch 1044 in the guide rod 1016 is slightly larger than the width of the guide bracket 992 to enable the radially inner arcuate portion of the guide bracket 992 to slide therein.

In the pivot enabling position (FIG. 29), the guide rod 1016 is rotated such that the notches 1044 of the guide rod 1016 are aligned with the inner arcuate portions of the guide brackets 992, enabling the guide brackets 992 to freely slide to and fro along the opposite ends of the guide rod 1016 and, accordingly, enabling the dunnage conversion machine 910 to be pivoted relative to the stand 912. In the pivot disabling or locking position, the guide rod 1016 is rotated such that the notches 1044 of the guide rod 1016 are out of alignment with respect to the inner arcuate portion of the guide bracket 992 and the outer diameter of the guide rod 1016 is in the path of and therefore blocks movement of the inner arcuate portion of the guide bracket 992. In the locking position, the guide rod 1016 prevents pivotal movement of the dunnage conversion machine 910 relative to the stand 912.

Figure 30:
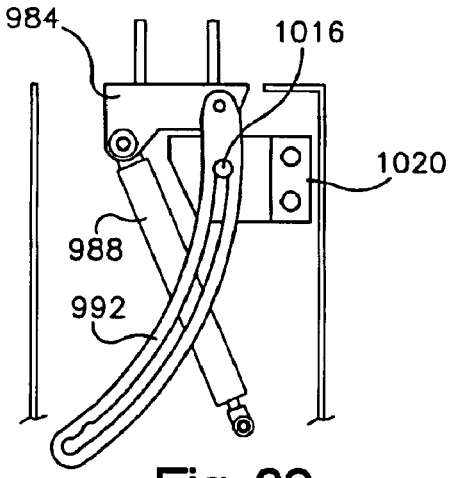
FIG. 30 is a side view of the FIG. 29 mounting mechanism, showing the position of the mechanism when the dunnage conversion machine is in an operating position.

When the guide rod 1016 is rotated in the indentation 1030 to block movement of the guide brackets 992, the dunnage conversion machine 910 is in an operating position, atop the stand 912 (FIG. 20). FIG. 30 shows the gas compression spring 988 and the guide brackets 992 in their respective positions when the dunnage conversion machine 910 is in the operating position. In the operating position, the gas compression springs 988 are compressed, and the weight of the dunnage conversion machine 910 is carried substantially by the guide brackets 992 in compression, as well as by the hinge 978 in the front of the stand 912 and the tops of the upright guide members 922 of the stand 912.

Figure 31:
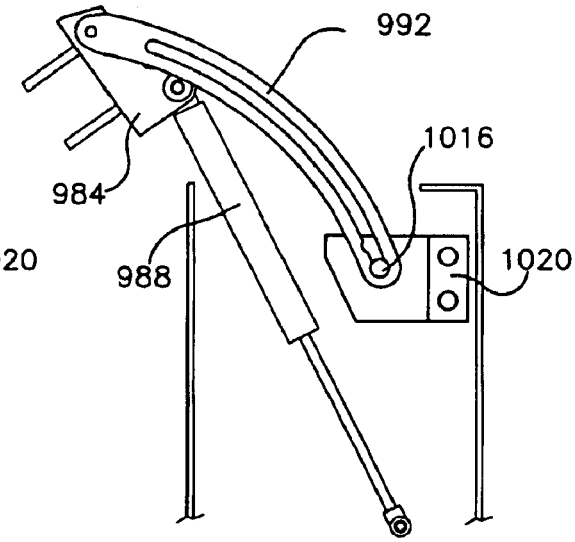
FIG. 31 is a side view of the FIG. 29 mounting mechanism, showing the position of the mechanism when the dunnage conversion machine is in a servicing/loading position.

When the guide rod 1016 is rotated in the indentation 1032 to block movement of the guide brackets 992, the dunnage conversion machine 910 is in an intermediate tilted servicing/loading position. When the guide rod 1016 is rotated in the indentation 1034 to block movement of the guide brackets 992, the dunnage conversion machine 910 is in a fully tilted servicing/loading position (FIGS. 27 and 28). FIG. 31 shows the gas compression spring 988 and the guide brackets 992 in their respective positions when the dunnage conversion machine 910 is in the fully tilted servicing/loading position. In such position, the gas compression springs 988 are extended, and the weight of the dunnage conversion machine 910 is carried substantially by the guide brackets 992 in tension, and by the hinge 978 in the front of the stand 912.

Together, the gas compression springs 988 and the guide brackets 992 of the mounting mechanisms 980 simplify pivotal movement of the dunnage conversion machine 910 relative to the stand 912. The gas compression springs 988, for example, bias the dunnage conversion machine 910 to impart a somewhat weightlessness to the dunnage conversion machine 910 when the dunnage conversion machine 910 is pivoted relative to the stand 912. The guide brackets 992, meanwhile, guide movement of the mounting brackets 984 and consequently the dunnage conversion machine 910 along the guide rods 1016, as the dunnage conversion machine 910 is pivoted relative to the stand 912. The gas compression springs 988 and the guide brackets 992 move between the planes of the inner and outer side walls 930 and 932 of the respective upright guide members 922 and, as is shown in FIG. 21, the gas compression springs 988 and the guide brackets 992 fully retract between the inner and outer side walls 930 and 932 when the dunnage conversion machine 910 is in its operating position.

Referring to FIG. 20, when the dunnage conversion machine 910 is in its operating position, the dunnage conversion machine 910, and more particularly the converting sub-assemblies thereof, which lie substantially in the plane of the side arms 184, are disposed above the top plane of the upright guide members 922 of the stand 912, and are inclined in the upstream to downstream direction at about 45 degrees relative to horizontal. Accordingly, the upstream end of the dunnage conversion machine 910 is out of the way from the packaging area around the system 900, while the downstream end of the dunnage conversion machine 910, and more particularly the outlet 650 thereof, is conveniently oriented towards the front or upstream end of the system 900 for easy access to a strip of dunnage discharged from the outlet 650.

Referring to FIGS. 27 and 28, by tilting the dunnage conversion machine 910 forward to one of its servicing/loading positions, access to the dunnage conversion machine 910 for servicing and/or loading same is simplified. In this regard, the multiple servicing/loading positions provide multiple points of access. For example, when the dunnage conversion machine 910 is in the servicing/loading position illustrated in FIGS. 27 and 28, the dunnage conversion machine 910 is at least partially inverted and is disposed substantially below the top plane of the stand 912. The angular displacement of the side arms 184 is about 135 degrees from their operating position, or 180 degrees from the horizontal. Thus, with the hood 154 opened, an operator or user may easily access internal components of the dunnage conversion machine 910, such as the converting sub-assemblies. Also, initial feeding of sheet stock into the dunnage conversion machine 910 is simplified when the dunnage conversion machine 910 is in a servicing/loading position, as the feeding end or upstream region 566 of the pulling assembly 328 (FIGS. 12 and 13) faces the front of the dunnage conversion system 900. Thus, a user or operator has substantially horizontal access to the pulling assembly 328 to feed sheet stock material into same from the front of the dunnage conversion system 900, and more particularly from the front of the stand 912. Also, feeding and routing the sheet stock material around the constant entry roller 196 and the guide roller 1064 is simplified, as substantially all of the travel path of the sheet stock material is accessible from the front of the dunnage conversion system 900.

As will be appreciated, the forward tilting dunnage conversion machine 910 is tiltable to positions lower than that obtainable by the earlier described rearward tilting dunnage conversion machine 10. This is facilitated by the cover 162 being less in width than the width between the upright guide members 922 of the stand 912, thus enabling the cover 162 to fit therebetween and the dunnage conversion machine 910 to be tilted until the downstream wall 174 of the frame 150 abuts or extends parallel to the upright guide members 922.

Details of the dunnage conversion machine 910 are shown in FIGS. 27 and 28. The dunnage conversion machine 910 is substantially the same as the afore described dunnage conversion machine 10 (see FIGS. 7–16, for example), except as described herein. In the several Figures, like reference numerals represent like components or features.

The dunnage conversion machine 910 includes a transversely extending infeed paper guide plate 1060 which is connected at its lateral edges to the side walls 170 of the frame 150 of the dunnage conversion machine 910. The upstream end of the guide plate 1060 has a lip 1062. A guide roller 1064 is disposed at the downstream end of the guide plate 1060 and is rotatably supported at its opposite ends by the side walls 170. Unlike the dunnage conversion machine 10, the dunnage conversion machine 910 does not include the pivotable infeed guide assembly 158, or the guide bars 202 and 220.

The path of the sheet stock material through the dunnage conversion machine is illustrated in part in FIGS. 27 and 28. From the stock supply 27, the sheet stock material passes through the opening in the bottom of the frame 150 and alongside the guide plate 1060 and the lip 1062 thereof. The sheet stock material is then trained around the guide roller 1064. From the guide roller 1064, the sheet stock material passes alongside or underneath the guide panel 190 extending transversely between the side arms 184. The sheet stock material is then trained around the constant entry roller 196. The constant entry roller 196, in turn, guides sheet stock material downstream to the converting components of the dunnage conversion machine 910 in a manner similar to that described above with reference to the dunnage conversion machine 10.

In accordance with the invention, the sheet stock material is substantially contained by the upright guide members 922 of the stand 912 and the dunnage conversion machine 910 so that loops or undulations exhibited by the sheet stock material during operation of the machine 910 are prevented or at least minimized. Advantageously, the travel path of the sheet stock material is maintained substantially inside the machine 910 or in close proximity to the machine 910 so that little or no paper loops form external to the machine 910.

Turning now to FIGS. 32 to 38 and FIG. 40, there is shown four exemplary baled stacks of fan folded sheet stock material 1100, 1102, 1104 and 1106 in accordance with the present invention. The baled stacks 1100, 1102, 1104 and 1106 may be used in connection with either of the dunnage conversion machines 10 and 910 disclosed herein, or in connection with any suitable dunnage conversion machine or system. The baled stacks 1100, 1102, 1104 and 1106 may be easily stored and/or transported and, as is described below, easily loaded into the dunnage conversion machines stands 12 and 912 to which the dunnage conversion machines 10 and 910 are mounted. Also, the baled stacks of sheet stock material 1100, 1102, 1104 and 1106 may be easily spliced to another stack of sheet stock material.

The baled stack 1100 includes a stack of fan folded sheet stock material 1110, a jacket 1112 and a pair of transversely spaced bale ties 1120. The stack of sheet stock material 1110 includes one or more plies of sheet stock material that are fan folded into a rectangular stack. The series of folds together form a sequence of rectangular pages which are piled accordion style one on top of the other to form the stack of sheet stock material 1110. The stack of sheet stock material 1110 has a top 1130, bottom 1132, front side 1134, rear side 1136, left side 1138 and right side 1140. For further details relating to an exemplary stack of sheet stock material, and the means for forming same, reference may be had to U.S. Pat. Nos. 5,387,173 and 5,882,767, both of which are assigned to the assignee of the present invention and are hereby incorporated herein by reference in their entireties.

Figure 32:
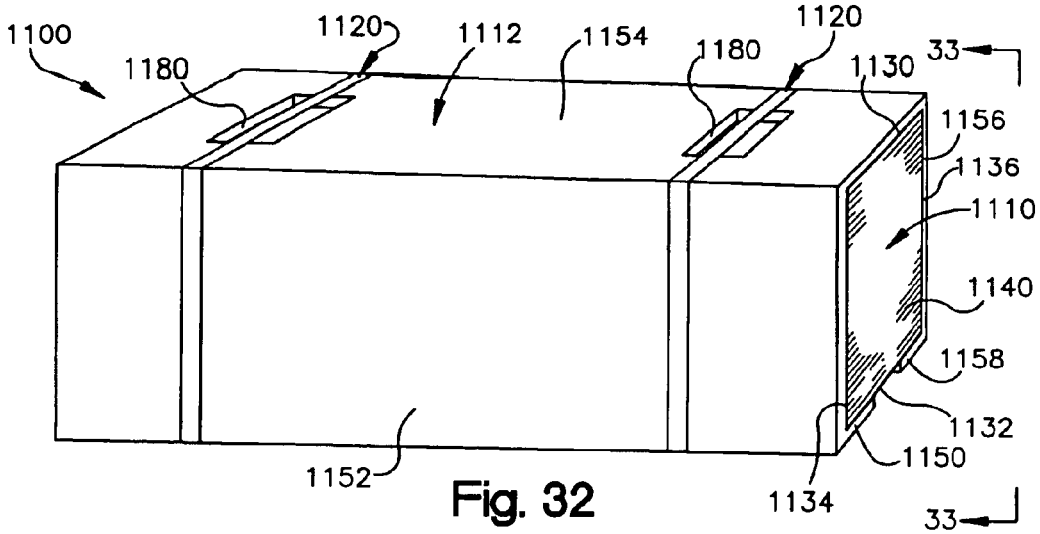
FIG. 32 is a perspective view of a baled stack of sheet stock material in accordance with the present invention.
Figure 33:
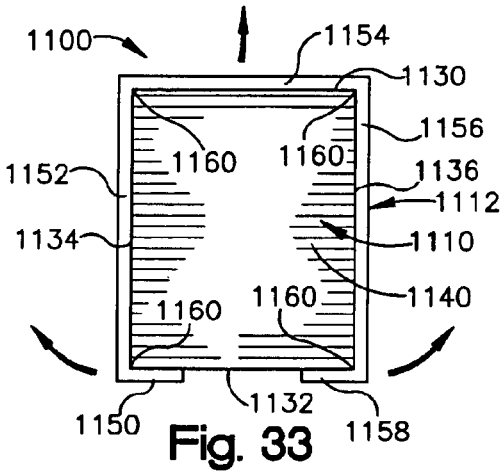
FIG. 33 is a side view of the baled stack of FIG. 32 as viewed from the line 33—33 in FIG. 32.

The jacket 1112 maintains the stack of sheet stock material 1110 in a compressed form. The jacket 1112 may be made of any suitable flexible material, for example, cardboard or plastic. The jacket 1112 includes a front bottom flap or tab 1150, a front panel 1152, a top panel 1154, a rear panel 1156, and a rear bottom flap or tab 1158 separated by four transversely extending fold lines 1160 (FIG. 33). The fold lines 1160 facilitate folding of the jacket 1112 from a substantially planar pre-folded configuration to the folded configuration shown in FIGS. 32–34.

The jacket 1112 is secured to the stack of sheet stock material 1110 by the bale ties 1120. The bale ties 1120 may be made of any suitable material, for example, nylon or wire. As is shown in FIG. 32, the top panel 1154 of the jacket 1112 includes a pair of rectangular shaped openings 1180. The bale ties 1120 extend longitudinally across the openings 1180 approximately at the center thereof. The width of the openings 1180 is slightly wider than the width of the human hand, enabling the bale ties 1120 extending thereacross to be conveniently grasped via the openings 1180.

Figure 34:
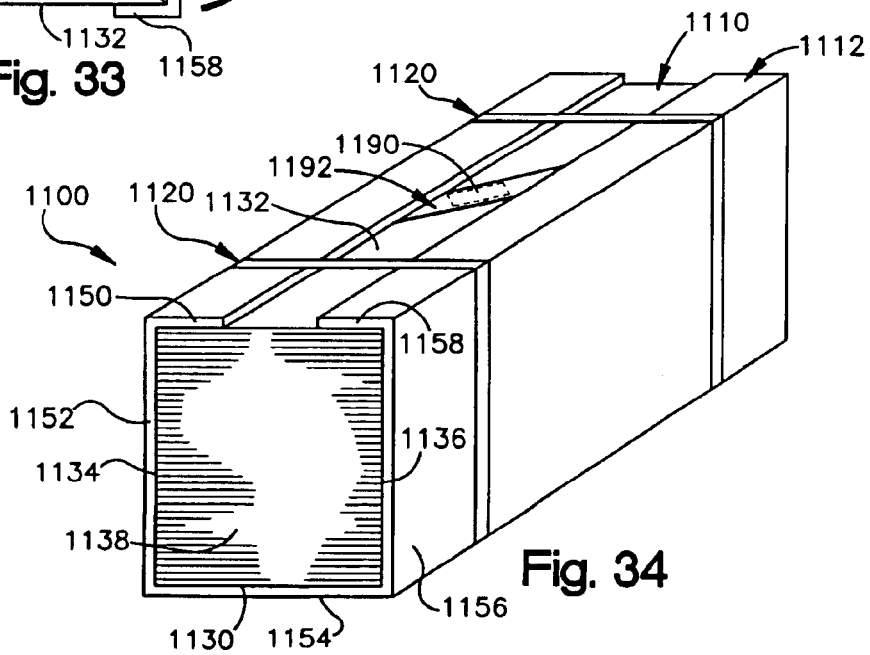
FIG. 34 is a bottom perspective view of the baled stack of FIG. 32.

As is shown in FIGS. 32 and 34, the width of the jacket 1112 is substantially the same as the width of the stack of sheet stock material 1110, and the jacket 1112 does not cover the left or right sides 1138 and 1140 of the stack of sheet stock material 1110. Also, as is shown in FIGS. 32–34, the front and rear bottom tabs 1150 and 1158 of the jacket 1112 extend under the bottom 1132 of the stack of sheet stock material 1110 to cover only a portion thereof, leaving exposed a transverse middle section of the bottom 1132 of the stack of sheet stock material 1110.

An adhesive layer 1190, for example glue or a double sided adhesive tape, is applied to the bottom 1132 of the stack of sheet stock material 1110. The adhesive layer 1190 is indicated by dashed lines in FIGS. 34 and 35. A release liner 1192, which is longer than the strip of adhesive 1190, covers the adhesive layer 1190. The adhesive layer 1190 and the release liner 1192 are disposed diagonally relative to the rectangular perimeter of the bottom 1132 of the stack of sheet stock material 1110. The adhesive layer 1190 is disposed approximately at the center of the bottom 1132 of the stack of sheet stock material 1110. The free ends of the release liner 1192 extend beyond the perimeter of the bottom 1132 of the stack of sheet stock material 1110 and form a pair of flexible pull straps 1198. When the stack of sheet stock material 1110 is secured in the jacket 1112, the pull straps 1198 are captured between the front side 1134 and rear side 1136 of the stack of sheet stock material 1110 and the respective front and rear panels 1152 and 1156 of the jacket 1112.

To load the baled stack 1100 into the stand 912, for example, the bale ties 1120 are grasped via the openings 1180 and the baled stack 1100 is lifted and inserted between the upright guide members 922 of the stand 912 in the manner described above with reference to FIGS. 22–26, for example, such that the baled stack 1100 rests on the base 18 of the stand 912. Alternatively, the baled stack 1100 may be stacked atop another stack of sheet stock material, for example, when it is desired to splice the two stacks together. Also, any desired quantity of baled stacks 1100 may be stacked one on top of the other, such quantity being limited to the height available between the base 18 of the stand 912 and the dunnage conversion machine 910 thereabove.

After the baled stack 1100 is loaded into the stand 912, the bale ties 1120 are cut and slid from underneath the jacket 1112 of the baled stack 1100. The front panel 1152, rear panel 1156 and/or the top panel 1154 of the jacket 1112 are then pulled upwardly and/or outwardly away from the stack of sheet stock material 1110, as illustrated for example by the arrows in FIG. 33, thereby to slide and remove the front and rear bottom tabs 1150 and 1158 of the jacket 1112 from underneath the stack of sheet stock material 1110. Once the front and rear bottom tabs 1150 and 1158 are removed from beneath the stack of sheet stock material 1110, the stack of sheet stock material 1110 falls slightly, that is a distance equal to the thickness of the jacket 1112, to the base 18 of the stand 912, or if a stack of sheet stack material already resides in the stand 912, then to such stack.

The jacket 1112 is then removed from the stand 912, thereby exposing the pull straps 1198 of the release liner 1192. In the illustrated embodiment, the jacket 1112 is wider than the span between the upright guide members 922 of the stand 912. Thus, the jacket 1112 may need to be tilted or otherwise manipulated to be removed from the stand 912. It will be appreciated that the jacket 1112 may have a width less than the span between the upright guide members 922 of the stand 912, in which case no such tilting or manipulation would be necessary.

If the stack of sheet stock material 1110 is loaded atop another stack of sheet stock material, and it is desired to splice the upper stack 1110 to the lower stack, either one of the pull straps 1198 may be pulled to remove the release liner 1192 from between the upper stack 1110 and the lower stack thereby to expose the adhesive layer 1190 on the bottom of the upper stack 1110. The weight of the upper stack of sheet stock material 1110 compresses together the bottom or trailing end page of the upper stack 1110 and the top or leading end page of the lower stack of sheet stock material. The adhesive layer 1190, compressed therebetween, adhesively bonds such pages to effect a splicing of the trailing end page of sheet stock material of the upper stack 1110 to the leading end page of sheet stock material of the lower stack.

Figure 37:
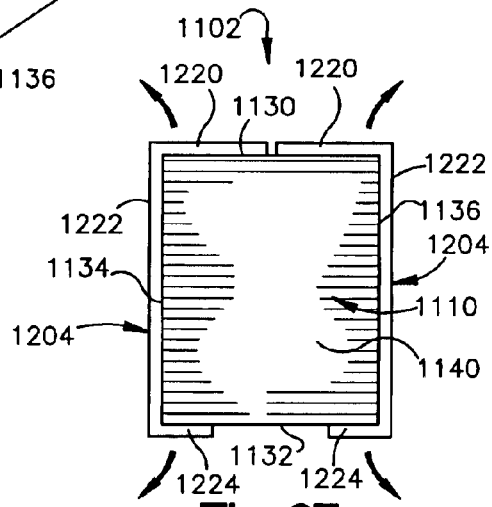
FIG. 37 is a side of the baled stack of FIG. 36 as viewed from the line 37—37 in FIG. 36.
Figure 36:
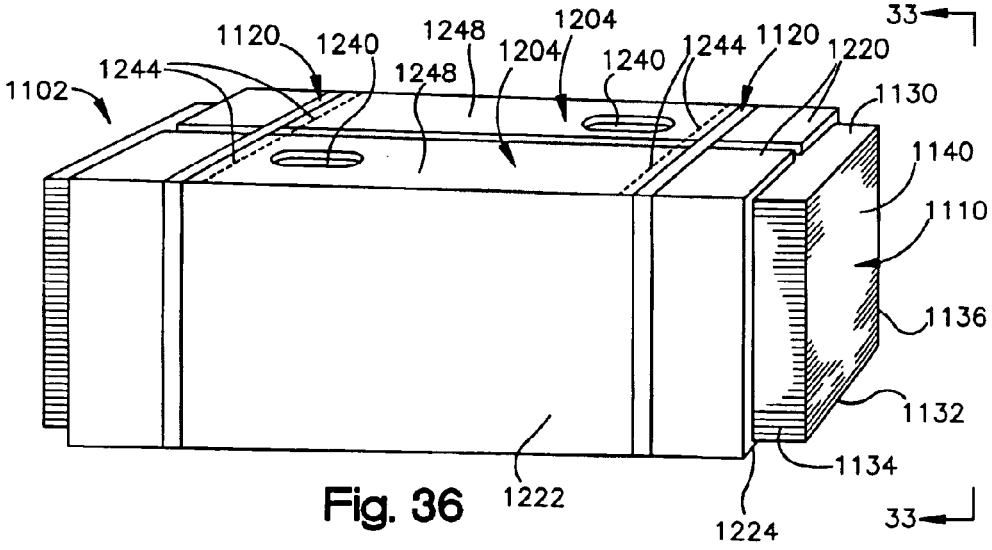
FIG. 36 is a perspective view of a baled stack of sheet stock material in accordance with another embodiment of the present invention.

FIGS. 36 and 37 show another embodiment of a baled stack of fan folded sheet stock material 1102 in accordance with the present invention. Except as described herein, the baled stack 1102 is substantially the same as the afore described baled stack 1100. In the several Figures, like reference numerals represent like components or features.

The baled stack 1102 includes a jacket having two jacket pieces 1204 that together maintain the stack of sheet stock material 1110 in its compressed form. As is shown in FIG. 36, the width of the jacket pieces 1204 is narrower than the width of the stack of sheet stock material 1110 and, like the afore described baled stack 1100, the jacket pieces 1204 do not cover the left or right sides 1138 and 1140 of the stack of sheet stock material 1110.

Each jacket piece 1204 includes a top panel 1220, an intermediate panel 1222, and a bottom flap or tab 1224, separated by two transversely extending fold lines 1230 and 1232. As is shown in FIG. 37, the intermediate panels 1222 of the jacket pieces 1204 cover the front side 1134 and rear side 1136 of the stack of sheet stock material 1110. The top panels 1220 extend longitudinally in opposite relation to one another to cover longitudinally spaced portions of the top 1130 of the stack of sheet stock material 1110, and are longitudinally spaced by a relatively narrow transverse gap. Like the front and rear bottom tabs 1150 and 1158 of the jacket 1112, the bottom tabs 1224 of the jacket pieces 1204 extend under the bottom 1132 of the stack of sheet stock material 1110 to cover only a portion thereof, leaving exposed a transverse middle section of the bottom 1132 of the stack of sheet stock material 1110.

The top panels 1220 of each jacket piece 1204 include a generally oval shaped opening 1240 sized sufficiently to receive therethrough the human hand. The top panels 1220 also include a pair of transversely spaced longitudinally extending perforations or tear lines 1244, indicated by dashed lines in FIG. 36. The tear lines 1244 facilitate tearing of the top panels 1220 to form a pair of handles 1248 for handling the baled stack of sheet stock material 1102, as is further described below. The jacket pieces 1204 are secured to the stack of sheet stock material 1110 by the bale ties 1120. The bale ties 1120 are spaced laterally outward from the tear lines 1244.

An adhesive layer 1190 is applied to the bottom 1132 of the stack of sheet stock material 1110, and a release liner 1192 covers the adhesive layer 1190 and also forms a pair of straps 1198. When the stack of sheet stock material 1110 is secured in the jacket pieces 1204, the pull straps 1198 are captured between, respectively, the front side 1134 and rear side 1136 of the stack of sheet stock material 1110 and the intermediate panels 1222 of the jacket pieces 1204.

To load the baled stack 1102 into the stand 912, for example, the top panels 1220 are torn along the tear lines 1244 to form the pair of upright handles 1248. The handles 1248 are grasped via the openings 1240 and the baled stack 1102 is lifted and inserted between the upright guide members 922 of the stand 912 in the manner described above, for example, such that the baled stack 1102 rests on the base 18 of the stand 912. Alternatively, the baled stack 1102 may be stacked atop another stack of sheet stock material, for example, when it is desired to splice the two stacks together. Once the baled stack 1102 is loaded into the stand 912, the bale ties 1120 are cut and slid from underneath the jacket pieces 1204 of the baled stack 1102. The top panel 1220 and/or intermediate panel 1222 of each jacket piece 1204 are then pulled upwardly and/or outwardly away from the stack of sheet stock material 1110, as illustrated for example by the arrows in FIG. 37, thereby to slide and remove the bottom tabs 1224 of the jacket pieces 1204 from underneath the stack of sheet stock material 1110. Once the bottom tabs 1224 are removed from beneath the stack of sheet stock material 1110, the stack of sheet stock material 1110 falls slightly, that is a distance equal to the thickness of the jacket pieces 1204, to the base 18 of the stand 912, or to the stack of sheet stock material below the stack 1110.

The jacket pieces 1204 are then removed from the stand 912, thereby exposing the pull straps 1198 of the release liner 1192. In the illustrated embodiment, the jacket pieces 1204 have a width less than the span between the upright guide members 922 of the stand 912. Thus, the jacket pieces 1204 may be removed from the stand 912 without the need to tilt or otherwise manipulate the jacket pieces 1204. In an alternative embodiment, the jacket pieces 1204 have a width that is wider than the span between the upright guide members 922 of the stand 912 and, accordingly, the jacket pieces 1204 may need such tilting to be removed therefrom.

As with the previously described embodiment, if it is desired to splice the upper stack 1110 to the lower stack, either one of the pull straps 1198 may be pulled to remove the release liner 1192 from between the upper stack 1110 and the lower stack and expose the adhesive layer 1190. The adhesive layer 1190, compressed therebetween, splices together the trailing end page of sheet stock material of the upper stack 1110 and the leading end page of sheet stock material of the lower stack.

Figure 38:
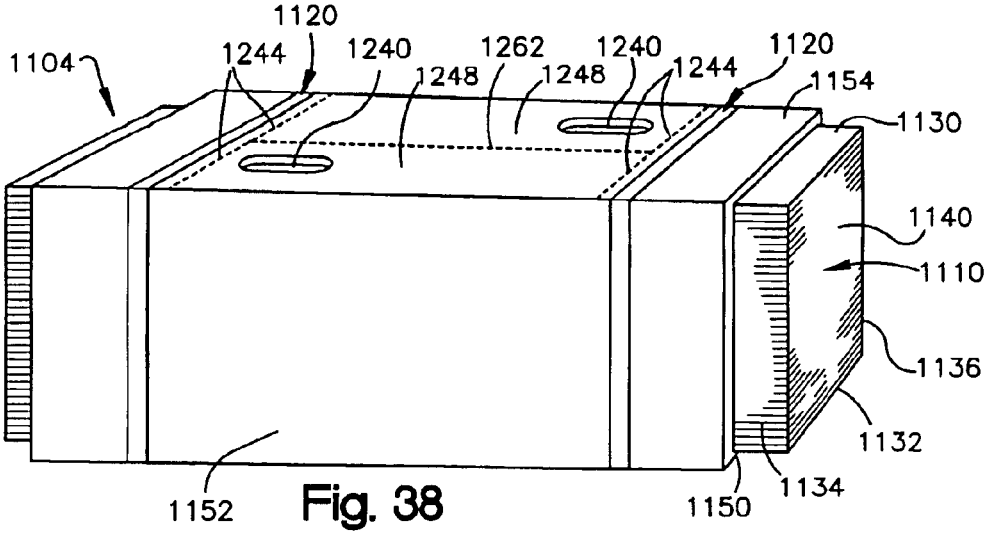
FIG. 38 is a perspective view of a baled stack of sheet stock material in accordance with another embodiment of the present invention.

FIG. 38 shows another embodiment of a baled stack of fan folded sheet stock material 1104 in accordance with the present invention. Except as described herein, the baled stack 1104 is substantially the same as the afore described baled stacks 1100 and 1102. In the several Figures, like reference numerals represent like components or features.

The baled stack 1104 includes a one-piece jacket 1260 that covers the stack of sheet stock material 1110 in a manner similar to that of the jacket 1112 of the baled stack 1100. In this regard, the jacket 1260 has panels and fold lines similar to those of the jacket 1112. The jacket 1260 also has longitudinal tear lines and top panel openings similar to those of the jacket pieces 1204. The jacket 1260 additionally includes a tear line 1262 that extends transversely between the tear lines 1244. Together, the longitudinal tear lines 1244 and the transverse tear line 1262 facilitate tearing of the top panel 1154 to form a pair of handles 1248 for handling the baled stack of sheet stock material 1104.

To load the baled stack 1104 into the stand 912, for example, the top panel 1154 is torn along the tear lines 1244 and 1262 to form the pair of upright handles 1248. The baled stack 1104 is then loaded into the stand 912 via the handles 1248 in a manner similar to that described above with reference to the baled stack 1102. The bale ties 1120 are cut, and the jacket 1262 is removed in substantially the same manner that the jacket 1112 of the baled stack 1100 is removed. The stack of sheet stock material 1110 may be spliced to a lower stack also in a manner substantially the same as that described above with respect to the baled stacks 1100 and 1102.

Figure 39:
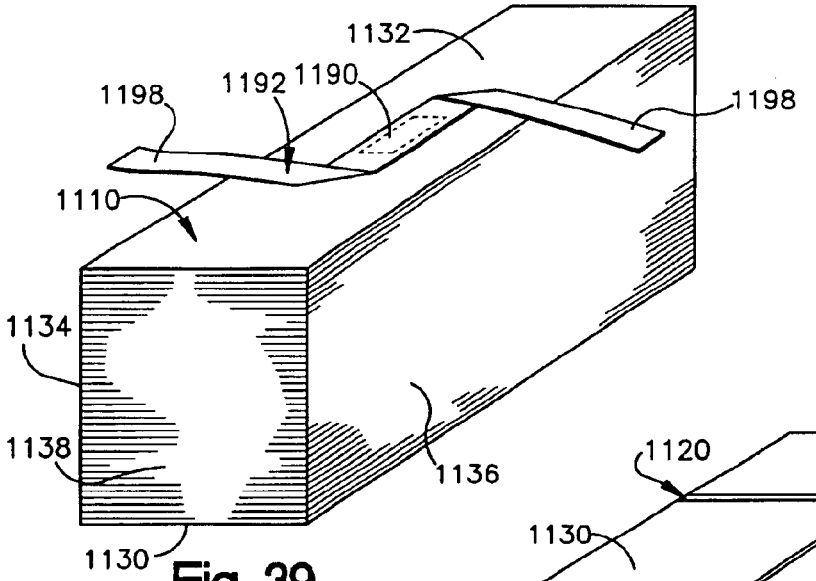
FIG. 39 is a bottom perspective view of a stack of sheet stock material in accordance with another embodiment of the present invention.

Turning now to FIG. 39, there is shown an alternative manner by which the adhesive layer 1190 and the release liner 1192 may be applied to the stack of sheet stock material 1110 in each of the baled stacks 1100, 1102, 1104 and 1106 (described below), or on any other suitable stack of sheet stock material. The adhesive layer 1190 is adhered to the bottom 1132 of the stack of sheet stock material 1110 at approximately the center thereof. Unlike the orientation in the FIG. 35 embodiment, in which the adhesive layer 1190 is disposed diagonally relative to the rectangular perimeter of the bottom 1132 of the stack 1110, the orientation of the adhesive layer 1190 in the FIG. 39 embodiment is such that the adhesive layer 1190 is disposed substantially parallel to the front and rear sides 1134 and 1136 of the stack 1110.

The release liner 1192 covers the adhesive layer 1190 and has its free ends folded over the intermediate covering portion, for example at about right angles to the intermediate covering portion. Like the FIG. 35 embodiment, the free ends of the release liner 1192 extend beyond the perimeter of the bottom 1132 of the stack of sheet stock material 1110 and form a pair of flexible pull straps 1198. When the stack of sheet stock material 1110 is secured in a jacket, the pull straps 1198 are captured between the front side 1134 and rear side 1136 of the stack of sheet stock material 1110 and the corresponding adjacent panels of the jacket. The stack of sheet stock material 1110 is spliced to another stack of sheet stock material in a manner similar to that of the afore described FIG. 35 embodiment, that is either one of the pull straps 1198 may be pulled to remove the release liner 1192 from between the upper stack 1110 and the lower stack and expose the adhesive layer 1190. The adhesive layer 1190, compressed therebetween, splices together the trailing end page of sheet stock material of the upper stack 1110 and the leading end page of sheet stock material of the lower stack.

Figure 40:
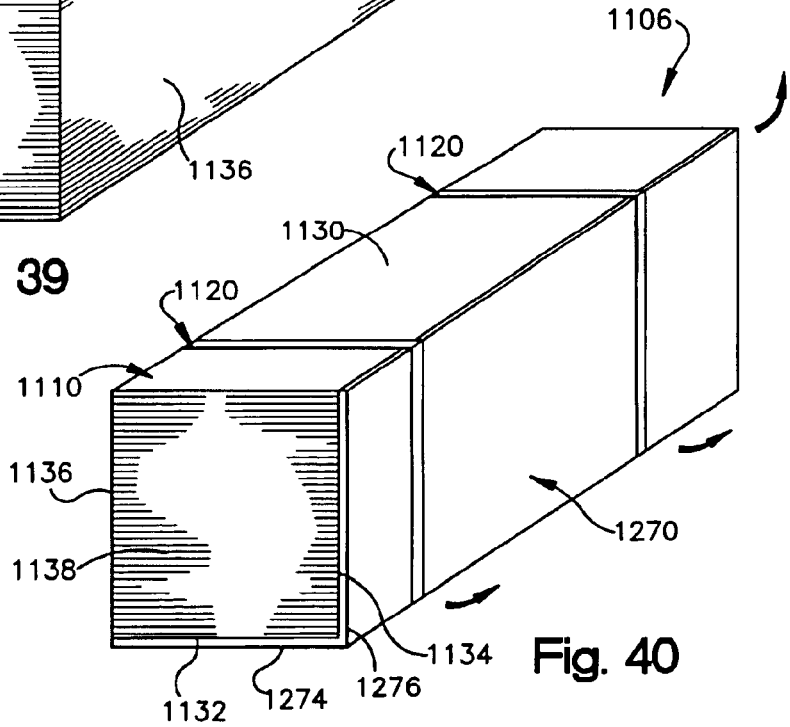
FIG. 40 is a perspective view of a baled stack of sheet stock material in accordance with still another embodiment of the present invention.

FIG. 40 shows another embodiment of a baled stack of fan folded sheet stock material 1106 in accordance with the present invention. Except as described herein, the baled stack 1106 is substantially the same as the afore described baled stacks 1100, 1102 and 1104. In the several Figures, like reference numerals represent like components or features.

The baled stack 1106 includes a stack of fan folded sheet stock material 1110, a jacket 1270 and a pair of transversely spaced bale ties 1120. The jacket 1270 includes a base flap or tab 1274 and an upright flap or tab 1276 separated by a transversely extending fold line 1278. Together, the base flap 1274 and upright flap 1276 form an L-shaped jacket 1270. In the illustrated exemplary embodiment, the base flap 1274 has substantially the same width and length as the top 1130 and bottom 1132 of the stack of sheet stock material 1110, and the upright flap 1276 has substantially the same width and height as the front side 1134 and rear side 1136 of the stack of sheet stock material 1110. It will be appreciated that the base flap 1274 and upright flap 1276 need not necessarily extend the full extent of the adjacent side of the stack of sheet stock material 1110.

The jacket 1270 maintains the stack of sheet stock material 1110 in its compressed form and is secured to the stack of sheet stock material 1110 by the bale ties 1120. As is preferred, the base flap 1274 of the jacket 1270 extends under the bottom 1132 of the stack of sheet stock material 1110 and the upright flap 1276 is disposed adjacent either the front side 1134 as shown, or the rear side 1136. Although not shown in the illustrated embodiment, corner pieces made of plastic for example may be inserted between the bale ties 1120 and the stack of sheet stock material 1110 at the corners thereof, for example, at the corners of the stack of sheet stock material 1110 that are not covered by the jacket 1270. Such corner pieces protect the stack of sheet stock material 1110 from any deleteriously effects from the bale ties 1120 for example.

Figure 35:
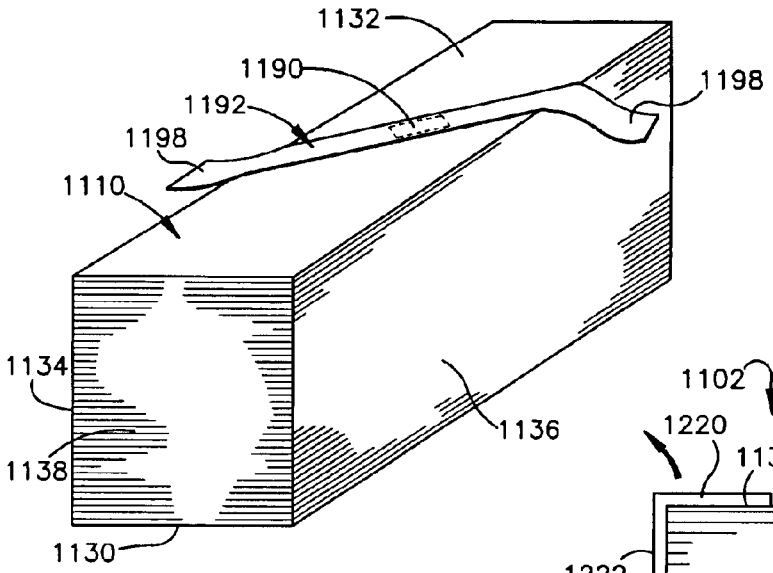
FIG. 35 is a bottom perspective view of the stack of sheet stock material forming part of the baled stack of FIG. 32.

An adhesive layer 1190 (not shown in FIG. 40) is applied to the bottom 1132 of the stack of sheet stock material 1110 of the baled stack of sheet stock material 1106, with a release liner 1192 covering same, such as is shown in FIG. 35 or 39. One of the straps 1198 of the release liner 1192 are captured between the front side 1134 of the stack of sheet stock material 1110 and the upright flap 1276 of the jacket 1270. The other strap 1198 remains free or may be omitted.

To load the baled stack 1106 into the stand 912, for example, the bale ties 1120 are grasped, for example, by inserting the hand under same, and the baled stack 1106 is lifted and inserted between the upright guide members 922 of the stand in the manner described above with reference to FIGS. 22–26, for example, such that the baled stack 1106 rests on the base 18 of the stand 912. Alternatively, the baled stack 1106 may be stacked atop another stack of sheet stock material, for example, when it is desired to splice the two stacks together. Once the baled stack 1106 is loaded into the stand 912, the bale ties 1120 are cut and slid from underneath the jacket 1270 of the baled stack 1106. The base flap 1274 and/or upright flap 1276 of the jacket 1270 are then pulled upwardly and/or outwardly away from the stack of sheet stock material 1110, as illustrated for example by the arrows in FIG. 40, thereby to slide and remove the base flap 1274 of the jacket 1270 from underneath the stack of sheet stock material 1110. Once the base flap 1274 is removed from beneath the stack of sheet stock material 1110, the stack of sheet stock material 1110 falls slightly, that is a distance equal to the thickness of the jacket 1270, to the base 18 of the stand 912, or to the stack of sheet stock material below the stack 1110.

The jacket 1270 is then removed from the stand 912, thereby exposing the pull straps 1198 of the release liner 1192. If it is desired to splice the upper stack 1110 to the lower stack, either one of the pull straps 1198 may be pulled to remove the release liner 1192 from between the upper stack 1110 and the lower stack and expose the adhesive layer 1190. The adhesive layer 1190, compressed therebetween, splices together the trailing end page of sheet stock material of the upper stack 1110 and the leading end page of sheet stock material of the lower stack.

It will be appreciated that various of the components and/or features of the baled stacks of sheet stock material 1100, 1102, 1104 and 1106 and/or the stack of sheet stock material 1110 may be combined to form alternative baled stacks of sheet stock material. For example, the jacket 1112 of the baled stack 1100 of FIGS. 32–34 may have a relatively narrower width than the width of the stack of sheet stock material that it covers. Also, the jacket 1112 of the baled stack 1100 may alternatively comprise two separate jacket pieces such as the jacket pieces illustrated in FIG. 36. In another embodiment, the jacket pieces 1204 of the baled stack 1102 of FIGS. 36 and 37 each include, in lieu of the oval shaped openings 1240, openings that form rectangular shaped openings similar to those shown in FIG. 32. The tear lines 1244 may be spaced inwardly from the rectangular shaped openings. The stack of sheet stock material 1110 in any of the baled stacks 1100, 1102, 1104 and 1106 may be equipped with the adhesive layer 1190 and release liner 1192 in either the diagonal or the parallel orientations discussed above. In an alternative embodiment, the adhesive layer 1190 and the release liner 1192 are disposed on the top of the stack of sheet stock material 1110. Still further, the baled stacks 1100, 1102, 1104 and 1106 alternatively may not include such an adhesive layer 1190 and release liner 1192, for example, in applications in which splicing is not necessary or desired. Still further, the stack of sheet stock material 1110 may be partially surrounded by a jacket and without the bale ties, for example, in applications in which the jacketed stack itself may be transported and/or inserted into a stand.

Turning now to FIGS. 41–53, there are shown several alternative embodiments of pulling assemblies and/or forming sections suitable for use in dunnage conversion machines such as the aforedescribed dunnage conversion machines 10, 762, 800, and 910, for feeding, connecting, pulling, gathering and/or crumpling sheet stock material. As will be appreciated, the embodiments shown in FIGS. 41–53 may be supported and/or driven in any suitable manner, or in a manner similar to that disclosed above for the pulling assembly 328 and the forming section 326. Accordingly, the support structure and surrounding components are not described in detail. In the several figures, like reference numerals represent like components or features.

Figure 41:
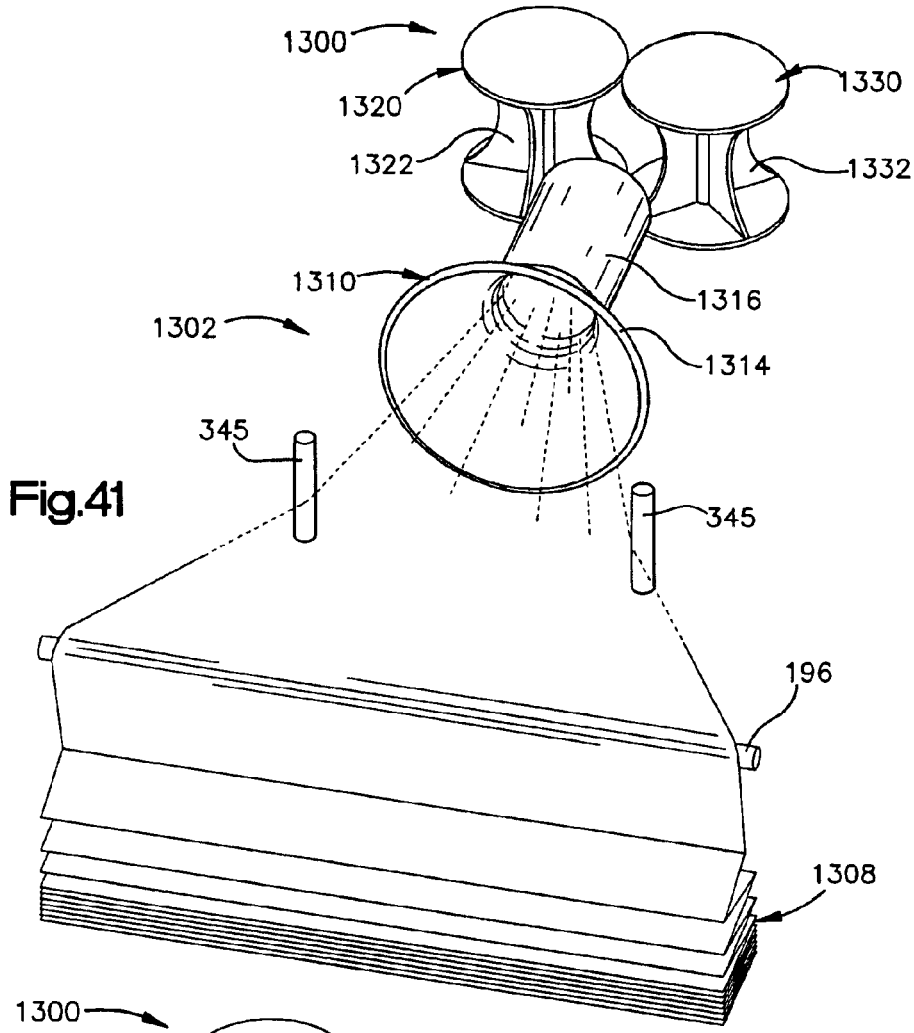
FIG. 41 is a schematic perspective view of a pulling mechanism and forming section in accordance with another embodiment of the present invention, with sheet stock material being shown trained around a constant entry roller and passing through the forming section.

FIG. 41 shows a pulling assembly 1300 and a forming section 1302 in accordance with the present invention. A constant entry roller 196 is located upstream of the forming section 1302. Upstream from the constant entry roller 196 is a supply of sheet stock material, which may be in the form of a stack of fan-folded sheet stock material 1308 as shown, or a roll of sheet stock material.

The forming section 1302 includes a pair of side guide bars 345 and a constriction member 1310. The constriction member 1310, which is also referred to as a gathering member, includes a tapered or funnel portion 1314 and a tube 1316, which together give the constriction member 1310 a funnel shape. The illustrated tube 1316 is cylindrical in shape, although it will be appreciated that the tube 1316 may take on other shapes, such as having a oval shaped cross section. In the illustrated exemplary embodiment, the tapered portion 1314 and the tube 1316 form an integral structure and the downstream portion of the tapered portion 1314 that transitions into the tube 1316 preferably has a smooth radius. The constriction member 1310 may be made of any suitable material, for example plastic or metal.

The pulling assembly 1300 is located downstream of the forming section 1302 and includes a first transfer assembly 1320 including a first set of translating grippers 1322, and a second transfer assembly 1330 including a second set of cooperating and opposing translating grippers 1332. The grippers 1322 and 1332 are translated along respective circular paths. In the illustrated embodiment, each transfer assembly 1320 and 1330 includes four grippers 1322 and 1332 that are uniformly circumferentially spaced apart. The grippers 1322 of the first transfer assembly 1320 and the grippers 1332 of the second transfer assembly 1330 can be rotated in phase or out of phase (as shown) with respect to one another. The grippers 1322 and 1332, as shown, each have a somewhat semicircular or semi-oval shaped outwardly opening aperture. However, the grippers 1322 and 1332 can be replaced by the previously described grippers. More generally, any of the herein described grippers can be used interchangeably.

During operation of the dunnage conversion machine, sheet stock material is trained around the constant entry roller 196 and passed between the pair of side guide bars 345. The side guide bars 345 preform and streamline the sheet stock material (shown in dashed lines between the side guide bars 345) and guide the sheet stock material to the constriction member 1310 in a manner similar to that described above in reference to FIGS. 9 and 13. In an alternative embodiment, the side guide bars 345 may be omitted from the forming section 1302, in which case the constriction member 1310 initially guides the sheet stock material from the constant entry roller 196.

The tapered portion 1314 and the tube 1316 of the constriction member 1310 further form or shape the sheet stock material and perform the additional function of directing the formed strip of dunnage into the pulling assembly 1300. As sheet stock material is passed through the tapered portion 1314, friction forces exerted on the sheet stock material from the wall of the tapered portion 1314 retard movement of some portions of the sheet material while allowing other portions to advance more easily, thereby facilitating inward crumpling of the sheet stock material.

The pulling assembly 1300, like the above described pulling assembly 328, performs at least one and preferably two functions in the operation of the dunnage conversion machine. One function is a feeding function whereby the opposing sets of translating grippers 1322 and 1332 progressively transversely engage the strip of dunnage on opposite transverse sides thereof to pull the dunnage strip through the forming section 1302 and in turn the sheet material from the supply of sheet stock material. The second function preferably performed by the pulling assembly 1300 is a connecting function whereby the opposing sets of translating grippers 1322 and 1332 deform the strip of dunnage on opposite sides thereof to form a connected strip of dunnage. Of course, other mechanisms may be employed to connect the dunnage strip, as was mentioned above.

It will be appreciated that various features of the pulling assembly 1300 and forming section 1302 may be altered to achieve different characteristics in the feeding and forming of the dunnage strip. For example, in an alternative embodiment, the transfer assemblies 1320 and 1330 of the pulling assembly 1300 may have fewer or a greater number of grippers 1322 and 1332, or the geometry of the grippers 1322 and 1332 may be different than that which is shown. Also, the length or diameter of the tube 1316, or the length or the degree of taper of the tapered portion 1314 of the forming section 1302 may be modified to effect different characteristics in the feeding and formation of the dunnage strip. Such alternatives are contemplated as falling within the scope of the presently claimed invention.

Figure 42:
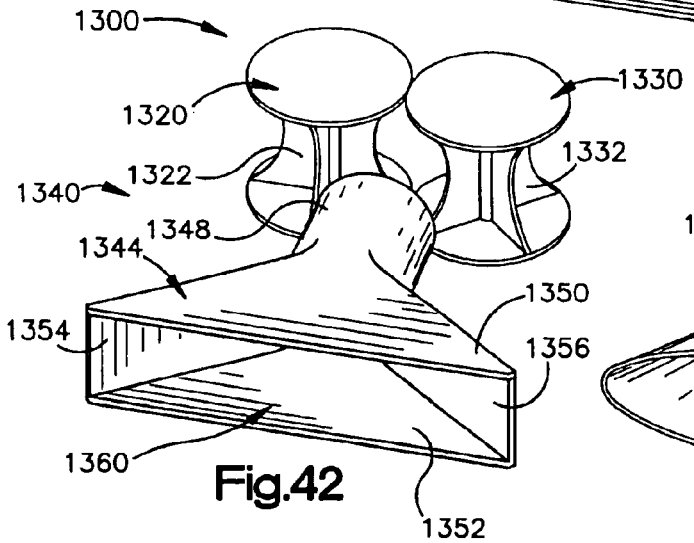
FIG. 42 is a schematic perspective view of a pulling mechanism and forming section in accordance with still another embodiment of the present invention.
Figure 43:
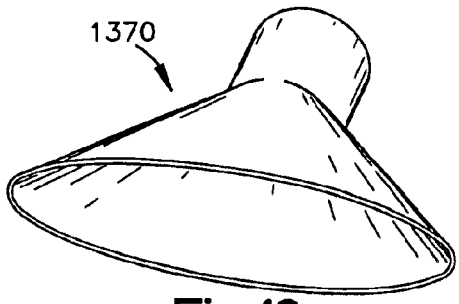
FIG. 43 is a schematic perspective view of a forming section in accordance with another embodiment of the present invention.

FIG. 42 shows another embodiment of a forming section 1340 in accordance with the present invention, which forming section 1340 is shown for example in combination with the pulling assembly 1300 of FIG. 41. The forming section 1340 is similar to the aforedescribed forming section 1302, except that it includes a flattened tapered or funnel portion 1344 that functions as both a preformer and a former.

The forming section 1340 includes the flattened tapered portion 1344 and a tube 1348. Like the above described tube 1316, the as shown tube 1348 is cylindrical in shape, although it will be appreciated that the tube 1348 may take on other shapes, such as having a oval shaped cross section. The flattened tapered portion 1344 includes generally triangular shaped top and bottom walls 1350 and 1352, and a pair of generally rectangular shaped side walls 1354 and 1356 that are connected at their top and bottom edges to the top and bottom walls 1350 and 1352 and taper inwardly towards one another in an upstream to downstream manner. At their upstream end, the top and bottom walls 1350 and 1352 and the side walls 1354 and 1356 together form a rectangular shaped inlet opening 1360 while the downstream end transitions into and is integrally connected to the tube 1348. The wide dimension of the rectangular shaped inlet opening 1360 is aligned with the plane of the sheet stock material from the constant entry roller 196 (not shown in FIG. 42). If desired, the angled corners between the walls can be rounded, and the walls may also be rounded such that the flattened tapered portion 1344 has an oval cross-sectional shape, as is illustrated for example in FIG. 43.

During operation of the dunnage conversion machine, sheet stock material is trained around the constant entry roller 196 and passes through the rectangular shaped inlet opening 1360 of the forming section 1340. The flattened tapered portion 1344 of the forming section 1340 preforms and streamlines the sheet stock material and guides the sheet stock material to the tube 1348. The flattened tapered portion 1344 and the tube 1348 together form or shape the sheet stock material and direct the formed strip of dunnage into the pulling assembly 1300. As sheet stock material is passed through the flattened tapered portion 1344, friction forces exerted on the sheet stock material from the walls 1350, 1352, 1354 and 1356 of the flattened tapered portion 1344 retard movement of some portions of the sheet material while allowing other portions to advance more easily, thereby facilitating inward crumpling of the sheet stock material.

Figure 44:
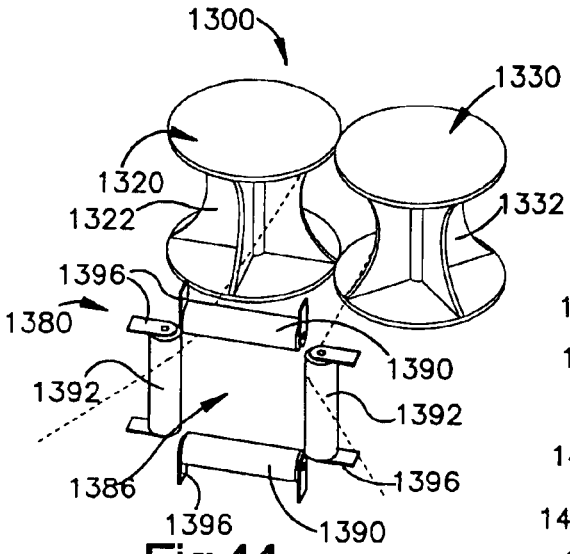
FIG. 44 is a schematic perspective view of a pulling mechanism and forming section in accordance with yet another embodiment of the present invention.

FIG. 44 shows another embodiment of a forming section 1380 in accordance with the present invention, which forming section 1380 is shown for example in combination with the pulling assembly 1300 of FIG. 41. In the FIG. 44 embodiment, the forming section 1380 includes an annular array of rollers 1390 and 1392, wherein the rollers 1390 and 1392 collectively define an aperture or opening 1386 through which the sheet stock material passes. In the illustrated exemplary embodiment there are four rollers, that is, vertically spaced apart and substantially parallel top and bottom rollers 1390 and laterally spaced apart and substantially parallel side rollers 1392. Each roller 1390 and 1392 preferably is generally cylindrical in shape and rotatably supported in a suitable manner at its opposite ends by brackets 1396. The brackets 1396 may be made to be adjustable so that the spacing between parallel rollers such as the top and bottom rollers 1390, for example, can be increased or decreased as desired for a particular converting application.

During operation of the dunnage conversion machine, sheet stock material is trained around the constant entry roller 196 and passes through the aperture 1386 of the forming section 1380. The rollers 1390 and 1392 together form, shape and streamline the sheet stock material into a strip of dunnage and guide the formed strip of dunnage into the pulling assembly 1300.

In the illustrated embodiment, the rollers 1390 and 1392 are the same size and shape. It will be appreciated that the rollers 1390 and 1392 may have a different size and/or shape. Also, although in the illustrated embodiment the top and bottom rollers 1390 are spaced apart about the same distance as the laterally spaced side rollers 1392, it will be appreciated that such spacing may be larger or smaller depending on, for example, the particular converting application. Also, although in the illustrated embodiment there is shown only a single aperture 1386, an additional aperture may be formed by an additional array of rollers, which additional aperture may be longitudinally spaced from (for example, upstream or downstream from) the first aperture 1386. Also, such additional aperture may be different in shape and size from the first aperture 1386. For example, in an embodiment, the additional aperture may be smaller and positioned downstream from the first aperture 1386 so that the strip of dunnage passing through the first aperture 1386 is further formed, shaped and streamlined, and/or reduced in cross section, as it passes through the additional aperture. Still further, it will be appreciated that the number of rollers that form a given aperture need not be limited to four as illustrated. For example, the forming section 1380 may include three or more rollers as desired. The presently claimed invention contemplates such alternatives in the shape, size, quantity and spacing between the rollers and/or the apertures formed thereby.

Figure 45:
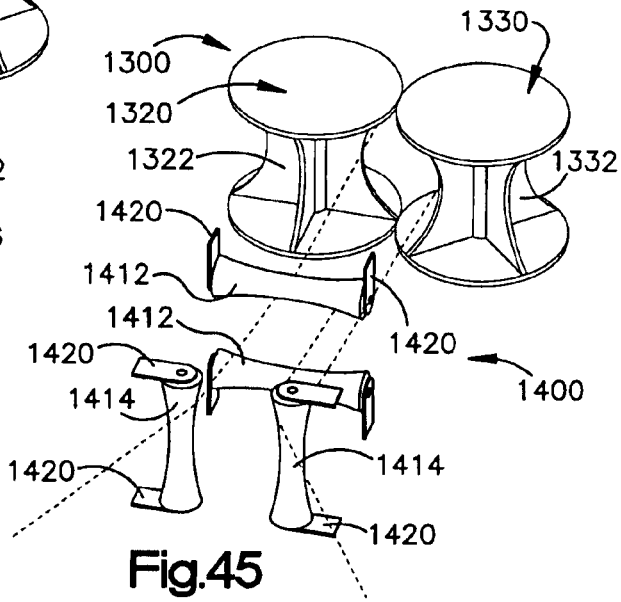
FIG. 45 is a schematic perspective view of a pulling mechanism and forming section in accordance with a further embodiment of the present invention.

FIG. 45 shows yet another embodiment of a forming section 1400 in accordance with the present invention, which forming section 1400 is shown for example in combination with the pulling assembly 1300 of FIG. 41. The forming section 1400 is similar to the aforedescribed forming section 1380, except that the rollers 1412 and 1414 have a concave outer surface and the top and bottom rollers 1412 are longitudinally spaced apart from the side rollers 1414. The concave shape of the rollers 1412 and 1414 facilitates inward rolling of the sheet stock material as same passes between the rollers 1412 and 1414. Although not illustrated, the brackets 1420 supporting the rollers 1412 and 1414 may be made to be longitudinally adjustable so that the longitudinal spacing between different sets of rollers may be increased or decreased as desired for a particular converting application. Also, although the illustrated exemplary forming section 1400 includes two sets of rollers 1412 and 1414, the presently claimed invention contemplates any number of sets of rollers. For example, in an alternative embodiment the forming section 1400 may include four sets of rollers, wherein first and second sets of top and bottom rollers are alternated with first and second sets of side rollers.

Figure 46:
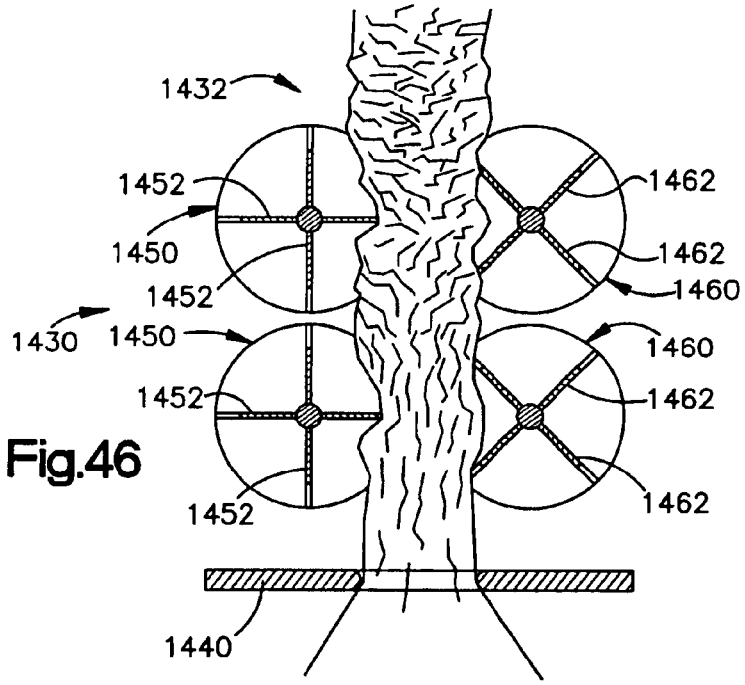
FIG. 46 is a schematic top plan view of a constriction member, and an upstream pulling mechanism and a downstream pulling mechanism, with sheet stock material being shown advanced therethrough.

Turning now to FIG. 46, there is shown an embodiment in which there are first and second pulling assemblies 1430 and 1432 longitudinally spaced apart from one another. That is, the second pulling assembly 1432 is downstream from the first pulling assembly 1430. Shown upstream from the first pulling assembly 1430 is a constriction member 1440 similar in construction to and similar in the manner of operation as the aforedescribed constriction member 348 shown in FIG. 12.

Each pulling assembly 1430 and 1432 includes a pair of transfer assemblies 1450 and 1460, and each transfer assembly 1450 and 1460 includes a set of translating grippers 1452 and 1462. In the illustrated exemplary embodiment, the transfer assemblies 1450 and 1460 and grippers 1452 and 1462 thereof are similar in construction and function in a manner similar to the transfer assemblies 1320 and 1330 and grippers 1322 and 1332 thereof of the aforedescribed pulling assembly 1300.

In accordance with the present invention, the first and second pulling assemblies 1430 and 1432 can operate at different speeds. In an exemplary embodiment, the transfer assemblies 1450 and 1460 of the second pulling assembly 1432 rotate at a slower speed than the transfer assemblies 1450 and 1460 of the first pulling assembly 1430, thereby to cause the strip of dunnage formed by the first pulling assembly 1430 to be crumpled longitudinally between the first and second pulling assemblies 1430 and 1432. Such longitudinal crumpling can increase the stiffness of the strip of dunnage produced by the first pulling assembly 1430.

In an embodiment of the invention, the transfer assemblies 1450 and 1460 of each pulling assembly 1430 and 1432 may be driven independently of each other, for example via respective independent drive mechanisms, to achieve the differing speeds. Alternatively, the transfer assemblies 1450 and 1460 of each pulling assembly 1430 and 1432 can be coupled together in a suitable manner by a speed reducer to effect differing speeds. It will be appreciated that the transfer assemblies 1450 and 1460 and the grippers 1452 and 1462 of each transfer assembly 1450 and 1460 may have differing characteristics that, for example, pull the sheet material (that is, feed the sheet material) through the constriction member 1440 and progressively crimp and/or kink (that is, connect) the strip of dunnage at regular intervals as it passes through the respective pulling assemblies 1430 and 1432. For example, the grippers 1452 and 1462 of the first pulling assembly 1430 may have a different size geometry or aperture than the grippers 1452 and 1462 of the second pulling assembly 1432, thereby to provide for example a connecting function. Alternatively, or additionally, the transfer assemblies 1450 and 1460 of the first pulling assembly 1430 may be laterally spaced from one another at a greater distance than that of the transfer assemblies 1450 and 1462 of the second pulling assembly 1432, thereby to effect, for example, different transverse crimping on the strip of dunnage.

Figure 47:
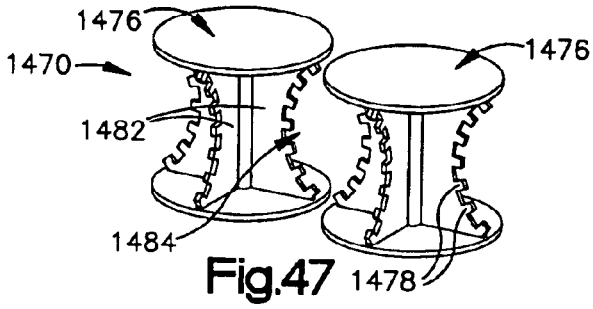
FIG. 47 is a schematic perspective view of a pulling mechanism in accordance with the present invention.
Figure 48:
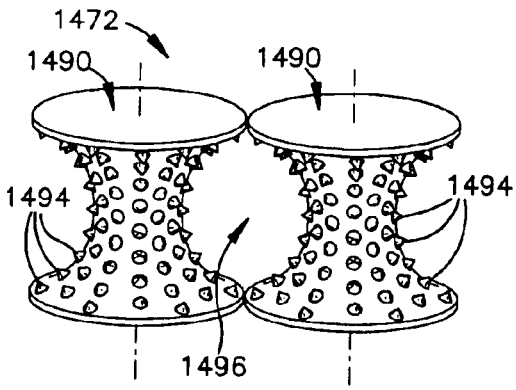
FIG. 48 is a schematic perspective view of another pulling mechanism in accordance with the present invention.
Figure 49:
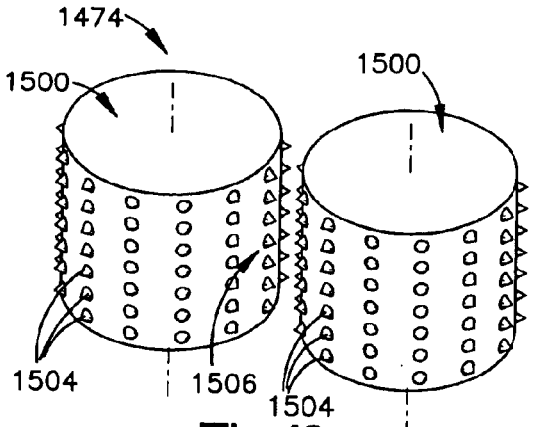
FIG. 49 is a schematic perspective view of still another pulling mechanism in accordance with the present invention.

Referring now to FIGS. 47–49, there are shown three embodiments of pulling assemblies 1470, 1472 and 1474, respectively, in accordance with the present invention. The pulling assembly 1470 includes a pair of transfer assemblies 1476, each including a set (four in the illustrated embodiment) of translating grippers 1482. The grippers 1482 are similar to the grippers 1322 and 1332 of the transfer assemblies 1320 and 1330 described above, except that the grippers 1482 are provided with finger-like projections 1478 protruding from their inner edges.

During operation of the dunnage conversion machine, the transfer assemblies 1476 gather and laterally capture the sheet stock material passing through the dunnage transfer region 1484 there between in a manner similar to the aforedescribed transfer assemblies 359 and 361, 1320 and 1330, 1450 and 1460. The projections 1478 provide a more positive grip on the sheet stock material and therefore improve the pulling effect of the pulling assembly 1470. The projections 1478 may also function as stitching or perforating fingers that perforate the sheet stock material as it is advanced between the transfer assemblies 1476. The projections 1478 can have sharp edges for penetrating the sheet stock material and can be of a length sufficient enough to stitch together overlapped portions of the sheet stock material. Such stitching aids in retaining the shape of the strip of dunnage after the strip of dunnage is released by the transfer assemblies 1476.

The pulling assembly 1472 (FIG. 48) includes a pair of transfer members 1490 each having a concave outer surface and a plurality of protruding elements 1494. The size, shape, quantity and/or arrangement of the protruding elements 1494 will depend on, for example, the particular converting application. The transfer members 1490 gather and laterally capture the sheet stock material passing there between in a manner similar to the aforedescribed transfer assemblies 359 and 361, 1320 and 1330, 1450 and 1460, and 1470. The protruding elements 1494 frictionally engage the sheet stock material to provide a more positive grip on same and therefore improve the pulling effect of the pulling assembly 1472. The protruding elements 1494 may also function as stitching or perforating fingers that perforate the sheet stock material as it is advanced between the transfer members 1490. The protruding elements 1494 can have pointed ends for penetrating the sheet stock material and can be of a length sufficient enough to stitch together overlapped portions of the sheet stock material. Such stitching aids in retaining the shape of the strip of dunnage after the strip of dunnage is released by the transfer members 1490.

As is shown in FIG. 48, the pair of concave transfer members 1490 define there between a dunnage transfer region 1496 having a substantially oval or circular shaped cross section. Consequently, as the transfer members 1490 urge the strip of dunnage through the transfer region 1496, the transfer members 1490 transform the strip of dunnage into having a generally cylindrical or tubular shape.

The pulling assembly 1474 (FIG. 49) includes a pair of transfer members 1500 each having a cylindrical outer surface and a plurality of protruding elements 1504. The transfer members 1500 gather and laterally capture the sheet stock material passing there between in a manner similar to the aforedescribed transfer assemblies 359 and 361, 1320 and 1330, 1450 and 1460, 1470 and 1472. The protruding elements 1504 frictionally engage the sheet stock material to provide a more positive grip on same and therefore improve the pulling effect of the pulling assembly 1474. Like the protruding elements 1494 of the pulling assembly 1472, the protruding elements 1504 may also function as stitching or perforating fingers that perforate the sheet stock material as it is advanced between the transfer members 1500. The protruding elements 1504 can have pointed ends for penetrating the sheet stock material and can be of a length sufficient enough to stitch together overlapped portions of the sheet stock material. Such stitching aids in retaining the shape of the strip of dunnage after the strip of dunnage is released by the transfer members 1500.

It is noted that the pair of cylindrical transfer members 1500 define there between a dunnage transfer region 1506 having a substantially rectangular shaped cross section. Consequently, as the transfer members 1500 urge the strip of dunnage through the transfer region 1506, the transfer members 1500 transform the strip of dunnage into having a generally flatter or narrower horizontal dimension than vertical dimension. Like the aforedescribed protruding elements 1494 of the pulling assembly 1472, the size, shape, quantity and/or arrangement of the protruding elements 1504 of the pulling assembly 1474 will depend on, for example, the particular converting application.

Figure 50:
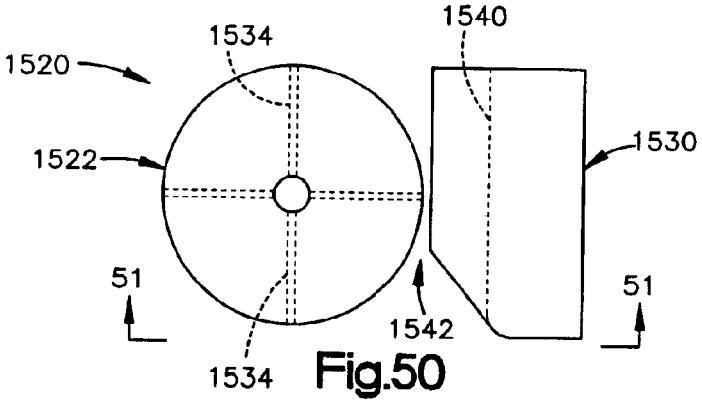
FIG. 50 is a schematic top plan view of yet another pulling mechanism in accordance with another embodiment of the present invention.
Figure 51:
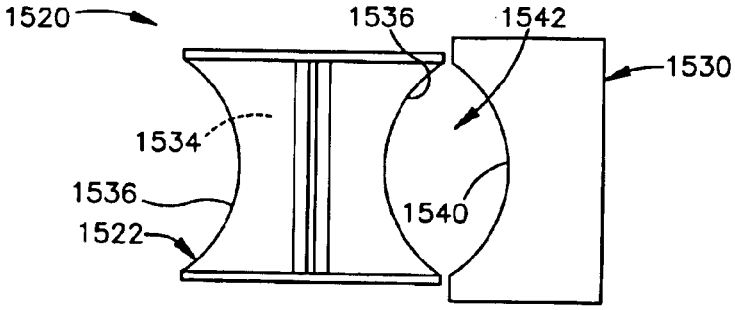
FIG. 51 is a schematic front elevational view of the pulling mechanism of FIG. 50 as viewed from the line 51—51 in FIG. 50.

Turning now to FIGS. 50 and 51, there is shown yet another embodiment of a pulling assembly 1520 in accordance with the present invention. The pulling assembly 1520 includes a first transfer assembly 1522 and a second transfer assembly, which also is referred to as a gripper, in the form of a channel 1530 positioned opposite the first transfer assembly 1522. The as shown transfer assembly 1522 is similar in construction and functions in a manner similar to the transfer assemblies 1320 and 1330, and 1450 and 1460. The transfer assembly 1522 includes a plurality of grippers 1534 that are preferably uniformly circumferentially spaced and preferably have a semi-oval or semi-circular shaped aperture 1536. In the illustrated exemplary embodiment, the transfer assembly 1522 includes four grippers 1534. The other gripper, or channel 1530, also has an aperture 1540 (i.e., cross sectional shape) that in the illustrated exemplary embodiment is substantially the same size and shape as viewed from the side (FIG. 51) as the apertures 1536 of the grippers 1534. The channel 1530 preferably has a smooth surface. The transfer assembly 1522 and the channel 1530 of the pulling assembly 1520 define there between a dunnage transfer region 1542 having a substantially oval or circular shaped cross section, as is illustrated in FIG. 51.

During operation of the dunnage conversion machine, the transfer assembly 1522, and the channel 1530 opposite therefrom, cooperate to gather and laterally capture the sheet stock material and draw same through the transfer region 1542 located between the transfer assemblies 1522 and 1530, to convert the sheet stock material into a strip of dunnage. It will be appreciated that the transfer assembly or channel 1530 may be slotted to receive the outermost portion of the transfer assembly 1522, thereby to provide for greater overlap and thus continuity between the transfer assembly 1522 and the channel 1530.

Figure 52:
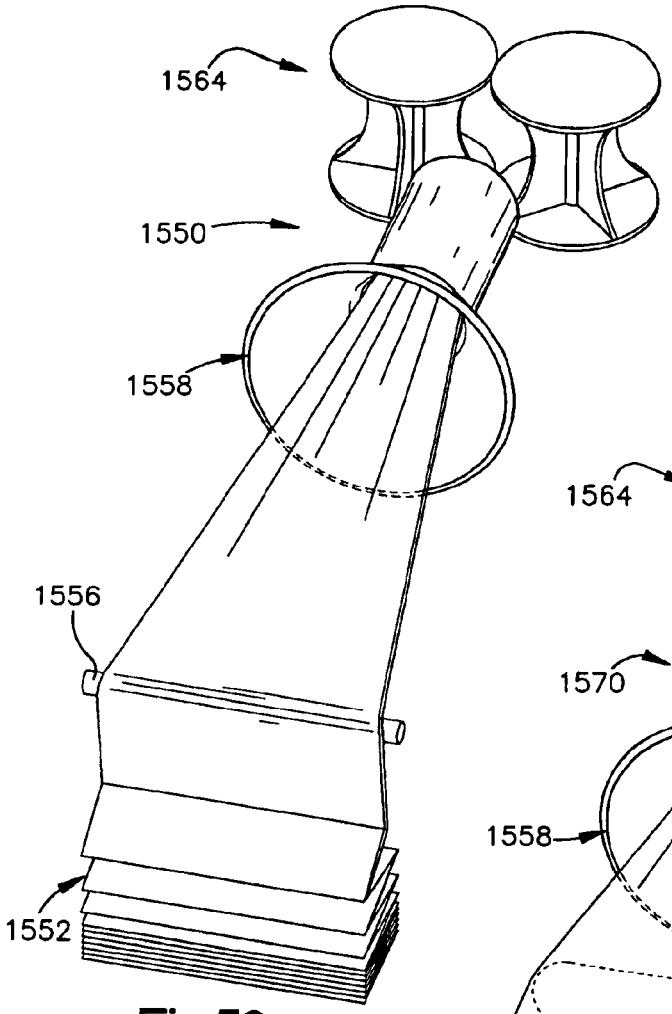
FIG. 52 is a schematic perspective view of a pulling mechanism, forming section and stack of sheet stock material in accordance with another embodiment of the present invention, with the sheet stock material being shown trained around a constant entry roller and passing through the forming section.

Referring now to FIG. 52, there is shown an embodiment of a forming section 1550 and a pulling assembly 1564 similar to the forming section 1302 and pulling assembly 1300 shown in FIG. 41, except that the forming section 1550 does not include the pair of side guide bars 345. Another difference between the embodiments shown in FIG. 52 and FIG. 41 is that the supply of fan folded sheet stock material 1552 in FIG. 52 has a smaller width than the supply of sheet stock material 1308 in FIG. 41. In a similar fashion, the constant entry roller 1556 corresponds in width to the forming section 1550, and therefore is less in width than the constant entry roller 196 in the embodiment of FIG. 41.

Because of the reduced size of the supply of sheet stock material 1552 and the constant entry roller 1556, the embodiment shown in FIG. 52 may be installed into a cushioning conversion machine having a smaller housing than that of a cushioning conversion machine for the FIG. 41 embodiment. A reduction in the size of a cushioning conversion machine provides various advantages such as lower shipping costs, easier delivery, more efficient service procedures, decreased need for storage space, etc.

In the FIG. 52 embodiment, the supply of sheet stock material 1552 includes a single ply of sheet stock material that is folded, for example in half, upon itself along the length of the sheet stock material so that, in effect, the single ply sheet stock material has two superimposed portions or flat layers joined at a longitudinally extending edge fold, for example the left edge in FIG. 52. The longitudinally folded sheet stock material is fan folded into a rectangular stack, and the series of folds together form a sequence of rectangular pages which are piled accordion style one on top of the other to form the stack of sheet stock material. For further details relating to an exemplary stack of longitudinally and fan-folded sheet stock material, and the means for forming same, reference may be had to U.S. Pat. Nos. 5,387,173; 5,882,767; 6,015,374; and 6,168,847, all of which are assigned to the assignee of the present invention and are hereby incorporated herein by reference in their entireties.

During operation of a dunnage conversion machine incorporating the reduced width supply of sheet stock material 1552 and constant entry roller 1556, the single-ply two-layer fan folded sheet stock material is trained around the constant entry roller 1556 and advances to the tapered or funnel portion 1558 of the forming section 1550. The forming section 1550 guides, forms and shapes the sheet stock material and directs the formed strip of dunnage into the pulling assembly 1564.

Figure 53:
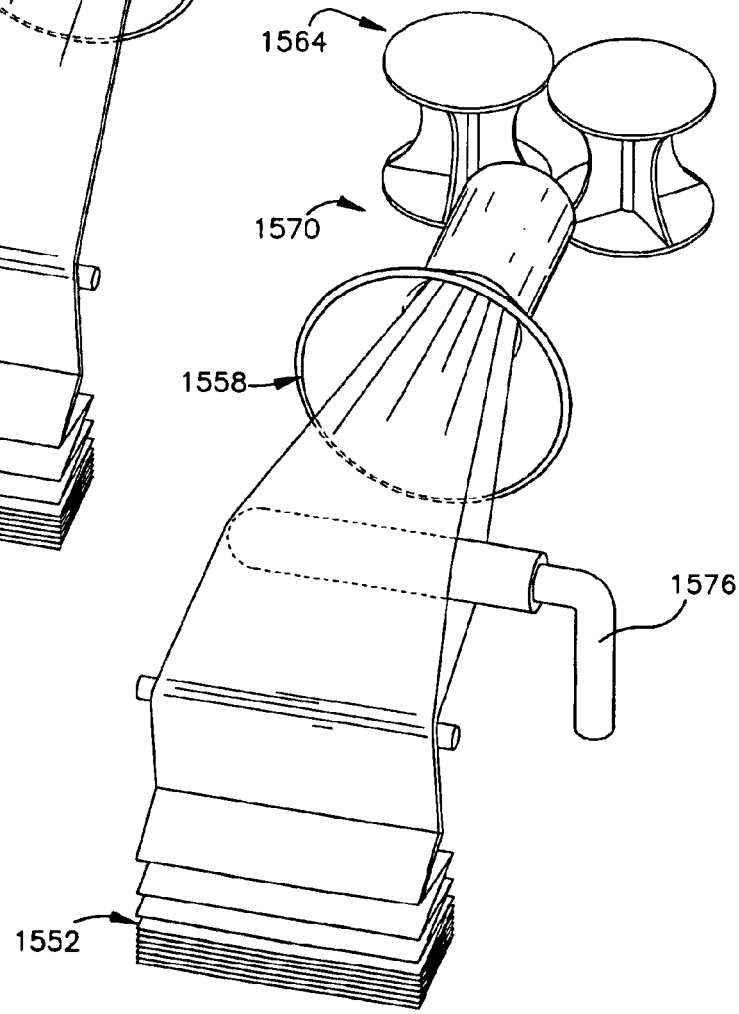
FIG. 53 is a schematic perspective view of the pulling mechanism, forming section and stack of sheet stock material of FIG. 49, as well as an expanding device in accordance with the present invention.

The FIG. 53 embodiment is similar to that of FIG. 52, except in the FIG. 53 embodiment the forming section 1570 thereof includes an expanding device 1576 that is operative to open up, or "expand", the single-ply two-layer fan folded sheet stock material, thereby forming an expanded strip of flat folded sheet material, before passage through the tapered portion 1558. As a result, the flat layers are separated from one another, thereby introducing loft into the then expanded material which now takes on a three dimensional shape as it enters the tapered portion 1558 of the forming section 1550.

A method of operating any of the aforedescribed dunnage conversion machines 10, 762, 800, and 910 in accordance with the present invention is now described. Any of the dunnage conversion machine may be adapted to include software control of ramping-up speeds (for example, during start-up) and ramping down speeds (for example, during shut down), and also the different speeds at which the machine can operate during a dunnage converting process.

In an embodiment of the present invention, the dunnage conversion machine (i.e., also referred to herein as a dunnage converter) includes controller software that is preprogrammed to operate at a specific motor start-up speed, three operating speeds, and a specific shut down ramp speed. In an alternative embodiment, the controller software of the dunnage converter is programmed by an end user to operate the dunnage converter at any desired motor start-up speed, any desired operating speed, or any desired shut down ramp speed. As will be appreciated, the operating speeds of the motor will be based on the characteristics of the motor and/or other drive components of the dunnage converter. Since different end users may have different packaging requirements, this would allow each end user to program its own machine in a manner most suitable for the end users converting applications.

Although the invention has been shown and described with respect to a certain preferred embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A supply of sheet stock material for use with a dunnage conversion machine, comprising:

a stack of tan-folded sheet stock material;

a jacket at least partially surrounding the stack; and at least one bale tie securing the jacket to the stack of sheet stock material, wherein the jacket has at least two flaps forming an L-shape cross section, a corner of the stack being disposed adjacent the corner of the L-shape jacket.

2. A supply as set forth in claim 1, wherein at least one of the flaps extends substantially the full extent of one side of the stack.

3. A supply as set forth in claim 1, wherein the jacket extends over at least two sides of the stack.

4. A supply as set forth in claim 1, wherein the stock material is kraft paper.

5. A supply as set forth in claim 1, wherein the stock material includes a multi-ply sheet stock material.

6. A supply as set forth in claim 1, wherein the jacket is made of a material that includes at least one of cardboard and plastic.

7. A supply as set forth in claim 1, wherein the bale ties are made of a material that includes at least one of wire and nylon.

8. A supply as set forth in claim 1, wherein the stack has a rectangular shape with sides that have a length dimension that is greater than a width dimension and a depth dimension that define rectangular ends of the stack, and the jacket extends over at least part of each of two sides of the stack, and the bale ties extend over all four sides of the stack to hold the stack together.

9. A supply as set forth in claim 8, wherein the jacket extends over at least part of two sides of the stack and has open ends.

10. A supply as set forth in claim 1, wherein the jacket extends over at least part of at least two sides of the stack and has open ends.

11. A supply of sheet stock material for use with a dunnage conversion machine, comprising:

a stack of fan-folded sheet stock material;

a jacket at least partially surrounding the stack; and at least one bale tie securing the jacket to the stack of sheet stock material, wherein the jacket has at least two flaps forming an L-shape cross section, a corner of the stack being disposed adjacent the corner of the L-shape jacket so that the jacket extends over at least part of each of two sides of the stack.

12. A supply as set forth in claim 11, wherein the jacket extends over at least part of at least two sides of the stack and has open ends.

13. A supply of sheet stock material for use with a dunnage conversion machine, comprising:

a stack of fan-folded sheet stock material;

a jacket at least partially surrounding the stack; and at least one bale tie securing the jacket to the stack of sheet stock material, wherein the jacket has an L-shape cross-section, and the jacket has a base flap and an upright flap separated by a fold line to give the jacket its L-shape cross-section.

* * * * *

UNITED STATES PATENT AND TRADEMARK OFFICE

CERTIFICATE OF CORRECTION

PATENT NO. : 6,918,489 B2
APPLICATION NO. : 10/420519
DATED : July 19, 2005
INVENTOR(S) : Joseph J. Harding et al.

It is certified that error appears in the above-identified patent and that said Letters Patent is hereby corrected as shown below:

Column 38, line 31, claim 1, “tan-folded” should read -- fan-folded --.

Signed and Sealed this

Twenty-ninth Day of July, 2008

JON W. DUDAS
*Director of the United States Patent and Trademark Office*